US006729254B2

(12) United States Patent
Mamiya et al.

(10) Patent No.: US 6,729,254 B2
(45) Date of Patent: May 4, 2004

(54) SEWING APPARATUS AND SEWING METHOD

(75) Inventors: Toshiyuki Mamiya, Kasugai (JP); Akira Terao, Nagoya (JP)

(73) Assignee: Brother Kogyô Kabushiki Kaisha, Nagoya (JP)

( * ) Notice: Subject to any disclaimer, the term of this patent is extended or adjusted under 35 U.S.C. 154(b) by 202 days.

(21) Appl. No.: 10/026,891

(22) Filed: Dec. 27, 2001

(65) Prior Publication Data

US 2002/0078871 A1 Jun. 27, 2002

(30) Foreign Application Priority Data

Dec. 27, 2000 (JP) ..... 2000-396877

(51) Int. Cl.[7] ..... D05B 5/02; D05C 15/28

(52) U.S. Cl. ..... 112/475.19; 112/80.16; 112/80.23

(58) Field of Search ..... 112/475.04, 475.05, 112/475.18, 475.19, 475.23, 80.16, 80.23, 80.3, 470.06, 80.31, 80.01, 102.5

(56) References Cited

U.S. PATENT DOCUMENTS

| | | | | |
|---|---|---|---|---|
| 3,361,095 A | * | 1/1968 | Short | 112/80.16 |
| 3,385,247 A | | 5/1968 | Johnson et al. | |
| 3,450,076 A | * | 6/1969 | Bender | 112/80.16 |
| 3,749,039 A | | 7/1973 | Fritts | |
| 4,077,339 A | | 3/1978 | Bass et al. | |
| 4,100,867 A | | 7/1978 | Bass et al. | |
| 4,549,496 A | | 10/1985 | Kile | |
| 4,669,406 A | | 6/1987 | Muroya | |
| 4,991,523 A | | 2/1991 | Ingram | |
| 5,205,233 A | | 4/1993 | Ingram | |
| 5,503,092 A | | 4/1996 | Aubourg et al. | |
| 5,803,001 A | | 9/1998 | Shimizu et al. | |
| 5,941,185 A | * | 8/1999 | Selbach et al. | 112/80.16 |
| 6,135,038 A | | 10/2000 | Okamoto | |

FOREIGN PATENT DOCUMENTS

JP A 10-151287 6/1998

OTHER PUBLICATIONS

U.S. patent application Ser. No. 09/897,393, Shimizu, filed Jul. 3, 2001.

U.S. patent application Ser. No. 09/897,600, Mamiya et al., filed Jul. 3, 2001.

* cited by examiner

*Primary Examiner*—Peter Nerbun
(74) *Attorney, Agent, or Firm*—Oliff & Berridge, PLC

(57) ABSTRACT

A sewing apparatus performs sewing operation on a work piece that moves along an X-Y plane perpendicular to an axial direction of a hollow needle having an inclined opening that is formed by angular cutting a portion of an end portion of the hollow needle that penetrates the work piece with respect to the axial direction of the hollow needle, by reciprocating the hollow needle in a penetrating direction, using a thread threaded in the hollow needle. In the sewing apparatus, Tatami stitches are formed on the work cloth with a plurality of stitches. First, a plurality of stitches are formed in a first stitching direction along a line angled between 20° and 160° with respect to a needle tip opening direction. Then, by controlling direction of movement of the work cloth so that the stitches in a second stitching direction proceed to an area opposite to the needle tip opening direction, a plurality of stitches are formed in a second stitching direction opposite to the first stitching direction, following and in parallel with the stitches formed in the first stitching direction.

20 Claims, 38 Drawing Sheets

SEWING APPARATUS AND SEWING METHOD

BACKGROUND OF THE INVENTION

1. Field of Invention

The invention relates to a sewing method for forming stitches, such as embroideries, on a work cloth, and to a patterned cloth formed using the method above.

2. Description of Related Art

Conventionally, a sewing apparatus, such as a sewing machine, performs sewing on a work cloth using upper and lower threads in cooperation with a thread take-up, a thread loop taker and a needle. The needle is threaded with the upper thread and moves vertically. A general home sewing machine performs sewing using a single needle attached to a lower end of a needle rod. Accordingly, when the upper thread wound around a spool runs out or when an upper thread needs to be changed to sew a different color of a color pattern, after the spool for the upper thread is changed, the upper thread is threaded to a predetermined guide portion provided on the sewing machine and then needs to be threaded through a needle hole.

In the known sewing apparatus, the sewing needle has the needle hole at its lower end and a thread is threaded through the needle hole. Therefore, it is difficult to form a pattern unless the needle cooperates with a thread take-up and a thread loop taker during a sewing operation. That is, a driving mechanism that drives the thread take-up and the thread loop taker is needed.

A known sewing apparatus used with a sewing cartridge accommodating a needle and a spool therein, that can be attached to and detached from the sewing apparatus, wherein threading of an upper thread and threading of an upper thread through a needle hole can be omitted when an upper thread wound around a spool runs out or when an upper thread needs to be changed to sew a color pattern, is disclosed in U.S. Pat. No. 4,100,867, the disclosure of which is incorporated herein by reference.

In the sewing apparatus disclosed in U.S. Pat. No. 4,100,867, the needle attached to the sewing cartridge is similar to a general sewing needle wherein a thread is threaded through a needle hole at its lower end. When the sewing cartridge is attached to the sewing apparatus, the needle and a needle up and down mechanism, provided to the sewing apparatus, are connected to each other to move integrally. As a machine motor is driven, the needle is moved up and down by the needle up and down driving mechanism with respect to the sewing cartridge fixed to the main body of the sewing machine. Thus, the operation in which the needle passes through a work cloth is repeated, whereby sewing is performed on a work cloth using upper thread and a looper member.

Japanese Laid-Open Patent publication No. 7-24173 discloses a sewing cartridge that can be easily detachably attached to a sewing machine. In a state where the sewing cartridge is removed from the sewing machine, an upper thread is held by a cartridge lever at a position, which is out of an operating range of end portions of a thread take-up and is higher than a highest thread take-up position. When the sewing cartridge is attached to the sewing machine, the end portions of the thread take-up are inserted into respective openings provided under the cartridge lever and a needle clamp in the sewing cartridge and a cartridge support shaft are connected each other. In this state, when a main shaft is rotated, the needle clamp and the end portions of the thread take-up move downward, so that the upper thread is pulled. Then, the cartridge lever is rotated downward, against an urging force from a spring, by a tension produced on the upper thread. After that, the needle clamp ascends, and a work cloth is advanced. As the end portions of the thread take-up move upward, the cartridge lever is pushed upward by the end portions of the thread take-up. The disclosure of Japanese Laid-Open Patent publication No. 7-24173 is herein incorporated by reference.

U.S. Pat. No. 3,749,039 discloses a sewing cartridge including a casing, a housing area formed in the casing to house a spool therein, a thread tension applying mechanism, and a plurality of thread guide portions. When the sewing cartridge is attached to a sewing apparatus, an upper thread, extending from the spool, in the sewing cartridge is automatically threaded onto a thread tensioning member provided in the sewing apparatus. The disclosure of U.S. Pat. No. 3,749,039 is herein incorporated by reference.

In the sewing cartridge disclosed in Japanese Laid-Open Patent No. 7-24173, the needle clamp and the cartridge lever need to be moved up and down. Therefore, the sewing cartridge becomes large because the sewing cartridge needs to be large enough for the needle clamp and the cartridge lever to move vertically therein. In addition to this, a number of parts required to be installed in the sewing cartridge is increased and an internal structure of the sewing cartridge becomes complicated. The sewing cartridge disclosed in U.S. Pat. No. 3,749,039 is provided with the housing area for the spool, the thread tension applying mechanism and the plurality of thread guide portions, so that the sewing cartridge also becomes large in size. Further, a number of parts required to be installed in the sewing cartridge is increased and an internal structure of the sewing cartridge becomes complicated.

SUMMARY OF THE INVENTION

The invention provides a sewing method that offers excellent stitches and provides a patterned cloth using the sewing method.

According to one aspect of the invention, a sewing operation is performed on a workpiece that moves along an X-Y plane perpendicular to an axial direction of a hollow needle. The hollow needle has an inclined opening that is formed by angularly cutting a portion of an end of the hollow needle that penetrates the workpiece with respect to the axial direction of the hollow needle. The sewing operation is performed by reciprocating the hollow needle in a penetrating direction, using a thread threaded in the hollow needle. The sewing operation includes forming a plurality of stitches in a first stitching direction, and forming a plurality of stitches in a second stitching direction opposite to the first stitching direction, following and in parallel with the plurality of stitches formed in the first stitching direction, by turning the hollow needle around in a direction opposite to the needle tip opening direction.

BRIEF DESCRIPTION OF THE DRAWINGS

An embodiment of the invention will be described in detail with reference to the following figures wherein.

DETAILED DESCRIPTION OF PREFERRED EMBODIMENTS

An embodiment of the invention will be described with reference to the accompanying drawings.

Figure 1:
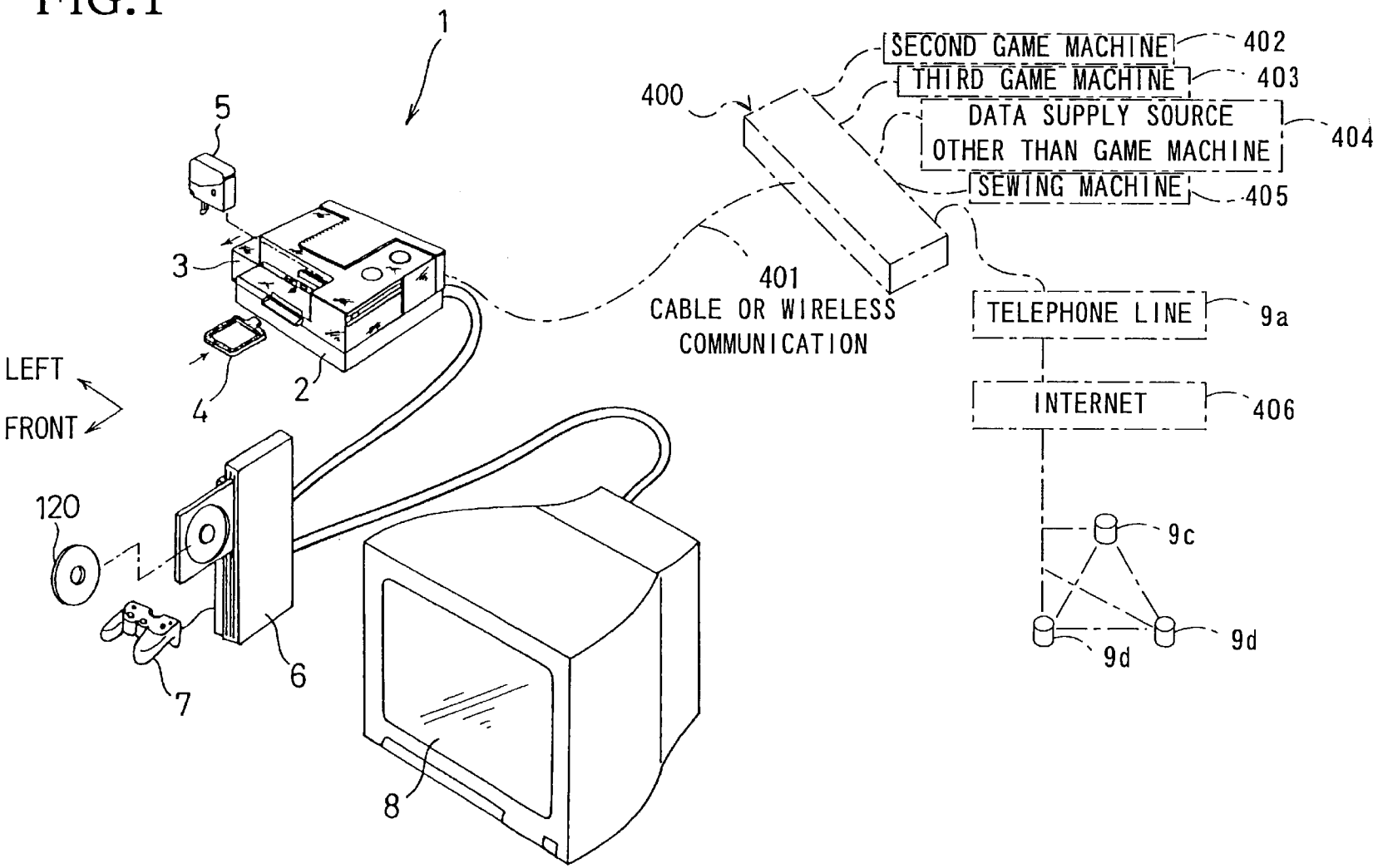
FIG. 1 is a perspective view showing a sewing apparatus according to a first embodiment of the invention and a game machine.

As shown in FIG. 1, a sewing apparatus 1 of the embodiment is connected to a home video game machine 6 including a controller 7 via a connecting cable. In the sewing apparatus 1, an embroidery pattern is selected/edited using the game machine 6 while the embroidery pattern is observed on a screen of a display (CRT) 8 (a home television). The selected/edited embroidery pattern can be embroidered on a predetermined work cloth. A description will be made in the embodiment using directions shown in FIG. 1 of the sewing apparatus 1 and as are applied throughout several drawings. Orientation of a sewing cartridge is defined in a state where the sewing cartridge is attached to the sewing apparatus 1 shown in FIG. 1.

Figure 2:
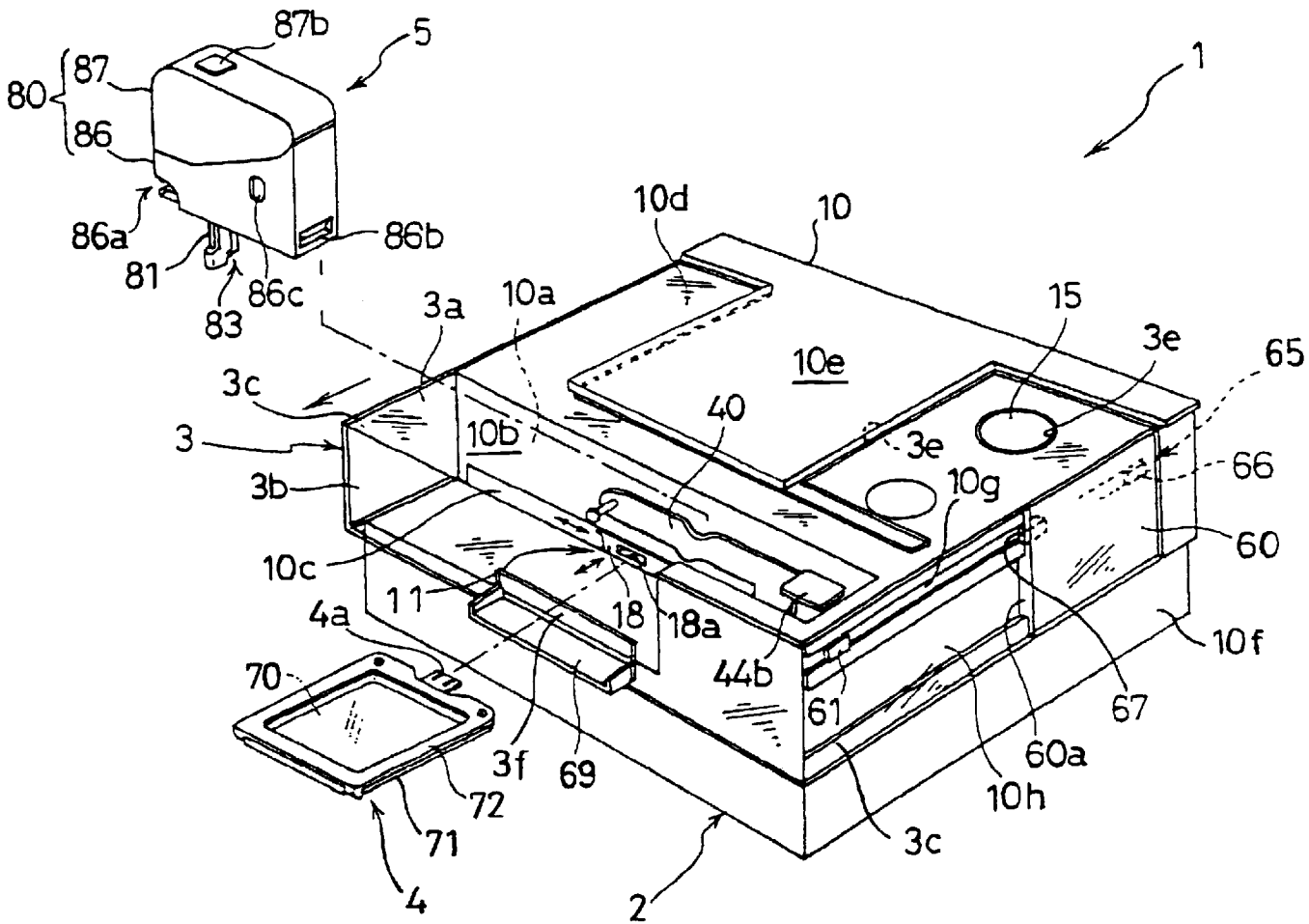
FIG. 2 is a perspective view of the sewing apparatus (when a safety cover is in a storage position)
Figure 3:
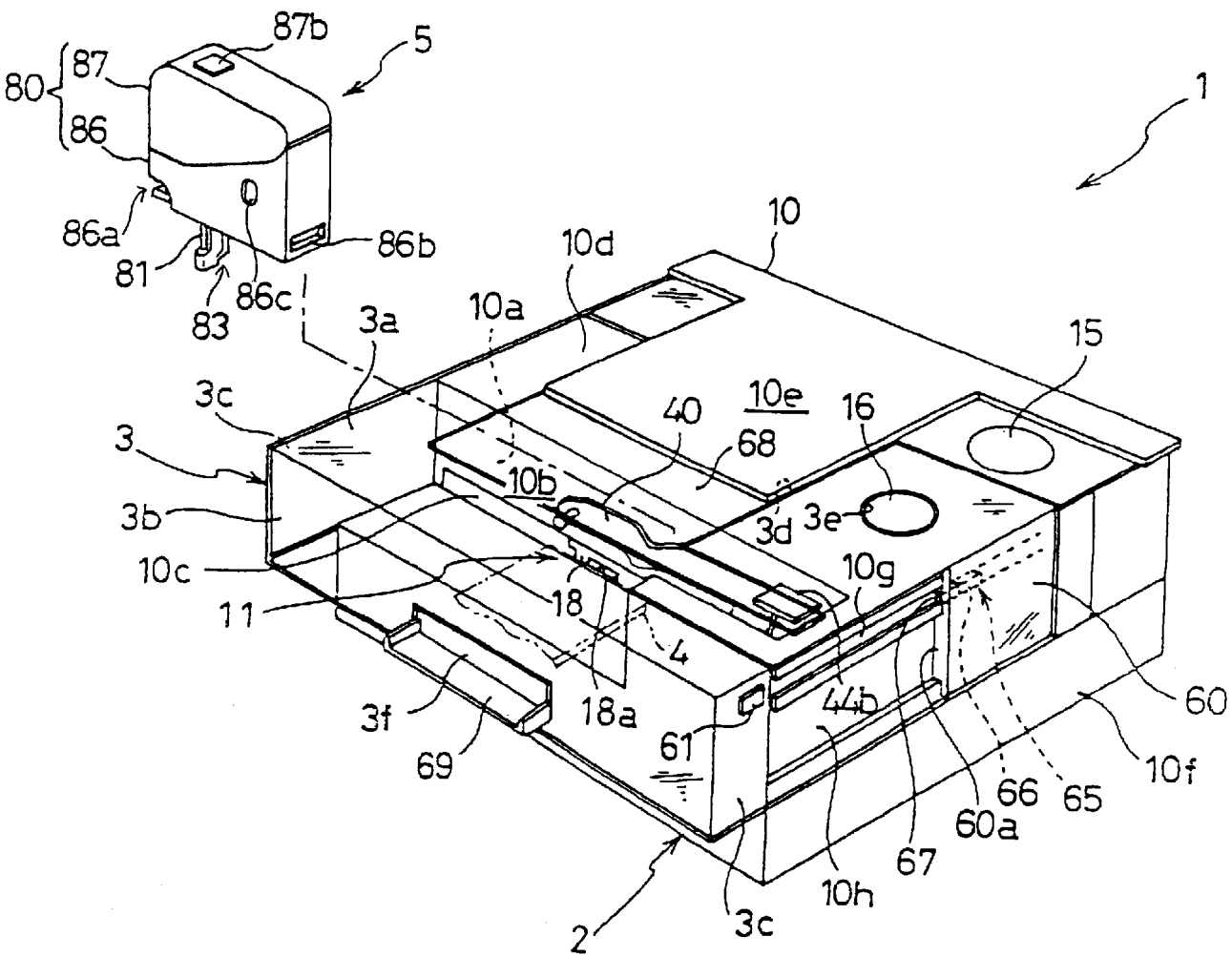
FIG. 3 is a perspective view of the sewing apparatus (when the safety cover is in a sewing position)
Figure 4:
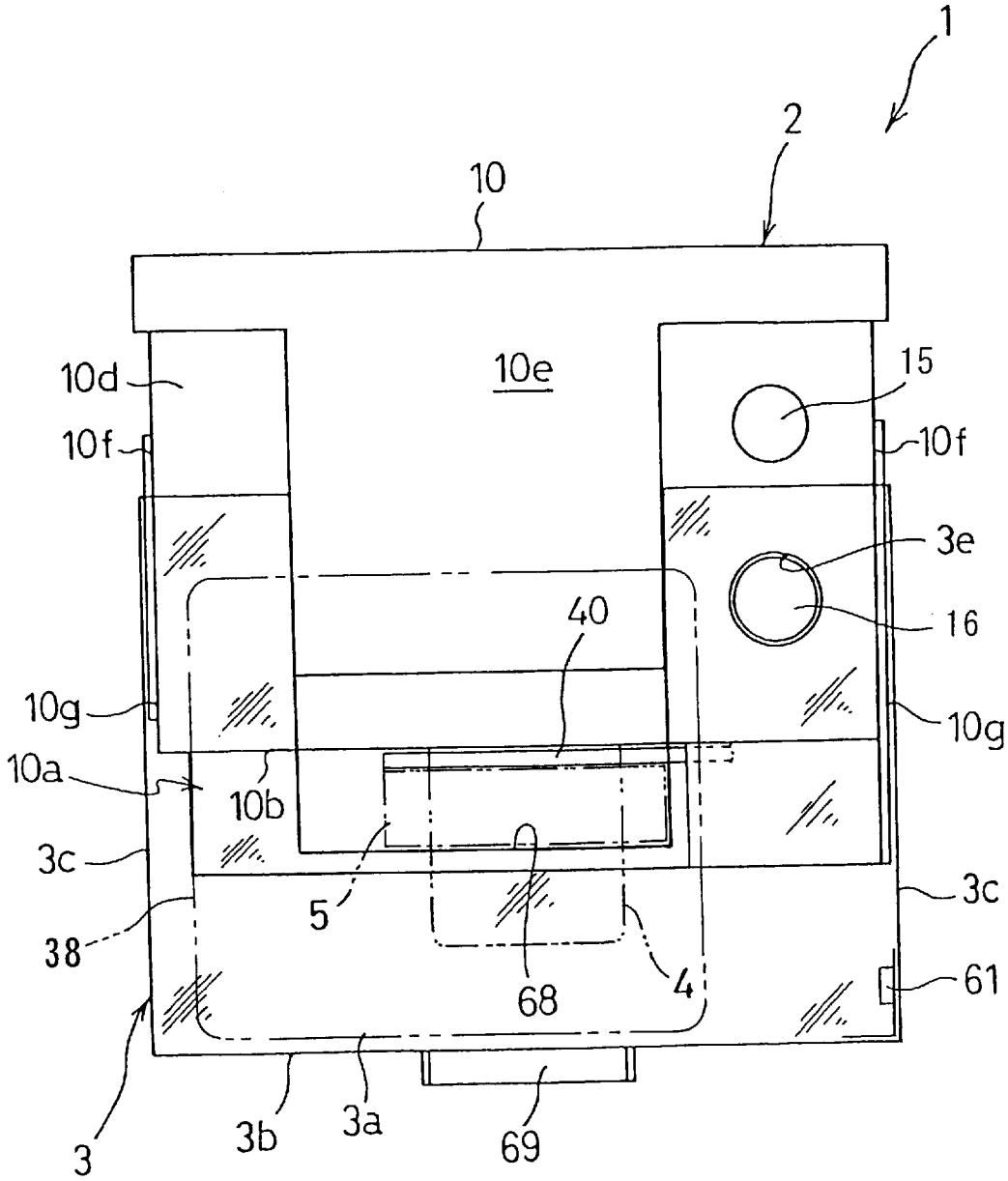
FIG. 4 is a plan view of the sewing apparatus (when the safety cover is in the sewing position)
Figure 5:
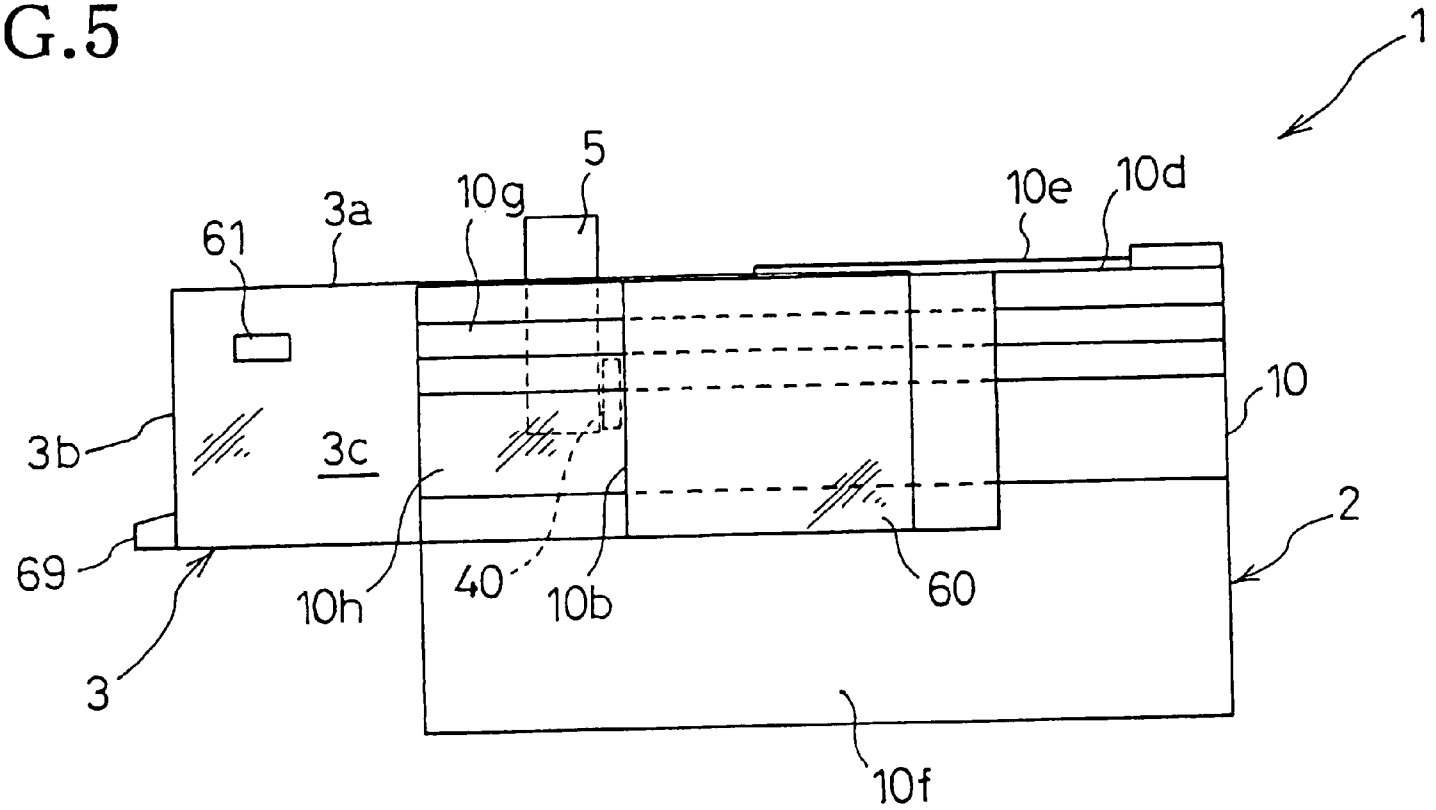
FIG. 5 is a right side view of the sewing apparatus (when the safety cover is in the sewing position)

As shown in FIGS. 1 to 3, the sewing apparatus 1 includes a sewing apparatus body 2, a safety cover 3 slidably attached to the sewing apparatus body 2 in a back and forth direction, an embroidery frame 4, and a sewing cartridge 5. The embroidery frame 4 and the sewing cartridge 5 are detachably attached to the sewing apparatus body 2. A work cloth 70, to be sewn, is attached to the embroidery frame 4. A hollow needle 81 for sewing, that can pass through the work cloth 70, is provided in the sewing cartridge 5.

First, the sewing apparatus body 2 will be described. As shown in FIGS. 2 to 8, the sewing apparatus body 2 includes a casing 10, an embroidery frame driving mechanism 11 that moves the embroidery frame 4 having the work cloth 70 in a horizontal plane with respect to the hollow needle 81 while the embroidery frame 4 is held by a carriage 18, a cartridge driving mechanism 12 that swings the sewing cartridge 5, attached to a swing arm 40, up and down, and a controller 13 (see FIG. 42) that controls the embroidery frame driving mechanism 11 and the cartridge driving mechanism 12.

The casing 10 has a relatively small box shape (for example, 130 mm in length, 165 mm in width, 70 mm in height). Substantial parts of the embroidery frame driving mechanism 11 and the cartridge driving mechanism 12 and the controller 13 are accommodated in the casing 10. The casing 10 is cut away approximately two-thirds of the way from a left side (as shown in FIGS. 1 and 2) of the casing 10 in the length, approximately one-fourth of the way from a front side, and approximately half of the height from the top. Thus, a cutaway space 10*a* is formed in the casing 10. The right forward part of the upper wall 10*d* of the casing 10 is cut away so that an operating member 44*b* (described later) can be operated. The cutaway portion communicates with the cutaway space 10*a*.

A slit 10*c*, extending in a right and left direction, is formed in a lower end portion of a front wall 10*b* of the casing 10 within the cutaway space 10*a*. The slit 10*c* is provided to attach the embroidery frame 4 to the carriage 18 and to move the embroidery frame 4 in a horizontal plane. A slit extending in a vertical direction (not shown) is formed in the side wall of the casing 10 within the cutaway space 10*a*. The swing arm 40 of the cartridge driving mechanism 12 protrudes into the cutaway space 10*a* from the inside of the casing 10 and is vertically movable in the vertical slit.

On an upper wall 10*d* of the casing 10, a guide upper surface 10*e* is formed as a step. A middle area of the guide upper surface 10*e* protrudes toward the front of the casing 10. On the right side of the guide upper surface 10*e*, a power switch 15, electrically connected to the controller 13, and a start/stop switch 16 that commands the start and an end of sewing, are provided. Upper surfaces of the power switch 15 and the start/stop switch 16 are positioned at the same or a slightly lower level than the upper surface of the upper wall 10*d*.

To assist attachment/detachment of the sewing cartridge 5 to/from the swing arm 40, in front of the guide upper surface 10*e* (described later), a front end of the guide upper surface 10*e* is longer in length in the right and left direction than the sewing cartridge 5. Accordingly, the front end of the guide upper surface 10*e* extends toward and behind the sewing cartridge 5 that is attached to the swing arm 40.

Guide grooves 10*g*, 10*h* are formed in the front and rear direction in right and left side walls 10*f* the casing 10. The width of the guide groove 10*g* is narrower than that of the guide groove 10*h*. An engagement block piece 67 is fixed to each guide groove 10*g* in a substantially mid-position, between the front and back sides, of the casing 10, and protrudes outwardly. Because the cutaway space 10*a* exists in the casing 10, the length of the guide grooves 10*g*, 10*h* in the left wall 10*f* is shorter than that of the guide grooves 10*g*, 10*h* in the right wall 10*f*.

Figure 6:
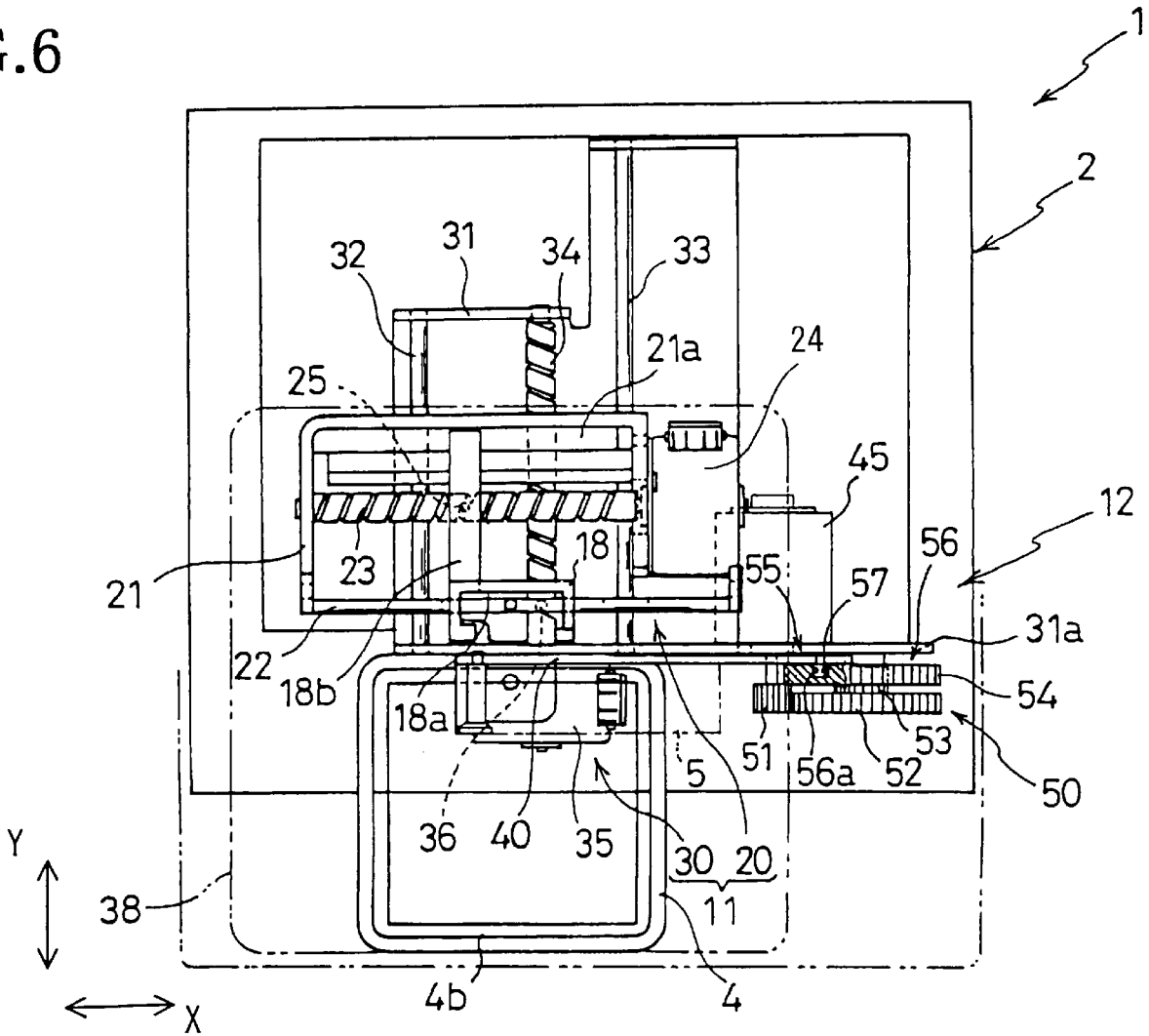
FIG. 6 is a transverse sectional view of the sewing apparatus.

As shown in FIGS. 2, 3, and 6, the embroidery frame driving mechanism 11 includes the carriage 18 to which the embroidery frame 4 is detachably attached, an X-axis direction driving mechanism 20 that moves the carriage 18 in an X-axis direction (the right and left direction) within a horizontal plane, and a Y-axis direction driving mechanism 30 that moves the carriage 18 in a Y-axis direction (the front and rear direction) perpendicular to the X-axis direction, within the horizontal plane.

The carriage 18 has an engagement portion 18*a* that can engage/disengage a rear end support portion 4*a* of the embroidery frame 4 thereto/therefrom and a guide plate 18*b* that extends rearward from the underside of the engagement portion 18*a*. When the embroidery frame 4 is attached to or detached from the carriage 18, the carriage 18 is positioned under the swing arm 40. A moving frame 21 of the X-axis direction driving mechanism 20 is formed with a guide portion 21*a* in the right and left direction at its rear and is provided with a guide rod 22 in the right and left direction at its front. The carriage 18 is movably supported and guided in the right and left direction by the guide portion 21*a* and the guide rod 22.

The X-axis direction driving mechanism 20 has the moving frame 21, the guide rod 22, a screw shaft 23, a pulse motor 24, and a guide pin 25. The moving frame 21 has a substantially box shape and an upper open structure. The guide rod 22 is supported by side walls of the moving frame 21 at its ends. The screw shaft 23 is disposed inside of the moving frame 21, extending in the right and left direction. A left end of the screw shaft 23 is rotatably supported by the left wall of the moving frame 21. The pulse motor 24 is fixed on the right of the right wall of the moving frame 21. An output shaft of the pulse motor 24 is directly connected to a right end of the screw shaft 23.

The guide plate 18*b* of the carriage 18 is disposed above the screw shaft 23. The guide pin 25 is fixed to the guide plate 18*b* so as to protrude downward. The guide pin 25 slidably engages a spiral groove formed in the screw shaft 23. As the screw shaft 23 is rotated by the pulse motor 24, the guide pin 25 is guided along the spiral groove, so that the guide pin 25 moves from side to side. As a result, the carriage 18 is moved in the X-axis direction.

The Y-axis direction driving mechanism 30 has a support frame 31, two guide rods 32, 33, a screw shaft 34, a pulse motor 35, and a guide pin 36. The support frame 31 has a substantially concave shape when viewed from the side. The guide rods 32, 33, extend in the front to back direction and are supported by the front and the rear walls at their ends. The support frame 31 of the Y-axis direction driving mechanism 30 is movably supported and guided in the back and forth direction by the guide rods 32, 33.

The screw shaft 34 extends in the front to back direction. The screw shaft 34 is rotatably supported by the rear wall of the support frame 34 at its rear end. The pulse motor 35 is fixed at the front of the front wall of the support frame 31. An output shaft of the pulse motor 35 is directly connected to the front end of the screw shaft 34. The guide pin 36 is fixed to the moving frame 21 so as to protrude downward. The guide pin 36 slidably engages a spiral groove formed in the screw shaft 34. As the screw shaft 34 is rotated by the pulse motor 35, the guide pin 36 is guided along the spiral groove, so that the guide pin 36 moves back and forth. As a result, the carriage 18 is moved in the Y-axis direction together with the moving frame 21. The Y-axis direction driving mechanism 30 is disposed under the X-axis direction driving mechanism 20.

An embroidery frame moving area 38, shown in FIG. 6, is an area in which the embroidery frame 4, attached to the carriage 18, can be moved by the embroidery frame driving mechanism 11. The hollow needle 81 in the sewing cartridge 5 attached to the sewing apparatus body 2 is positioned substantially at a center of the embroidery frame moving area 38. The sewing cartridge 5 is attached to the forward part of the sewing apparatus body 2, so that the embroidery frame moving area 38 extends from the casing 10. As described above, the Y-axis direction driving mechanism 30 is disposed under the X-axis direction driving mechanism 20 and each of the driving mechanisms 20, 30 is positioned under the embroidery frame moving area 38 of the carriage 18. Accordingly, the sewing apparatus body 2 can be downsized.

As shown in FIGS. 6 to 9, the cartridge driving mechanism 12 has the swing arm 40 that the sewing cartridge 5 is attached to or detached from, a machine motor 45, that is an AC motor, as drive source to move the swing arm 40 up and down, a gear mechanism 50 that reduces the rotation speed of the machine motor 45, and a cam mechanism 55 that converts a rotary motion, reduced in its rotation speed by the gear mechanism 50, into up-and-down movements of the swing arm 40.

As shown in FIGS. 7, 8, and 19 to 21, the swing arm 40 is formed with an arm portion 40*a*, extending in the right and left direction, and a lever portion 40*b*, extending in the up and down direction, which are integral to form a single structure. The swing arm 40 is disposed at substantially the right half part of the forward part of the casing 10. The lever portion 40*b* is pivotally supported at its middle portion by a pivot shaft 41*b* which is supported by the sewing apparatus body 2 via a bracket 41*a*. A largest portion of the arm portion 40*a* protrudes toward the cutaway space 10*a*. The remaining portion, including the lever portion 40*b*, is accommodated in the casing 10.

An engaging pin 42, extending from front and rear of the casing 10, is fixed at a left end portion of the arm portion 40*a*. The engaging pin 42 rotatably supports the sewing cartridge 5 at the left end portion of the arm portion 40*a*. A lock release pin 43, also extending from front and rear, is fixed to the right of the engaging pin 42 so as to protrude toward the front of the casing 10. An engaging member 44*a* is rotatably supported by the swing arm 40. The engaging member 44*a* regulates the rotation of the sewing cartridge 5, which is pivotally supported by the engaging pin 42, in a position where sewing can be performed (see FIG. 21B) at the right of the lock release pin 43. The engaging pin 42 includes a shaft portion 42*a*, protruding from the arm portion 40*a*, and a head portion 42*b* provided at a free end side of the shaft portion 42*a* (see FIG. 20). The diameter of the head portion 42*b* is larger than that of the shaft portion 42*a*.

The arm portion 40*a* is also provided with a torsion spring (not shown) and a leaf spring 44*c*. The torsion spring rotatably urges the engaging member 44*a* in a clockwise direction. The leaf sprint 44*c* receives the sewing cartridge 5 in the sewable position from its bottom while elastically urging the sewing cartridge 5 upward. An engagement plate 19, that is integrally formed with a machine frame of the sewing apparatus body 2, is provided behind the swing arm 40. The engagement plate 19 extends from the right part of the machine frame of the sewing apparatus body 2 and toward the left. In front of the engagement plate 19, the operating member 44*b*, that is operated to rotate the engaging member 44*a* in a counterclockwise direction, is operably rotatably supported. A torsion spring 44*d* is provided to a support shaft of the operating member 44*b* while its one end is received by a fixing member 19*b* provided to the engagement plate 19 and its other end is received by a left end portion of the operating member 44*b*. The engagement plate 19 is also provided with a regulating member (not shown) that prevents the operating member 44*b* from being rotated other than the manual operation. With this structure, the operating member 44*b* is supported in a substantially horizontal position.

The engaging pin 42, the lock release pin 43, the engaging member 44*a*, the operating member 44*b* and the leaf spring 44*c* are provided in order to attach/detach the sewing cartridge 5 to/from the swing arm 40.

Figure 21A:
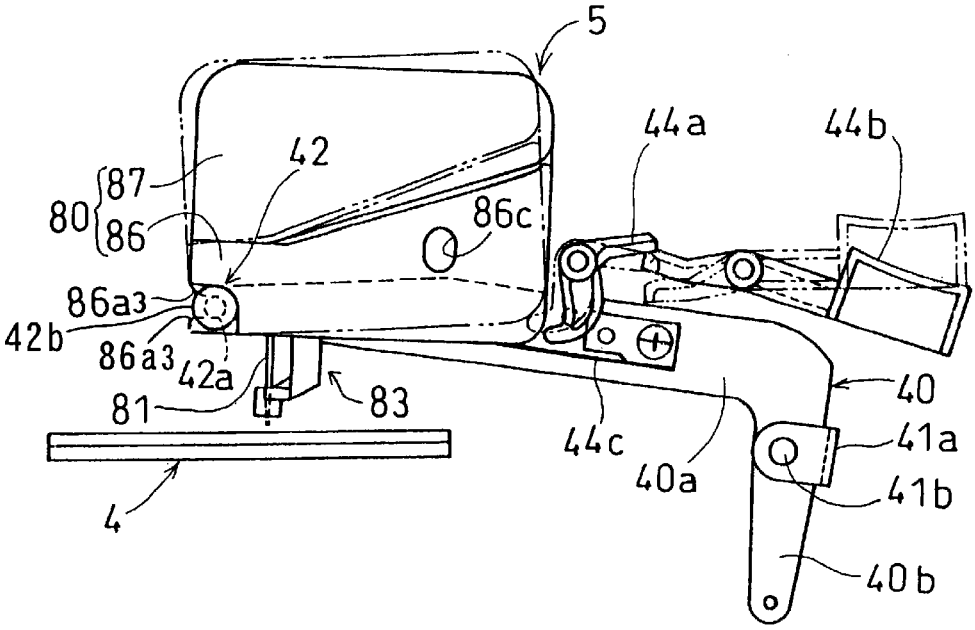
FIG. 21A shows a process of attaching/detaching the sewing cartridge to/from the swing arm.
Figure 21B:
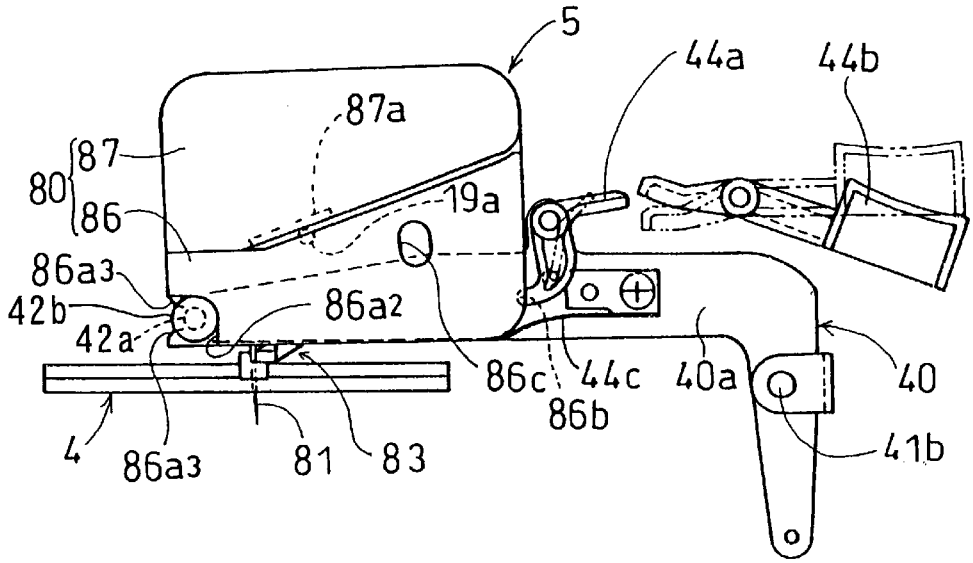
FIG. 21B is a front view of the sewing cartridge and the swing arm (when the sewing cartridge is completely attached to the swing arm)
Figure 22:
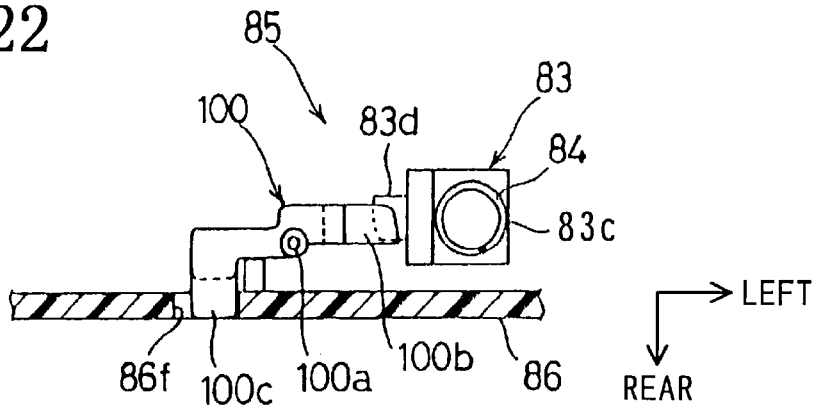
FIG. 22 is a plan view of a movement prohibiting mechanism (in a locked position)
Figure 23:
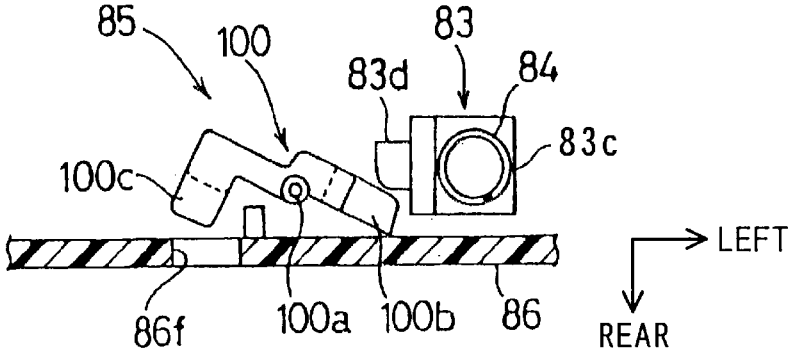
FIG. 23 is a plan view of the movement prohibiting mechanism (in an unlocked position)

As shown in FIG. 21B, when the free end side of the arm portion 40*a* of the swing arm 40 has descended and is in a sewing position (that is, when the hollow needle 81 is positioned near the work cloth 70 attached to the embroidery frame 4 or is penetrating the work cloth 70), a left end portion of the operating portion 44*b* (with respect to a center of rotation of the operating portion 44*b* in FIG. 21A) is apart from a right end portion of the engaging member 44*a* (with respect to a center of rotation of the engaging member 44*a* in FIG. 21A), so that they cannot contact each other. On the other hand, as shown in FIG. 21A, when the free end side of the arm portion 40*a* of the swing arm 40 has ascended, the left end portion of the operating member 44*b* can contact the right end portion of the engaging member 44*a* so that the sewing cartridge 5 can be detached from the swing arm 40. A positional relationship between the center of rotation of the swing arm 40 (the pivot shaft 41*b*) and the center of rotation of the operating member 44*b*, a distance between the center of rotation of the operating member 44*b* and the left end portion of the operating member 44*b*, and a distance between the center of rotation of the engaging member 44*a* and the right end portion of the engaging member 44*a* are set so that the above-described operation can be performed.

Figure 7:
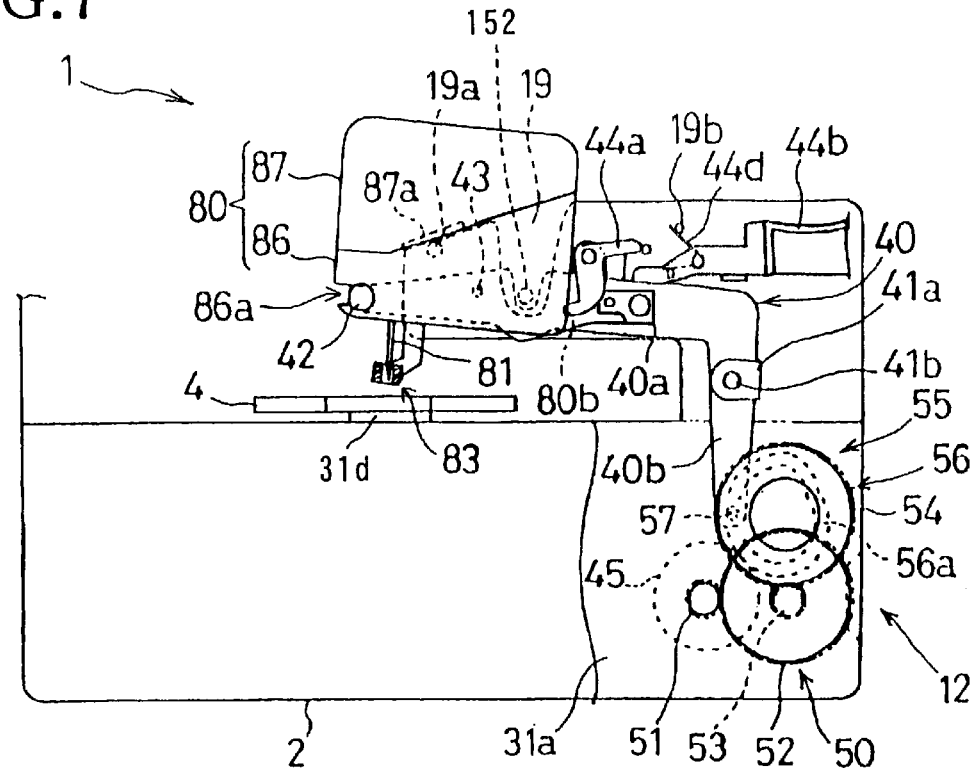
FIG. 7 is a partial perspective view of the sewing apparatus (when a hollow needle is in an upper limit position) as seen from the front.
Figure 8:
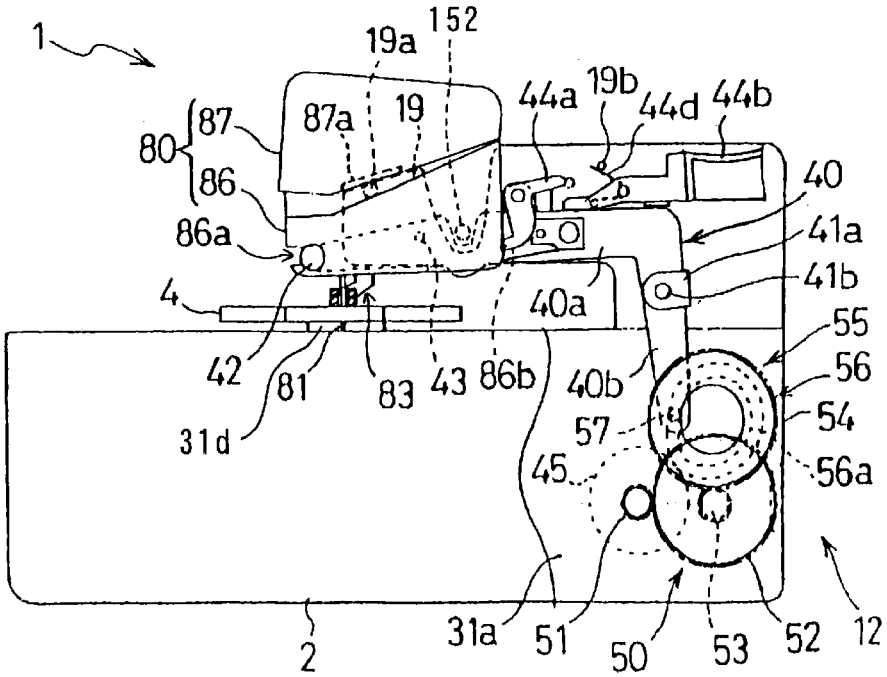
FIG. 8 is a partial perspective view of the sewing apparatus (when the hollow needle is in a lower limit position) as seen from the front.

The machine motor 45 is fixed to the back of the right lower portion of the front wall 31 a of the support frame 31 so that a rotational shaft of the machine motor 45 extends toward the front of the casing 10. As shown in FIGS. 6 to 8, the gear mechanism 50 includes gears 51 to 54 disposed in front of the front wall 31*a* of the support frame 31. The drive gear 51 is fixed to the output shaft of the machine motor 45. The intermediate gears 52, 53 are integrally connected and rotatably supported on the same shaft and the large-diameter gear 54 is rotatably supported on another shaft. The drive gear 51 engages the intermediate gear 52. The intermediate gear 53 engages the large-diameter gear 54. Thus, rotation speed of the large-diameter gear 54 is reduced with respect to the rotation speed of the machine motor 45 (the drive gear 51).

As shown in FIGS. 6 to 9, the cam mechanism 55 has a cam 56 that is rotatably supported by the front wall 31*a* and a cam follower 57 that is fixedly attached to the right end of the swing arm 40 to protrude toward the front. The outer region of the cam 56 is formed with gear teeth of the large-diameter gear 54. A cam groove 56*a* is formed on the back of the cam 56. The cam follower 57 is slidably engaged with the cam groove 56*a*.

Figure 9:
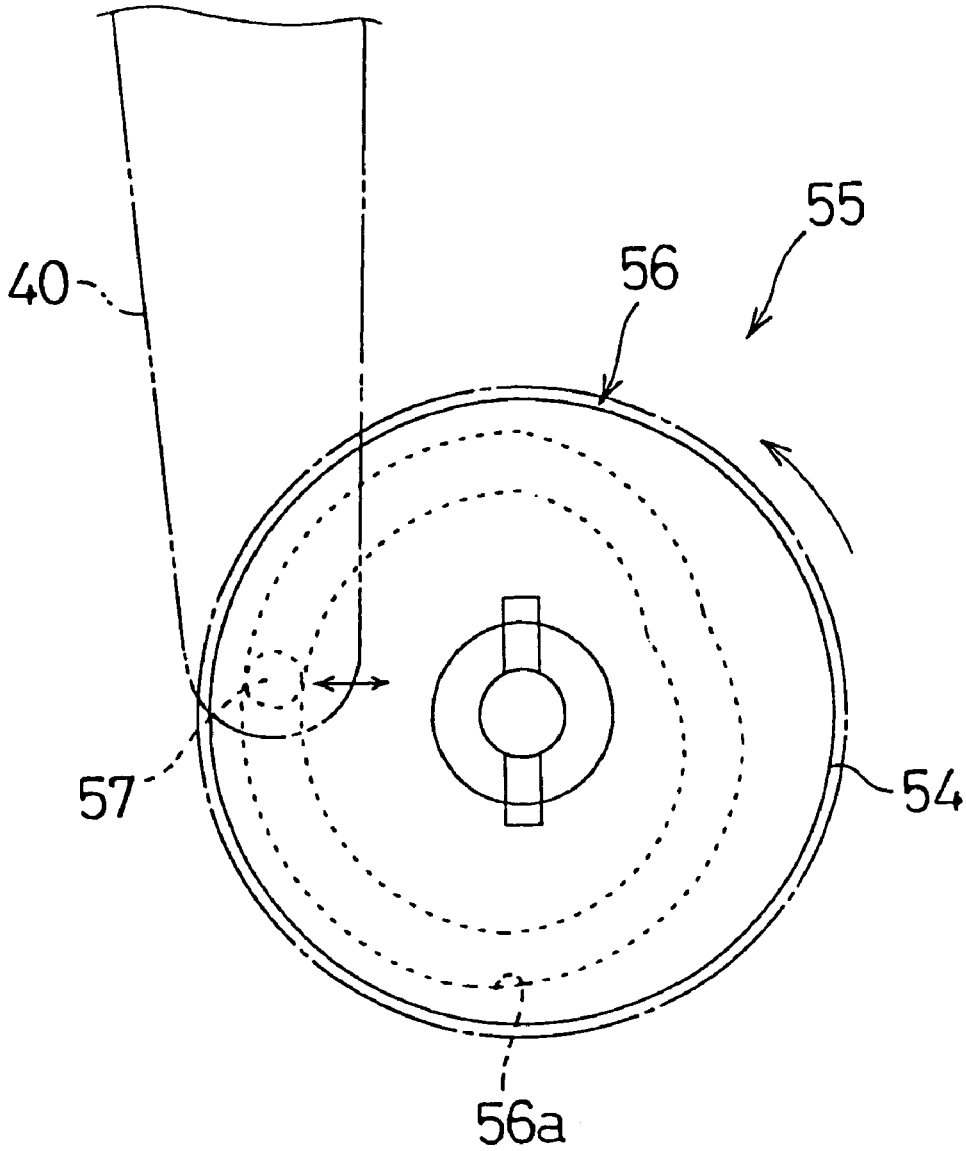
FIG. 9 is a front view of a cam.
Figure 10:
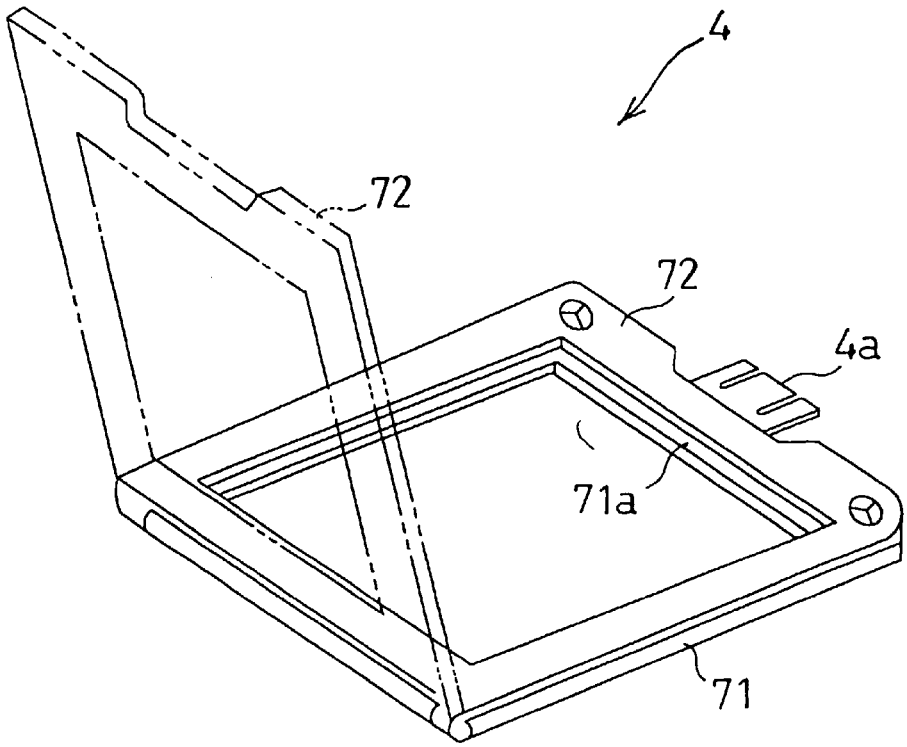
FIG. 10 is a perspective view of an embroidery frame of the embodiment of the invention.

As shown in FIG. 9, the cam groove 56*a* is formed into a loop wherein a distance between the cam groove 56*a* and a center of rotation of the cam 56 is changed. When the cam 56 is turned, the arm portion 40*a* travels vertically between an upper limit position, shown in FIG. 7, and a lower limit position, shown in FIG. 8. As a distance between an engaging position where the cam follower 57 engages the cam groove 56*a* and a center of an axis of rotation of the cam 56 becomes longer, the cam follower 57 is located at a further left position and the arm portion 40*a* of the swing arm 40 is located at a further upper position. FIG. 9 shows a state where the cam follower 57 engages a position which is farthest from the center of rotation of the cam 56 in the cam groove 56*a*. In this state, the arm portion 40*a* of the swing arm 40 is in the upper limit position of FIG. 7.

As shown in FIGS. 2 to 5, the safety cover 3 has a function of protecting the embroidery frame 4, the sewing cartridge 5, and the swing arm 40 which are to be moved, a function of covering the hollow needle 81 and the embroidery frame moving area 38 so that a user, such as a child, will not be hurt, and a function of preventing an occurrence of undesired operation of the start/stop switch 16. The safety cover 3 can cover the entire embroidery frame moving area 38. The safety cover 3 can be moved between a sewing position (see FIG. 3), where the safety cover 3 covers the embroidery frame moving area 38 at the time when sewing is executed, and a storage position (see FIG. 2), where the safety cover 3 is in a position for storage or packing.

The safety cover 3 is formed of a transparent or a translucent material made of a synthetic resin. The safety cover 3 has an upper wall 3*a*, a front wall 3*b*, and right and left walls 3*c*. The safety cover 3 does not have a lower wall or a rear wall. The upper wall 3*a* of the safety cover 3 is formed with a recessed area 3*d* which is recessed at the rear, generally center portion. The recessed area 3*d* engages the guide upper surface 10*e* of the casing 10 so that the safety cover 3 can slide back and forth. The lower surface of the upper wall 3*a* of the safety cover 3 can contact the upper surface of the upper wall 10*d* of the casing 10, except for the guide upper surface 10*e*.

A vertical plate 60 is fixed inside of the rear part of each side wall 3*c* of the safety cover 3. An engagement piece 66 is fixed inside of the upper rear portion of each vertical plate 60. An engagement portion 60*a* is integrally formed with each vertical plate 60 under the engagement piece 66. Each engagement piece 66 slidably engages a guide groove 10*g* formed in each side wall 10*f* of the casing 10. The guide groove 10*h* is also formed in each side wall 10*f*. Each engagement portion 60*a* slidably engages a guide groove 10*h*. Inside of the forward part of the right side wall 3*c* of the safety cover 3, is fixed an engagement piece 61, which can slidably engage the guide groove 1*g*.

A stopper mechanism 65 is provided to position the safety cover 3 in the sewing position and to regulate the safety cover 3 so as not to be removed from the sewing apparatus body 2. The stopper mechanism 65 has the engagement pieces 66 fixed to each side wall 3*c* of the safety cover 3 and engagement block pieces 67 fixed to the guide groove 10*g* of each side wall 10*f* of the casing 10. When the engagement pieces 66 engage the engagement block pieces 67, the safety cover 3 is in the sewing position. As a result, the safety cover 3 cannot move forward from the sewing position.

In a state where the safety cover 3 is switched to the storage position shown in FIG. 2, the recessed area 3*d* of the safety cover 3 completely engages the guide upper surface 10*e* of the casing 10. The rear end of the upper wall 3*a* of the safety cover 3 contacts the stepped portion of the guide upper surface 10*e*. The front wall 3*b* of the safety cover 3 is brought closer to the front surface of the casing 10. When the safety cover 3 is in the storage position, the embroidery frame moving area 38 is not entirely covered by the safety cover 3. As the safety cover 3 is switched to the sewing position shown in FIG. 3, by sliding the safety cover 3 forward from the storage position shown in FIG. 2, the entire embroidery frame moving area 38 is covered with the safety cover 3.

In a state where the safety cover 3 is switched to the sewing position shown in FIG. 3, a cartridge insertion slot 68 is formed by the front end of the guide upper surface 10*e* of the casing 10 and the recessed area 3*d* of the safety cover 3. The width of the cartridge insertion slot 68 is substantially equal to the width of the sewing cartridge 5 (see FIG. 4). The length of the cartridge insertion slot 68 is longer than that of the sewing cartridge 5. The sewing cartridge 5 can be attached to the swing arm 40 by inserting the sewing cartridge 5 from the cartridge insertion slot 68. An opening is formed in the upper wall of the safety cover 3 in the sewing position so that the operating member 44*b* can be operated from above. When the sewing cartridge 5 is inserted into the safety cover 3 from the cartridge insertion slot 68, the sewing cartridge 5 is guided by the cartridge insertion portion 68 and attached to the swing arm 40. In a state where the sewing cartridge 5 is attached to the sewing apparatus body 2, the safety cover 3 is regulated in its position to the sewing position by the sewing cartridge 5.

A switch operating hole 3*e* is formed on the right in the upper wall 3*a* of the safety cover 3. When the safety cover 3 is in the storage position shown in FIG. 2, the switch operating hole 3*e* is opposed to the power switch 15. Therefore, the power switch 15 can be operated via the switch operating hole 3*e*. In this state, the start/stop switch 16 is covered with the safety cover 3, so that the start/stop switch 16 cannot be operated.

The power switch 15 is disposed to the rear of the start/stop switch 16. The distance between centers of the power switch 15 and the start/stop switch 16 is the same as sliding amount of back-and-forth movement of the safety cover 3. Accordingly, in the state where the safety cover 3 is in the sewing position shown in FIG. 3, the switch operating hole 3*e* is opposed to the start/stop switch 16, so that the start/stop switch 16 can be operated via the switch operating switch 16. That is, the prohibition provided by the safety cover 3 is withdrawn.

When the safety cover 3 is in the sewing position, the power switch 15 is exposed at the rear portion of the safety cover 3. Therefore, the power switch 15 can be also operated. As described above, the power switch 15 can be operated when the safety cover 3 is in both the sewing position and the storage position. The power switch 15, the start/stop switch 16, and the switch operating hole 3*e* are formed into a circular shape having the substantially same size as seen from above.

An embroidery frame insertion slot 3*f* is formed at a substantially middle portion in the right and left direction (perpendicular to the sliding direction of the safety cover 3) of the lower portion of the front wall 3*b* of the safety cover 3. The embroidery frame 4 can be inserted into the safety cover 3 via the embroidery frame insertion slot 3*f*. A guide member 69 protruding forward is fixed to the front wall 3*b*. The guide member 69 guides the embroidery frame 4 in the back and forth direction when the embroidery frame 4 is attached to the carriage 18 by inserting the embroidery frame 4 into the safety cover 3 from the embroidery frame insertion slot 3*f*. The embroidery frame insertion slot 3*f* is in the middle portion of the front wall 3*b* in the right and left position and in a position displaced to the right slightly from a middle position within the moving range of the carriage 18 in the right and left direction (a middle position of the embroidery frame moving area 38 in the right and left direction).

When the carriage 18 is positioned substantially under the swing arm 40, the carriage 18 is in a foremost position. Accordingly, the embroidery frame 4, which is guided by the guide member 69 and is inserted into the inside of the safety cover 3 via the embroidery frame insertion slot 3*f*, can be attached to the carriage 18. The guide member 69 doubles as a pull for moving the safety cover 3.

As shown in FIGS. 2, 6, 10, and 11, the embroidery frame 4 is formed with a base frame 71 having a rectangular shape and a holding frame 72. The base frame 71 and the holding frame 72 are rotatably connected each other at their front ends. The rear end support portion 4*a* is formed integral with the base frame 4*a* at the rear end. The rear end support portion 4*a* can engage/disengage the embroidery frame 4 with/from the engaging portion 18*a* of the carriage 18. A stepped portion 71*a* is formed to the internal edge of the base frame 71. An outer region of a special work cloth 70 is fit to the stepped portion 71*a*. The work cloth 70 is attached to substantially the entire embroidery frame 4 when the work cloth 70 is held by the holding frame 72 under tension. The work cloth 70 may be releasably attached to substantially the entire embroidery frame 4 via a double-sided adhesive tape or an adhesive.

Figure 11:
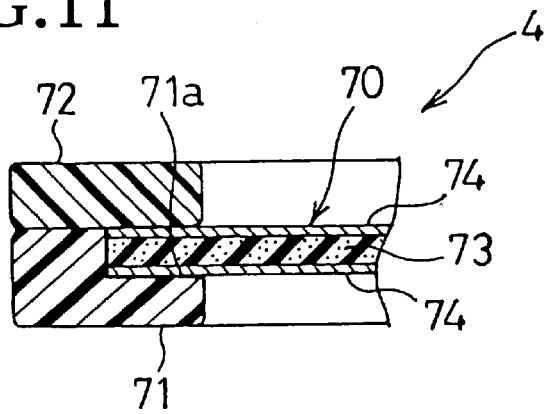
FIG. 11 is a fragmentally vertical sectional view of the embroidery frame.

As shown in FIG. 11, for example, the work cloth 70 is a special cloth that has elasticity and a multi-layer structure formed by which an elastic film member 73 made of urethane is sandwiched by pieces of cloth 74 by lamination. A plurality of the embroidery frames 4 with the work cloth 70 attached in advance are kept at the ready.

The sewing cartridge 5 will be described below. For all of the discussion below, any direction description related to FIGS. 15–18 is the reverse of the actual directions when the sewing cartridge 5 is mounted in the sewing apparatus, such as shown in FIGS. 1, 2 and 19 to 21B, for example.

As shown in FIGS. 2, 3, and 12 to 18, the sewing cartridge 5 includes a cassette body 80, the hollow needle 81 that can pass through the work cloth 70, a spool 82 around which a thread T to be supplied to the hollow needle 81 is wound, a needle cover 83 that covers at least a tip of the hollow needle 81, a coil compression spring 84 that urges the needle cover 83 to a cover position where the needle cover 83 covers the hollow needle 81, and a movement prohibiting mechanism 85 that prohibits the movement of the needle cover 83 positioned at the cover position. For this sewing apparatus 1, a plurality of sewing cartridges 5 that can be detachably attached to the swing arm 40 are prepared. The sewing cartridges 5 each accommodate different colors, so that a colorful embroidery pattern can be formed using several sewing cartridges 5.

The cassette body 80 has a rectangular shape like a horizontally oriented standing matchbox. The cassette body 80 has a housing case 86 and an openable cover 87. The housing case 86 is movable with respect to the sewing apparatus body 2 in a state where the cassette body 80 is attached to the swing arm 40. The openable cover 87 is substantially fixed with respect to the sewing apparatus body 2. The housing case 86 accommodates the upper portion of the hollow needle 81 and the needle cover 83, the spool 82, the coil compression spring 84, and the movement prohibiting mechanism 85. The housing case 86 and the openable cover 87 are rotatably connected to each other at an upper right portion of the cassette body 80 (see FIGS. 15 and 16). The openable cover 87 travels between a closed position shown in FIG. 15 and an open position shown in FIG. 16 with respect to the housing case 86. A torsion spring 88 is attached to a pivot shaft that pivotally supports the openable cover 87 with respect to the housing case 86. The openable cover 87 is rotatably urged to the closed position by the torsion spring 88.

The sewing cartridge 5 includes a housing area 90 wherein the spool 82 is housed, an excessive rotation preventive mechanism 91, a backflow preventive mechanism 92, and a locking mechanism 93. The excessive rotation preventive mechanism 91 prevents the spool 82 accommodated in the housing area 90 from rotating excessively in the thread supply direction so that excessive feeding of the thread T is prevented. The backflow preventive mechanism 92 prevents the thread T from being drawn back to the housing area 90 side from the hollow needle 81 side by applying resistance to the thread T drawn partway from the spool 82 to the hollow needle 81. The locking mechanism 93 locks the openable cover 87 in the closed position with respect to the housing case 86. The housing area 90, the excessive rotation preventive mechanism 91, and a locking member 110 of the locking mechanism 93 are provided inside the housing case 86. The backflow preventive mechanism 92 and an engaged portion 87*d* of the locking mechanism 93 are provided inside the openable cover 87.

Figure 12:
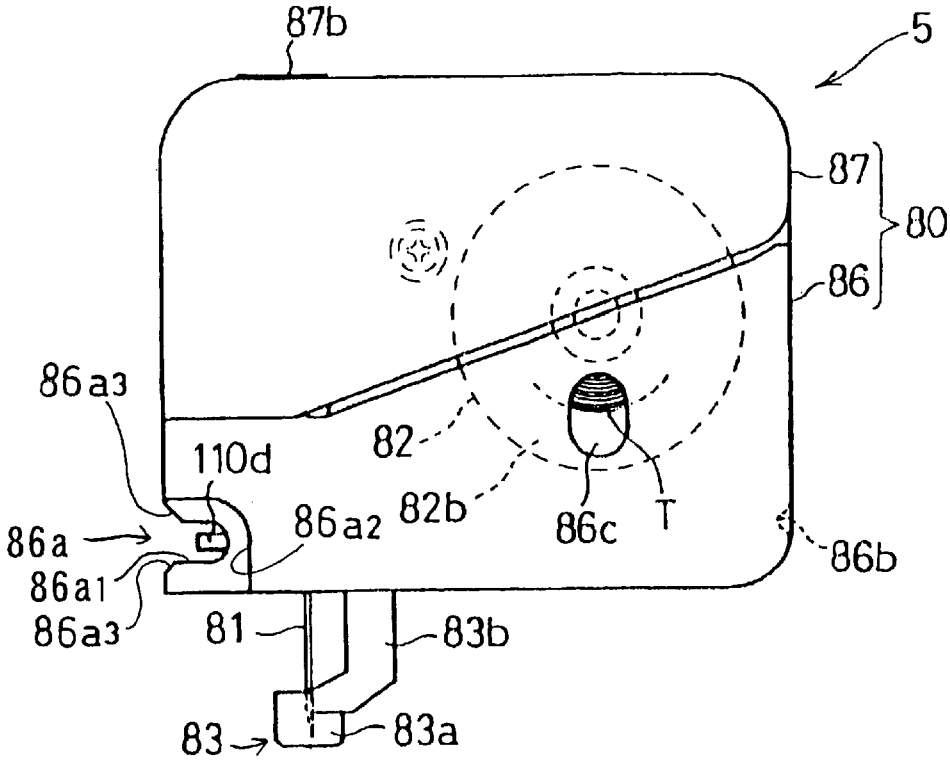
FIG. 12 is a front view of a sewing cartridge of the first embodiment of the invention.
Figure 13:
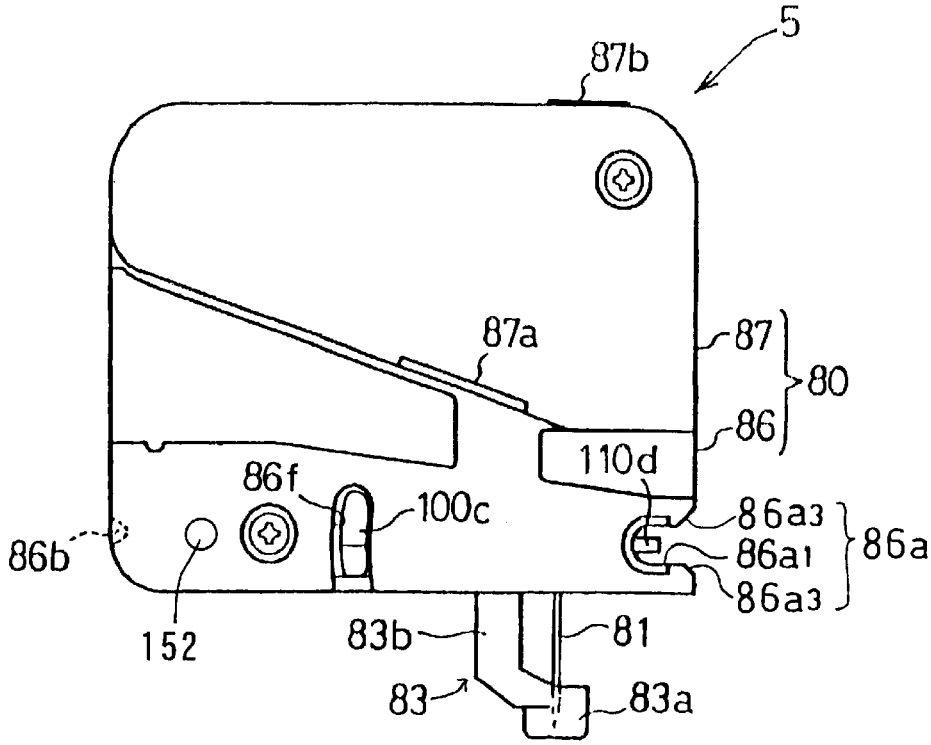
FIG. 13 is a rear view of the sewing cartridge.
Figure 14:
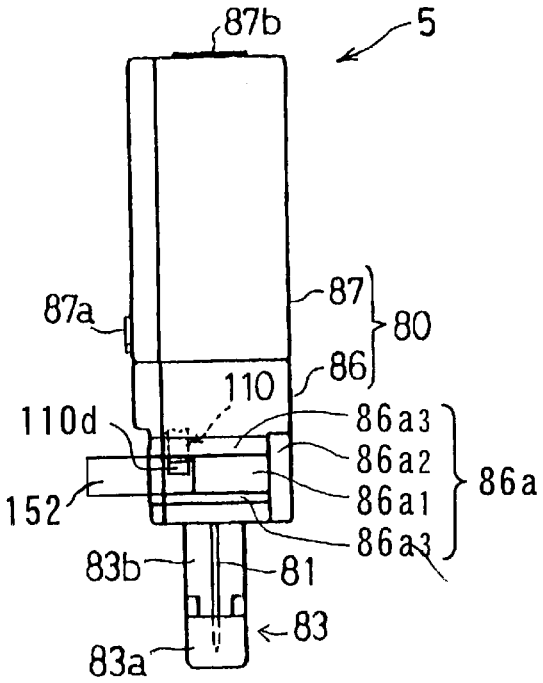
FIG. 14 is a left side view of the sewing cartridge.
Figure 15:
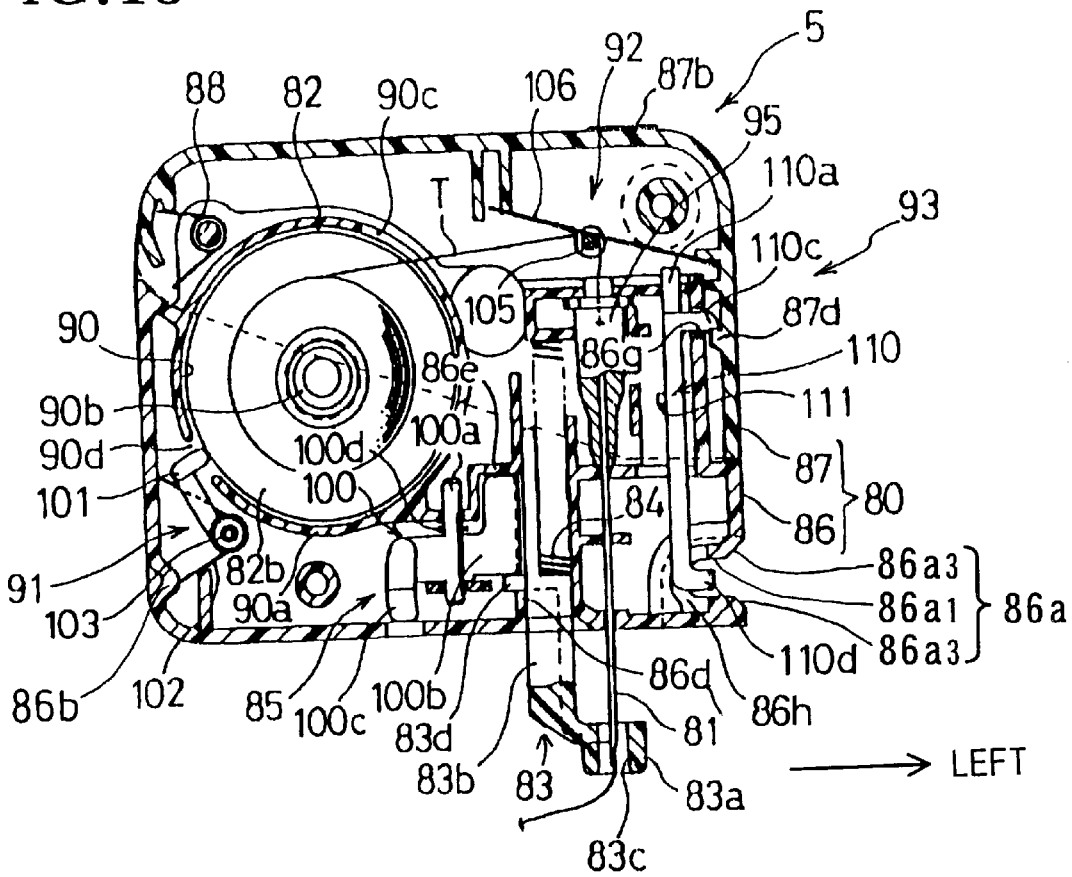
FIG. 15 is a vertical sectional view of the sewing cartridge (in a closed state)
Figure 16:
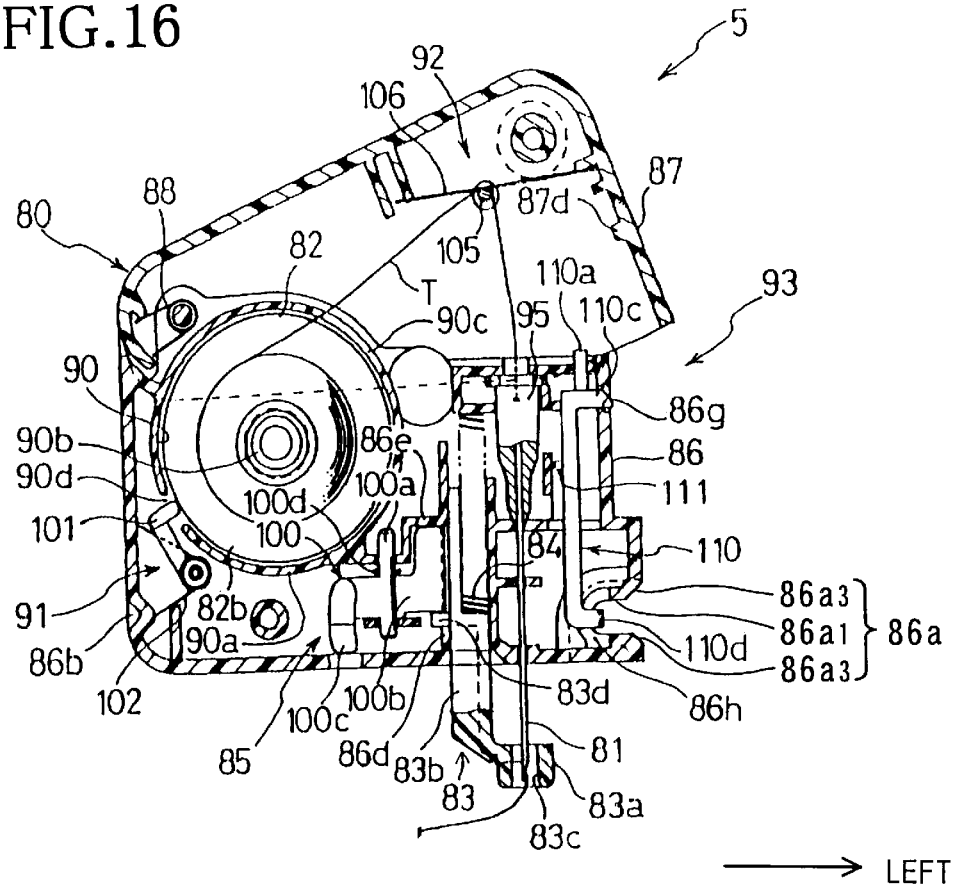
FIG. 16 is a vertical sectional view of the sewing cartridge (in an open state)

As shown in FIG. 12, a U-shaped engagement groove 86*a* is formed in a lower left portion of the housing case 86 (see FIGS. 15 and 16). The engagement groove 86*a* is cut away from the left and can engage the engaging pin 42*a* of the swing arm 40. The engagement groove 86*a* includes a U-shaped narrow groove portion 86*a*1 and a wide recessed portion 86*a*2. The narrow groove portion 86*a*1 is cut away from the left. The shaft portion 42*a* of the engaging pin 42 rotatably engages the narrow groove portion 86*a*1. The wide recessed portion 86*a*2 is provided so as to connect with the narrow groove portion 86*a*1. The head portion 42*b* of the engaging pin 42 rotatably engages the wide recessed portion 86*a*2. The engagement groove 86*a* also includes connecting portions 86*a*3, 86*a*3 that connect the narrow groove portion 86*a*1 and the periphery of the housing case 86 of the sewing cartridge 5. At least one of the connecting portions 86*a*3, 86*a*3 (both connecting portions 86*a*3 opposed each other in the embodiment) is inclined such that the opening of the engagement groove 86*a* becomes wider toward the periphery of the sewing cartridge 5 (see FIG. 20). The connecting portions 86*a*3, 86*a*3 may be curved, instead of straightly included, as long as the opening of the engagement groove 86*a* becomes wider toward the periphery of the sewing cartridge 5. The engagement groove 86*a* opens (to the left when viewed from the front) in a horizontal direction while the sewing cartridge 5 is attached to the sewing apparatus body 2. With this structure, the engaging pin 42 becomes easily to be engaged with the engagement groove 86*a*.

An engagement recess 86*b*, that can engage the engaging member 44*a* provided to the swing arm 40, is formed in a lower right portion of the housing case 86.

Figure 19:
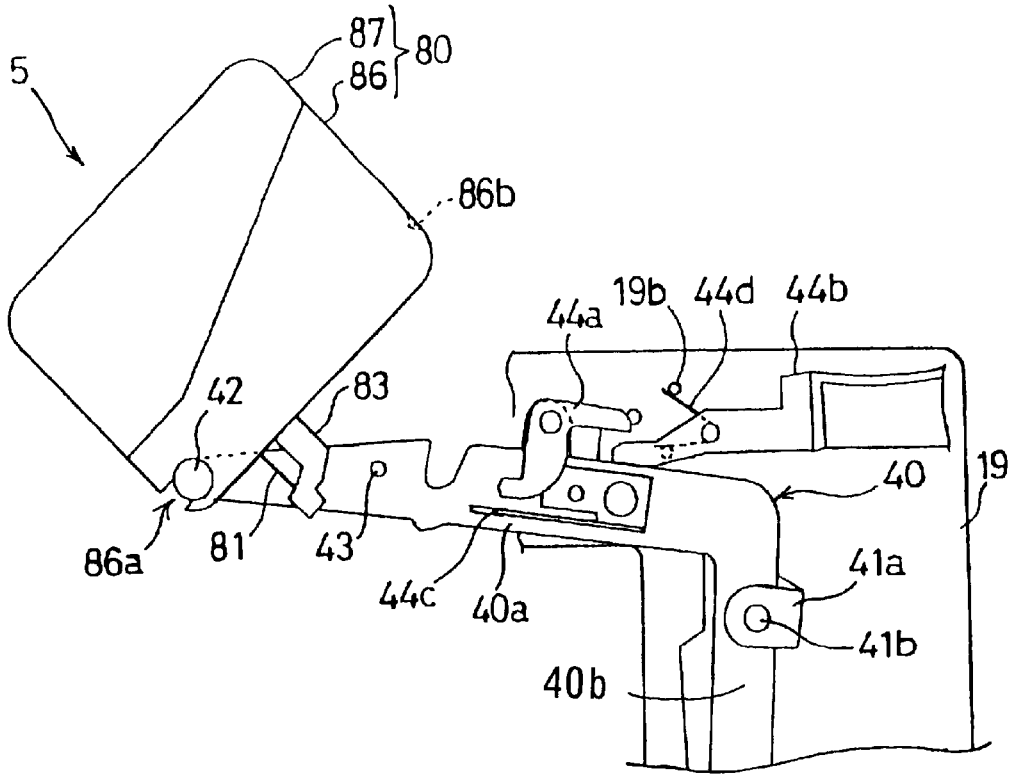
FIG. 19 is a front view of a swing arm and the sewing cartridge (when the sewing cartridge is not completely attached to the swing arm)
Figure 20:
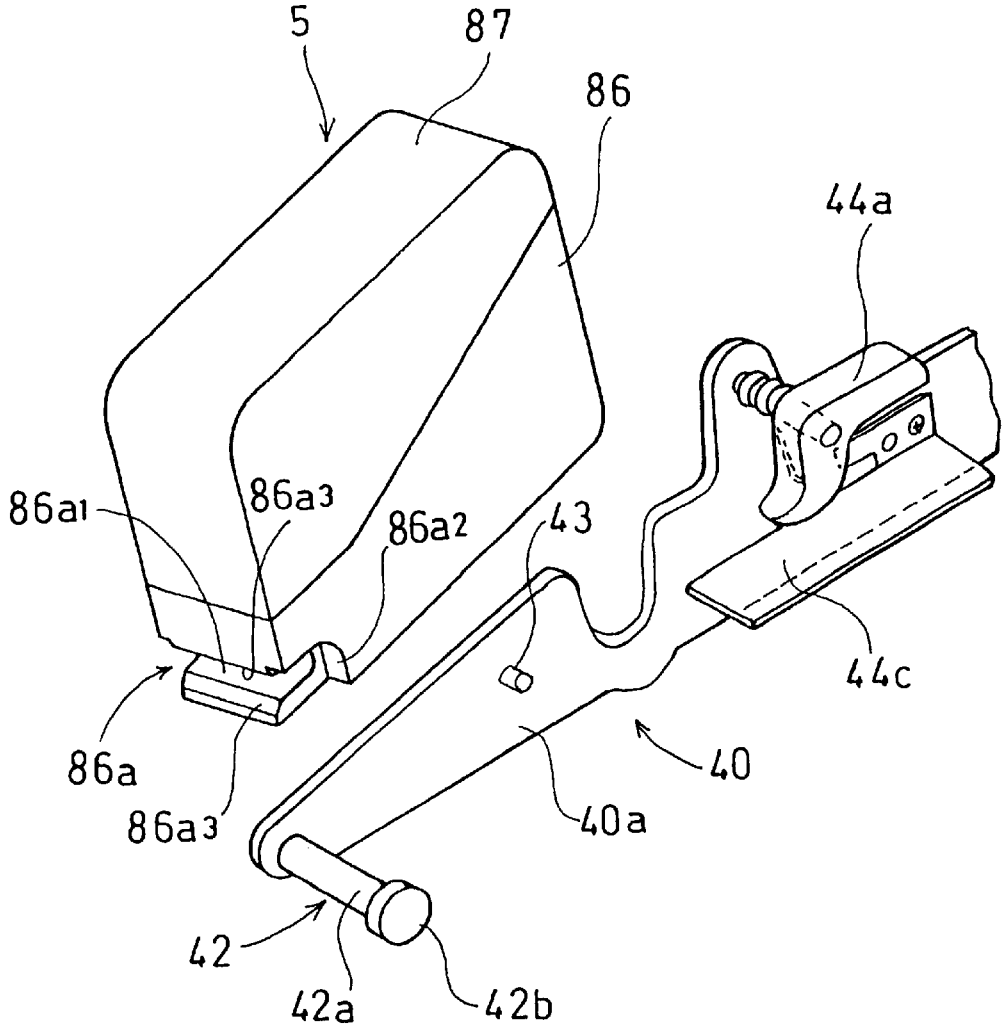
FIG. 20 is a partial perspective view of the sewing cartridge and the swing arm.

Here, attachment/detachment of the sewing cartridge 5 to/from the swing arm 40 will be described. When the sewing cartridge 5 is attached to the swing arm 40, the sewing cartridge 5 is inserted from the cartridge insertion slot 68, formed by the forward movement of the safety cover 3, while inclined leftwardly and downwardly. As shown in FIG. 19, the engagement groove 86*a* is engaged with the engaging pin 42. At that time, because the connecting portions 86*a*3, 86*a*3, which connect the narrow groove portion 86*a*1 and the periphery of the housing case 86 of the sewing cartridge 5, are inclined so that the opening of the engagement groove 86*a* become wider toward the outside as shown in FIGS. 20, 21A and 21B, the shaft portion 42*a* can be smoothly engage the narrow groove portion 86*a*1. Further, the head portion 42*b* provided to the shaft portion 42*a* at its free end engages the wide recessed portion 86*a*2 connected with the narrow groove portion 86*a*1. Therefore, the sewing cartridge 5 cannot move along the shaft portion 42*a* so that it can be properly fit in a predetermined position.

Even if the shaft portion 42*a* and head portion 42*b* are positioned at the wide recessed portion 86*a*2 and the narrow groove portion 86*a*1, respectively, it is absolutely impossible to fit the head portion into the narrow groove portion 86*a*1. Accordingly, the sewing cartridge 5 can be surely prevented from being attached to the swing arm 40 in an improper posture by a user.

Then, the sewing cartridge 5 is rotated in the clockwise direction so as to be in a sewable position where the sewing cartridge 5 is placed in a horizontal position. As shown in FIG. 21A, the engaging member 44*a* is engaged and held by the swing arm 40 so as to be able to contact the lower right end portion of the sewing cartridge 5. The lower right end portion of the sewing cartridge 5 contacts the engaging member 44*a* slightly before the sewing cartridge 5 reaches the sewable position. As the sewing cartridge 5 reaches the sewable position, the engaging member 44*a* rotates in the counterclockwise direction against an urging force from the torsion spring 44*d*.

Then, as shown in FIG. 21B, the engaging member 44*a* is rotated in the clockwise direction by the urging force from the torsion spring 44*d* to engage the engagement recess 86*b*, so that the engaging member 44*a* is returned by a small amount. Thus, as shown in FIG. 21B, the housing case 86 is regulated of its rotation and is fixedly attached to the swing arm 40. When the sewing cartridge 5 is rotated to the sewable position, the engaging member 44*a* contacts the leaf spring 44*c* before engaging the engagement recess 86*b*. The sewing cartridge 5 is placed in the sewable position while elastically deforming the leaf spring 44*c*. That is, the sewing cartridge 5 is attached to the swing arm 40 while being regulated of its rotation and received by the leaf spring 44*c* with upward urging force in the sewable position (see FIG. 21B).

The sewing cartridge 5 is attached to the swing arm 40 in a state where the swing arm 40 is in the upper limit position. As described above, when the housing case 86 is fixedly attached to the swing arm 40, as shown in FIGS. 7 and 21B, an engaged portion 87*a* of the openable cover 87 engages a pin 19*a* provided to the engagement plate 19 of the sewing apparatus body 2 so as to abut against it from the above. A guide pin 105 provided in the openable cover 87 slightly swings though the housing case 86 fiercely swings. Thus, the openable cover 87 is substantially fixed with respect to the sewing apparatus body 2. The openable cover 87 may be fixed to the sewing apparatus body 2. The openable cover 87 may be completely fixed to the sewing apparatus body 2.

In a state where the sewing cartridge 5 is in the upper limit position shown in FIG. 21A so that the hollow needle 81 is placed above the work cloth 70 attached to the embroidery frame 4, the left end portion of the operating member 44*b* pivotally supported by the engagement plate 19 is placed close to the right end portion of the engaging member 44*a* pivotally supported by the arm portion 40*a*. Therefore, when the sewing cartridge 5 is detached from the swing arm 40, the operating member 44*b* is rotated in the clockwise direction in the state described above. As a result, the engaging member 44*a* is rotated in the counterclockwise direction against the urging force from the torsion spring via the operating member 44*b*. By doing so, as shown in FIG. 21A indicated by a solid line, the engaging member 44*a* is disengaged from the engagement recess 86*b*. After the operating member 44*b* is operated, the engaging member 44*a* is moved to a position where the engaging member 44*a* does not engage the engagement recess 86*b* and the sewing cartridge 5 is rotated and moved upward in the counterclockwise direction by the urging force from the leaf spring 44*c* (this state is indicated by a double dashed chain line in FIG. 21A). From this state, the sewing cartridge 5 can be removed from the swing arm 40 in a manner reverse to the operation for attaching the sewing cartridge 5 to the swing arm 40. While the operating member 44*b* is not operated, the operating member 44*b* is supported in a substantially horizontal position by the torsion spring 44*d*.

If the sewing cartridge 5 is detached from the swing arm 40 in a state where the arm portion 40*a* of the swing arm 40 is in a descended position, that is, in the horizontal position (in a state where the hollow needle 81 is passing through the work cloth 70), the hollow needle 81 may damage, for example, bend or snap, by interference of the work cloth 70. To prevent such a case, as shown in FIG. 21B, the right end portion of the engaging member 44*a* is apart from the left end portion of the operating member 44*b* when the arm portion 40*a* of the swing arm 40 is in the descended position, so that the engaging member 44*a* cannot be rotated if the user operates the operating member 44*b* by accident. Thus, the sewing cartridge 5 cannot be detached from the swing arm 40 in this state, and this structure improves safety.

The upper wall 10*d* of the casing 10 is cut away to continue to the cutaway space 10*a* so as to expose the operating member 44*b* from the top of the upper wall 10*d*. With respect to the cutaway portion, an opening is formed in the upper wall of the safety cover 3 in the sewing position. Accordingly, the operating member 44*b* can be operated from outside.

An opening 86*c* is formed in the front wall in front of the housing area 90 in the housing case 86 of the cassette body 80. A remaining amount of a thread T wound around the spool 82 housed in the housing area 90 can be visually confirmed from the outside through the opening 86*c*. A thread color indicating portion 87*b*, that indicates a same/similar color as the color of the thread T wound around the spool 82, housed in the housing area 90, is provided on a top surface of the openable cover 87 of the cassette body 80, to which a color chip, that is the same as or similar to the color of the thread T, is adhered.

Flanges 82*b* of the spool 82 are transparent or translucent. Accordingly, a remaining amount of the thread T wound around the spool 82 housed in the housing area 90 can be visually confirmed from the opening 86*c* through the flange 82*b*. Because the thread color indicating portion 87*b* is provided on the top surface of the openable cover 87, the thread color indicating portion 87*b* is visually exposed to the outside in a state where the sewing cartridge 5 is attached to the sewing apparatus body 2.

The hollow needle 81 is disposed at the left part (FIGS. 2, 3, 7, 8 and 12) of the inside of the cassette body 80 in a substantially standing posture. At least the upper end portion of the hollow needle 81 is supported by a tube-like needle support member 95 (FIGS. 15 and 16) fixedly attached to the housing case 86. The lower end portion of the hollow needle 81 protrudes from the bottom of the cassette body 80. A tip of the hollow needle 81 is pointed such that the tip is inclined rightwardly and downwardly from the left to the right (FIG. 12). When the sewing cartridge 5 is installed in the sewing apparatus body 2, an extreme tip 81*a* of the hollow needle 81 faces a center-of-swing side of the swing arm 40 (FIGS. 2,3, 12, 21A and 21B).

In FIG. 15, a circular wall 90*a*, which is formed integral with the housing case 86 and protrudes therefrom, forms the housing area 90 in the right half in the housing case 86. The spool 82 housed in the housing area 90 is fit onto a shaft 90*b* of the housing case 86 and is rotatably supported by the shaft

90*b*. The thread T extending from the spool 82 is fed into the thread hole formed in the hollow needle 81 from above via the backflow preventive mechanism 92 from a thread passing aperture 90*c* formed in the circular wall 90*a*. The thread T is drawn to the outside of the sewing cartridge 5 from the lower end of the hollow needle 81.

The upper thread T, wound around the spool 82, is not very heavy. A thread hole of the hollow needle 51 is formed so that the thread T can be threaded through the hollow needle 81. A sewing operation is performed when a certain length of the thread T is drawn from the lower end of the hollow needle 81.

The needle cover 83 can move between a cover position where the needle cover 83 covers the tip of the hollow needle 81 and a retracted position where the needle cover 83 retracts to a position above the cover position so that the hollow needle 81 can pass through the work cloth 70. The needle cover 83 also serves as a presser foot that holds the work cloth 70 at the time of sewing. The needle cover 83 includes a cover portion 83*a* and a guided portion 83*b* extending upward from the right end of the cover portion 83*a*. The cover portion 83*a* and the guided portion 83*b* are integrated into a single part to form the needle cover 83.

The cover portion 83*a* is formed with a needle passing hole 83*c* through which the hollow needle 81 passes. The guided portion 83*b* is vertically movably guided by the housing case 86. The coil compression spring 84 is interposed between the guided portion 83*b* and the housing case 86. A protrusion 83*d*, protruding rightward in FIG. 15, is provided at a middle portion of the guided portion 83*b* in the up and down direction. In a state where the protrusion 83*d* abuts against an upper end of a rib 86*d* that guides the guided portion 83*b* in the up and down direction, the needle cover 83 is in the cover position. Further, the tip of the hollow needle 81 is positioned inside of the needle passing hole 83*c*, so that the tip of the hollow needle 83 is covered with the cover portion 83*a*. As the needle cover 83 moves upward with respect to the hollow needle 81, the needle cover 83 is placed in the retracted position. Thus, the hollow needle 81 passes through the needle passing hole 83*c* and protrudes from the bottom of the cover portion 83*a*.

As shown in FIGS. 15 to 17 and 22 to 24, the movement prohibiting mechanism 85 has a movement prohibiting member 100 disposed at a middle, lower portion, in the right and left direction, inside of the housing case 86. The movement prohibiting member 100 includes a vertical pivot shaft portion 100*a*, a locking portion 100*b* disposed on the left of the pivot shaft portion 100*a* (FIGS. 15, 16, 22 and 23) and an engaged portion 100*c*, that engages the lock release pin 43, disposed on the right of the pivot shaft portion 100*a*. The vertical pivot shaft portion 100*a*, the locking portion 100*b*, and the engaged portion 100*c* are integral and form a unitary structure. In the movement prohibiting member 100, the pivot shaft portion 100*a* is pivotally supported to the housing case 86, so that the movement prohibiting member 100 is rotated about the pivot shaft portion 100*a*. The movement prohibiting member 100 cannot move vertically.

The locking portion 100*b* is relatively long in the up and down direction. The lower end of the locking portion 100*b* substantially abuts against an upper surface of the protrusion 83*d* of the needle cover 83 in the cover position, that is, where the lower surface of the protrusion 83*d* is abutted against the upper surface of the rib 86*d*. In this state, the locking portion 100*b* is positioned between a rib 86*e*, in the cassette body 80, and the protrusion 83*d*. Thus, the needle cover 83 is locked in the cover position, and cannot move upward. The movement prohibiting member 100 can be rotated between a locked position (see FIG. 22) and an unlocked position (see FIG. 23) where the locking portion 100*b* is moved out of the way of the up and down movement of the protrusion 83*d* between the rib 86*e* and the rib 86*d*. Therefore, when the movement prohibiting member 100 is placed in the unlocked position, the needle cover 83 can be movable if the needle cover 83 is pushed upwardly against the elastic force from the coil compressing spring 84. The needle cover 83 is pushed upwardly when the sewing cartridge 5 is moved to the sewing position by the movement of the swing arm 40. At that time, the needle cover 83 is pushed against a needle plate 31*d*, having a hole through which the hollow needle 81 can pass, formed on the support frame 31, via the work cloth 70 (see FIG. 8).

A torsion spring 100*d* is attached to the pivot shaft portion 100*a*. The movement prohibiting member 100 is rotatably urged to the locked position by the torsion spring 100*d*. In a state where the sewing cartridge 5 is not attached to the sewing apparatus body 2, the movement prohibiting member 100 is maintained in the locked position. The rear wall of the housing case 86 is formed with an opening 86*f* corresponding to the engaged portion 100*c* (FIGS. 15 and 16). When the movement prohibiting member 100 is in the locked position, the engaged portion 100*c* protrudes toward the outside from the opening 86*f*

Figure 24:
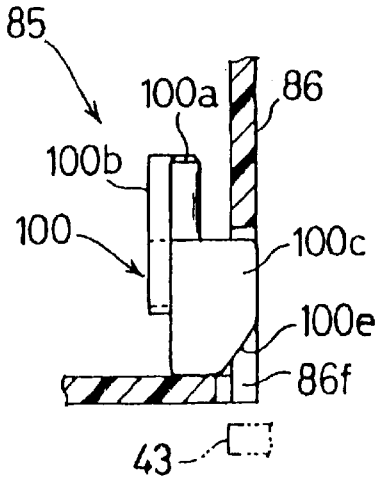
FIG. 24 is a side view of the movement prohibiting mechanism.
Figure 25:
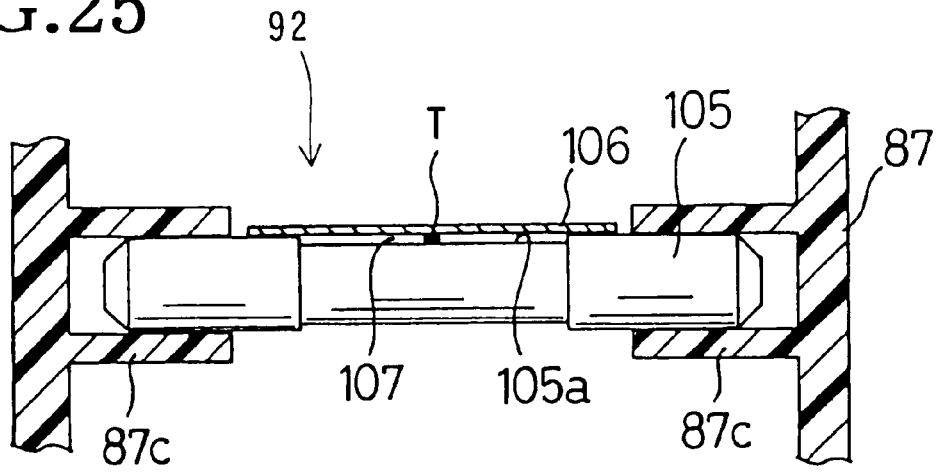
FIG. 25 is a vertical sectional view of a backflow preventive mechanism.
Figure 26:
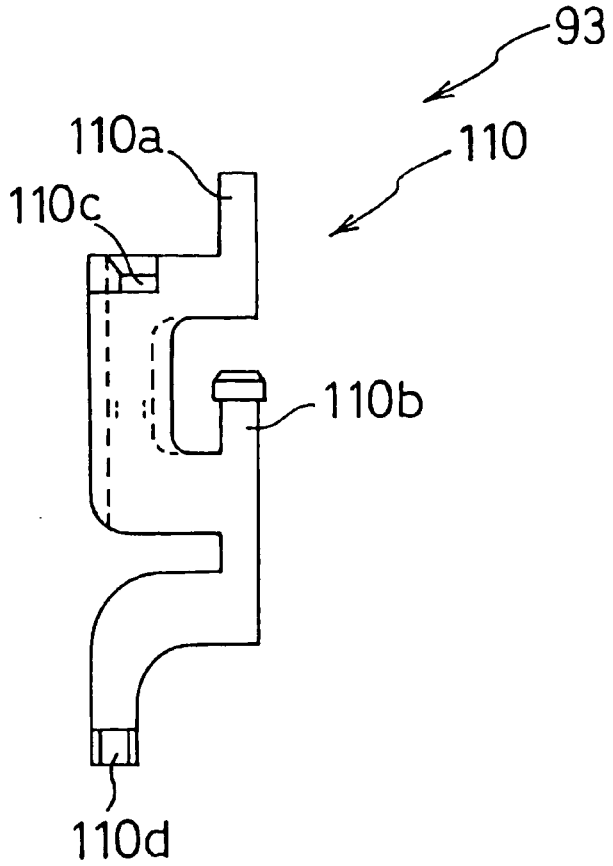
FIG. 26 is a side view of a locking member of a locking mechanism.

As shown in FIG. 24, the opening 86*f* extends to the lower wall of the housing case 86. The bottom of the engaged portion 100*c* is formed with a tapered portion 100*e* that inclines externally and upwardly. As described above, the lock release pin 43 is provided to the swing arm 40. When the sewing cartridge 5 is attached to the swing arm 40, the lock release pin 43 enters into the opening 86*f* from the bottom and engages the tapered portion 100*e* of the engaged portion 100*c*. As a result, the movement prohibiting member 100 is rotated from the locked position to the unlocked position against the urging force from the torsion spring 100*d*, so that the needle cover 83 is unlocked and can be movable upwardly as described above.

As described above, in the state where the sewing cartridge 5 is not attached to the sewing apparatus body 2, the movement prohibiting member 100 prohibits the needle cover 83 in the cover position from moving therefrom. In the state where the sewing cartridge 5 is attached to the sewing apparatus body 2, the needle cover 83 is allowed to move from the cover position to the retracted position.

Figure 17:
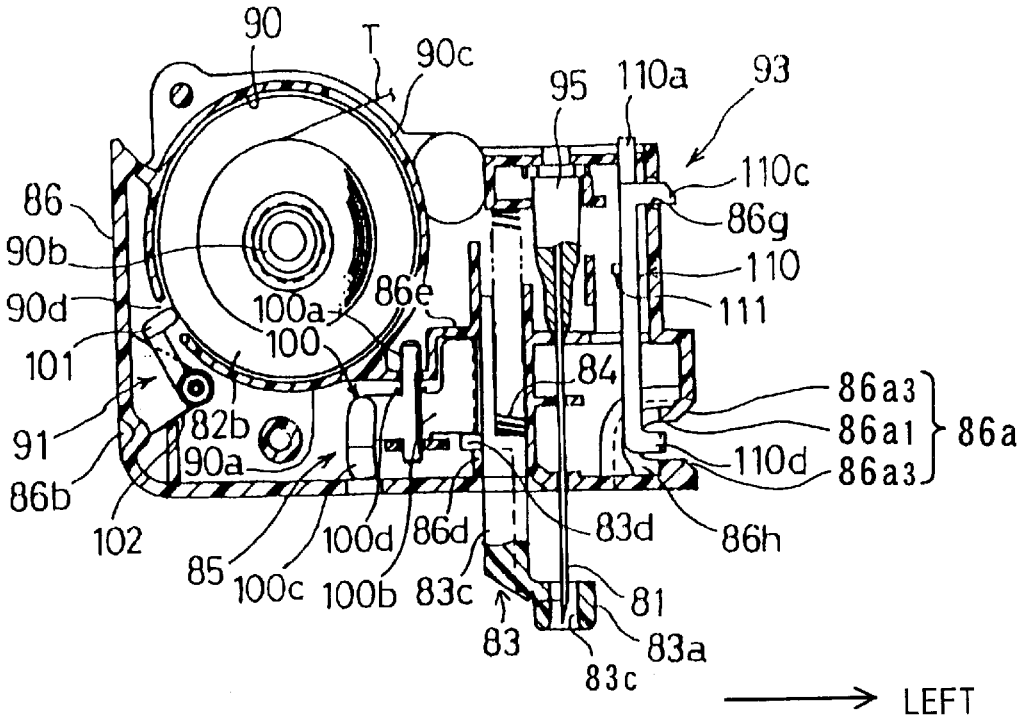
FIG. 17 is a vertical sectional view of a housing case of the sewing cartridge.
Figure 18:
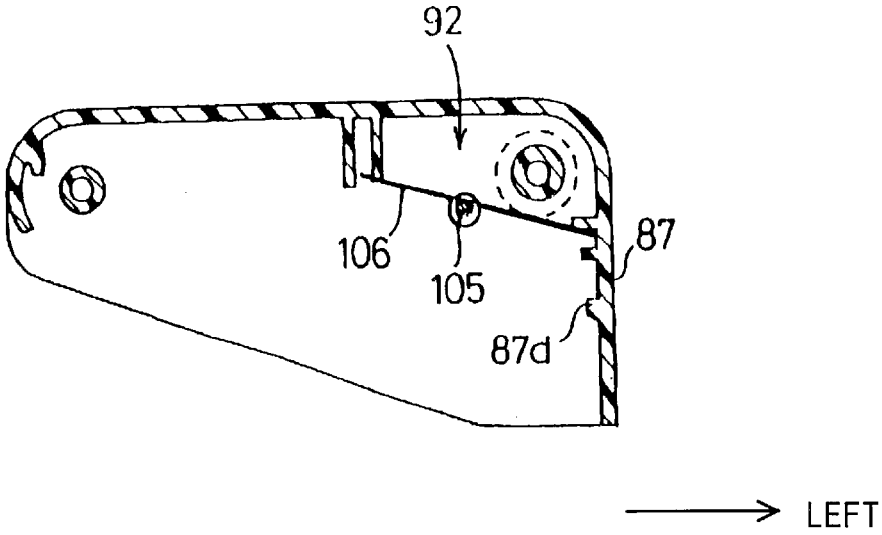
FIG. 18 is a vertical sectional view of an openable cover of the sewing cartridge.

As shown in FIGS. 15 to 17, the excessive rotation preventive mechanism 91 has a contact 101 that can contact one of the flanges 82*b* of the spool 82, and a torsion spring 102 that urges the contact 101 against the flange 82*b*. By the friction produced between the contact 101 and the flange 82*b*, the spool 82 is prevented from excessively rotating in the thread supply direction to prevent the excessive feeding of the thread T. The contact 101 is pivotally supported by a shaft 103 disposed near the housing area 90 in the housing case 86. The shaft 103 is provided with the torsion spring 102. The tip of the contact 101 contacts the flange 82*b* of the spool 82 in the housing area 90 by passing through an aperture 90*d* formed in the circular wall 90*a*.

As shown in FIGS. 15, 16, 18 and 25, the backflow preventive mechanism 92 has two backflow preventive members, the guide pin 105 and a leaf spring 106 abutting against the guide pin 105. Between the guide pin 105 and the leaf spring 106, a thread passing portion 107, which has extremely small clearance, is provided. The thread T drawn from the spool 82 is passed through the thread passing portion 107. A frictional resistance is applied to the thread T due to the contact of the guide pin 105 and the leaf spring 106.

Both ends of the guide pin 105 are fixed in respective bosses 87*c* formed at the left part (FIGS. 15 and 16) of the openable cover 87. The leaf spring 106 is inserted into the openable cover 87 so as to urge the guide pin 105 in a leftwardly and downwardly inclined posture. A slender portion 105*a*, having a smaller diameter is formed at the middle portion of the guide pin 105. The thread passing portion 107 is formed by the slender portion 105*a* and the leaf spring 106. Thereby, the thread T passing through the thread passing portion 107 has an appropriate frictional resistance applied thereto and the thread T can be surely guided into the hollow needle 81.

As shown in FIGS. 15 to 17 and 26, the locking mechanism 93 integrally locks the openable cover 87 to the housing case 86 in a state where the sewing cartridge 5 is not attached to the sewing apparatus body 2. The locking mechanism 93 has the locking member 110 disposed on the left of the housing case 86. The locking member 110 is formed with pivot portions 110*a*, 110*b*, an engaging portion 110*c*, and an engaged portion 110*d* as an integrated structure. The pivot portions 110*a*, 110*b* are supported to the housing case 86 such that the locking member 110 pivots about a vertical axis. The locking member 110 can be switched between the locked position (see FIG. 15) and the unlocked position (see FIG. 16).

The locking member 110 is regulated in its vertical movement. The locking member 110 is urged to the locked position by a torsion spring 111. In FIG. 15, the engaging portion 110*c* protrudes leftward from the upper portion of the locking member 110. The engaged portion 110*d* protrudes leftward from the lower end portion of the locking member 110. The engaging portion 110*c* and the engaged portion 110*d* protrude toward the left from apertures 86*g*, 86*h*, respectively, which are formed in the upper portion of the left side wall and a back wall of the engagement groove 86*a*.

When the sewing cartridge 5 is not attached to the swing arm 40, the openable cover 87 is in the closed position. In this state, the engaging portion 110*c* of the locking member 110 in the locked position engages the engaged portion 87*d* protruding rightward (inward) in FIG. 15 from the front wall of the openable cover 87 from the above. Accordingly, the openable cover 87 cannot be moved upward with respect to the housing case 86 and is integrally locked to the housing case 86 in the closed position.

When the sewing cartridge 5 is attached to the swing arm 40, as described above, the engaging pin 42 rightwardly presses (FIG. 19, for example) and moves the engaged portion 110*d* of the locking member 110 as the engagement groove 86*a* of the housing case 86 engages the engaging pin 42 of the swing arm 40. Therefore, the locking member 110 is switched to the unlocked position from the locked position. In this state, the engaging portion 110*c* of the locking member 110 is in the unlocked position and is disengaged from the engaged portion 87*d*. The lock is released, so that the openable cover 87 can be moved upward with respect to the housing case 86.

Usually, the sewing cartridge 5 is detached from the swing arm 40 in a state where the openable cover 87 is in the closed position. Therefore, the openable cover 87 is locked to the housing case 86 in the locked position immediately after the sewing cartridge 5 is detached. If the sewing cartridge 5 is detached from the swing arm 40 in a state where the openable cover 87 is in a position other than the closed position, the locking member 110 is switched to the locked position with the openable cover 87 unlocked. However, the openable cover 87 is rotated to the closed position by the urging force from the torsion spring 88 because a tapered portion inclined leftwardly is formed at the left end portion of the engaging portion 110*c* of the locking member 110. At that time, the engaged portion 87*d* temporarily presses and moves the locking member 110 toward the unlocked position via the tapered portion, so that the openable cover 87 can be switched to the closed position.

Next, the sewing operation performed in the sewing apparatus 1 and stitches to be formed on the work cloth 70 by the sewing operation will be described with reference to FIGS. 27 to 34, 47 and 48.

In a state where the embroidery frame 4 having the work cloth 70 and the sewing cartridge 5 are attached to the sewing apparatus body 2, the sewing cartridge 5 is vertically moved by the cartridge driving mechanism 12. At that time, the hollow needle 81, the needle cover 83 (when the needle cover 83 is kept away from the work cloth 70), the spool 82, and the excessive rotation preventive mechanism 91 move up and down with the housing case 86. However, the openable cover 87 is supported by the pin 19*a* and is fixed with respect to the sewing apparatus body 2, so that the backflow preventive mechanism 92 provided therein hardly moves up and down.

Figure 46:
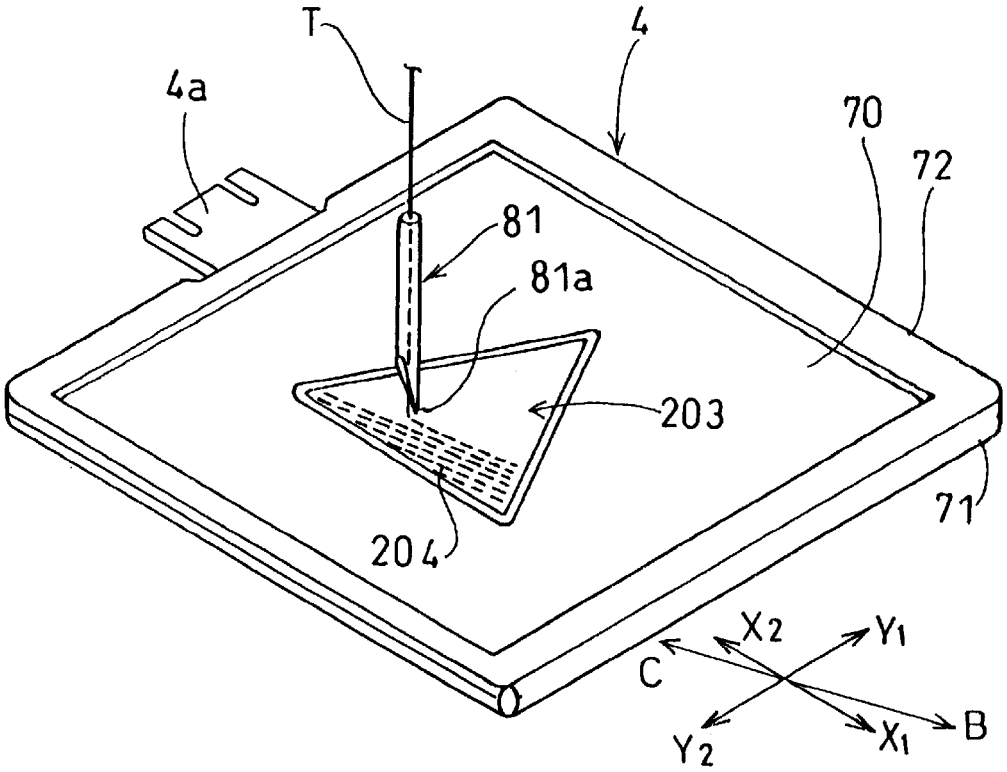
FIG. 46 is a perspective view showing a relative movement between the embroidery frame and the hollow needle.

When the hollow needle 81 in the sewing cartridge 5 is positioned in the upper limit position above the work cloth 70, based on a command signal for executing sewing operation, as shown in FIG. 46, the embroidery frame 4 can be moved in an X1-X2 direction by the X-axis direction driving mechanism 20 and in a Y1-Y2 direction by the Y-axis direction driving mechanism 30. Therefore, the embroidery frame 4 can be moved in all directions of combinations of X-axis and Y-axis directions as required (for example, in a direction indicated with an arrow B in FIG. 48).

Figure 27:
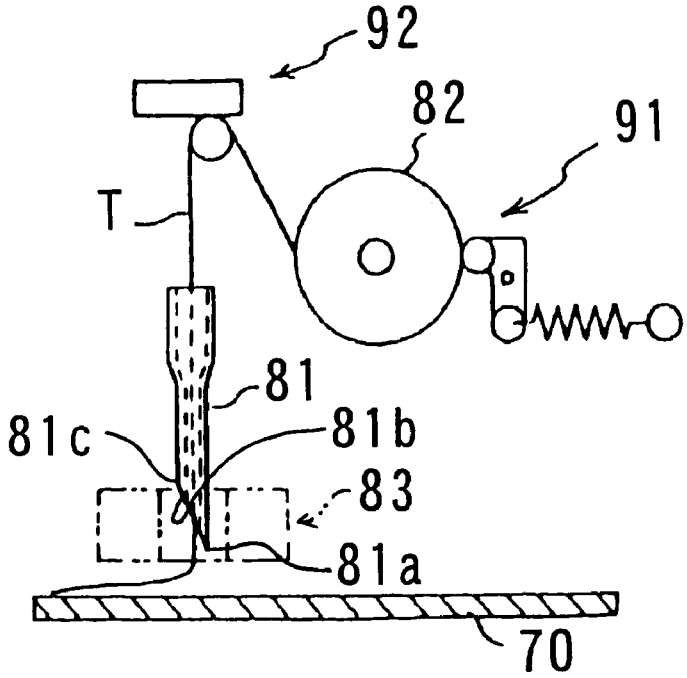
FIG. 27 is an explanatory diagram showing sewing operation (before the sewing operation is started)
Figure 47A:
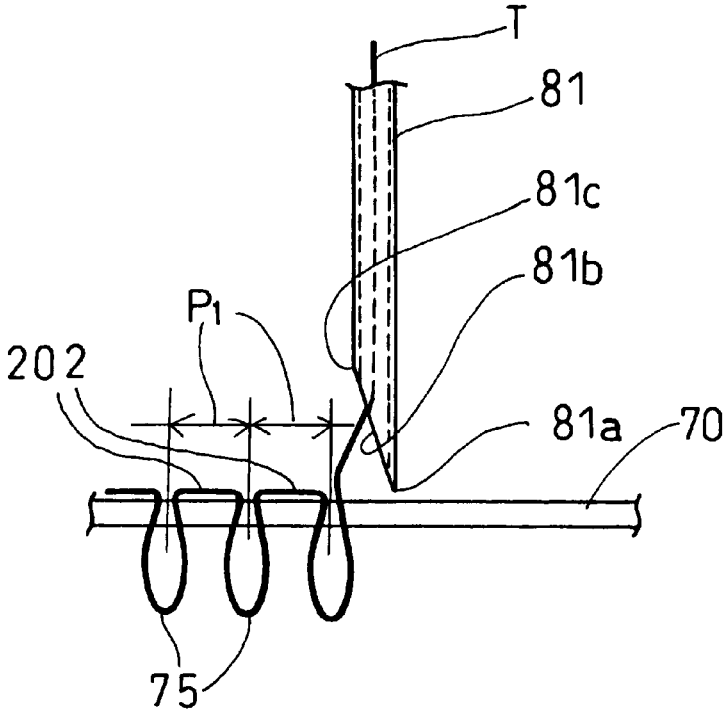
FIG. 47A is a side view of essential parts of the hollow needle.

The hollow needle 81 has an inclined opening 81*b*, which is formed by the hollow needle 81 being cut across the extreme tip 81*a* of the hollow needle so that the tip is inclined rightwardly and downwardly from the left to the right (see FIGS. 27 and 47A). An upper end 81*c* of the inclined opening 81*b* is positioned in line with an axis 200 and the extreme tip 81*a* of the hollow needle 81. The extreme tip 81*a* of the hollow needle 81 is located on the side near the center-of-swing of the swing arm 40, so that the inclined opening 81*b* opens toward the free end of the arm portion 40*a*.

Figure 28:
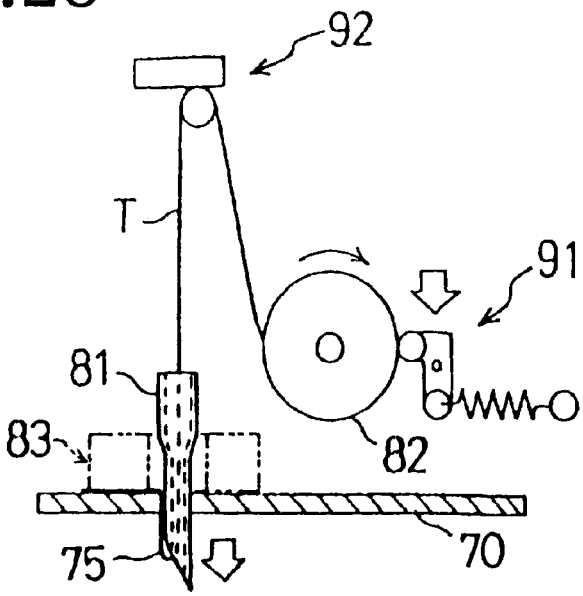
FIG. 28 is an explanatory diagram showing the sewing operation (when a first stitching is performed)

When the sewing cartridge 5 is attached to the swing arm 40 and the first sewing operation is performed, as shown in FIG. 27, a certain length of a thread T is drawn from the lower end of the hollow needle 81. When the housing case 86 descends from this state, as shown in FIG. 28, first, the needle cover 83 as a presser foot holds the work cloth 70 with the thread T on the work cloth 70. As the needle cover 83 holds the work cloth 70, the needle cover 83 comes to a substantial standstill. Then, the hollow needle 81 descends with respect to the needle cover 83 and penetrates the work cloth 70. At that time, the hollow needle 81 is substantially perpendicular to the work cloth 70 at the instant when the hollow needle 81 penetrates the work cloth 70. The extreme tip 81*a* of the hollow needle 81 is positioned on the center-of-swing side of the swing arm 40, so that the work cloth 70 is prevented from being displaced.

When the hollow needle 81 penetrates the elastic film member 73 and the thread T extending from the hollow needle 81 and penetrating the work cloth 70, the thread T penetrating the work cloth 70 is held by a thread holding force due to elasticity of the elastic film member 73. In this state, when the hollow needle 81 (the spool 82 and the excessive rotation preventive mechanism 91) further descends, the thread T is drawn from the spool 82 against the draw resistance for the thread T provided by the excessive rotation preventive mechanism 91 and the backflow preventive mechanism 92 and a free loop 75 is formed on a reverse side of the work cloth 70. At this stage, a half of the thread T forming the free loop 75 exists inside of the hollow needle 81.

While the hollow needle 81 penetrates the work cloth 70 and descends to a lower limit position, the thread T extending from the hollow needle 81 is pulled toward the reverse side of the work cloth 70 and more thread T is drawn from the spool 82. Thus, the free loop 75 is formed on the reverse side of the work cloth 70. Further, the thread T is prevented, up to a point, from being pulled toward the reverse side of the work cloth 70 before the hollow needle 81 penetrates the work cloth 70, if the thread T extending from the hollow needle 81 is held between the needle cover 83 and the work cloth 70.

Figure 29:
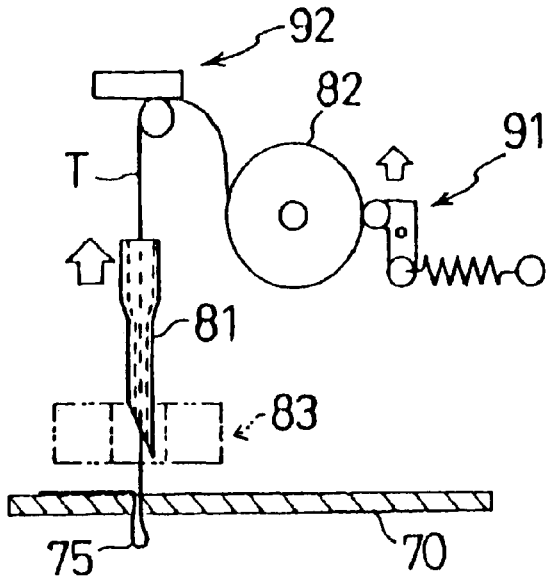
FIG. 29 is an explanatory diagram showing the sewing operation (when the hollow needle has risen immediately after the first stitching was performed)

Next, when the housing case 86 is moved upward, as shown in FIG. 29, the hollow needle 81 ascends from the lower limit position and the tip of the hollow needle 81 is pulled from the work cloth 70. Then, the work cloth 70, held by the needle cover 83, becomes free from the pressure and the needle cover 83 ascends to an upper limit position together with the hollow needle 81. At that time, only the hollow needle 81 ascends while the thread T is fixed or set between the backflow preventive mechanism 92 stopped in a certain position and the work cloth 70. The free loop 75 formed on the reverse side of the work cloth 70 is held and the entire free loop 75 is exposed. When the hollow needle 81 moves to the upper limit position, the spool 82 and the excessive rotation preventive mechanism 91 also move to the upper limit position. At that time, the thread T is not drawn from the backflow preventive mechanism 92 to the hollow needle 81, and the backflow preventive mechanism 92 and the excessive rotation preventive mechanism 91 apply resistance to drawing the thread to the thread T. Accordingly, the thread T extending between the spool 82 and the backflow preventive mechanism 92 becomes loosened.

Figure 30:
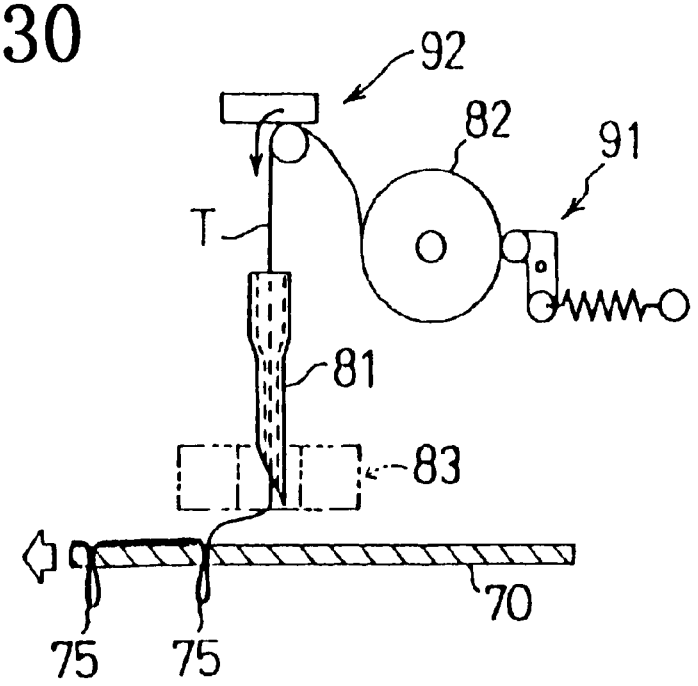
FIG. 30 is an explanatory diagram showing the sewing operation (while advancing a work cloth)

Then, as shown in FIG. 30, as the work cloth 70 is moved in a horizontal direction, the thread T is pulled by the thread holding force and the loosened thread T extending between the spool 82 and the backflow preventive mechanism 92 is pulled via the backflow preventive mechanism 92 because the thread T extending from the hollow needle 81 is held by the work cloth 70. At that time, the thread holding force by the work cloth 70 is far greater than the resistance to draw of the thread by the backflow preventive mechanism 92, so that there is no possibility of pulling out the thread T forming the free loop 75 toward the hollow needle 81 side.

Figure 31:
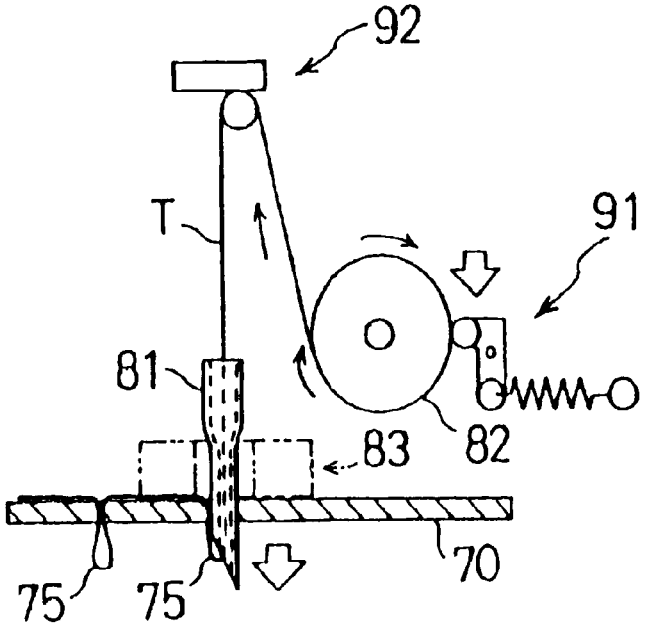
FIG. 31 is an explanatory diagram showing the sewing operation (when a second or following stitching is performed)

After the work cloth 70 is moved in the horizontal direction, the housing case 86 descends. As shown in FIG. 31, the needle cover 83 holds the work cloth 70 and the hollow needle 81 penetrates the work cloth 70. While the hollow needle 81 descends from the upper limit position to the lower limit position, the remaining loosened thread T extending between the spool 82 and the backflow preventive mechanism 91 is pulled and then the thread T is drawn from the spool 82. Applied to the drawn thread T is the resistance to drawing the thread by the excessive rotation preventive mechanism 91 and the backflow preventive mechanism 92. As described above, the resistance to drawing the thread is smaller than the thread holding force of the work cloth 70. Further, thread T can be pressed against the work cloth 70 by the needle cover 83. Accordingly, a new free loop 75 is formed without pulling the previous free loop 75 from the work cloth 70.

Figure 32:
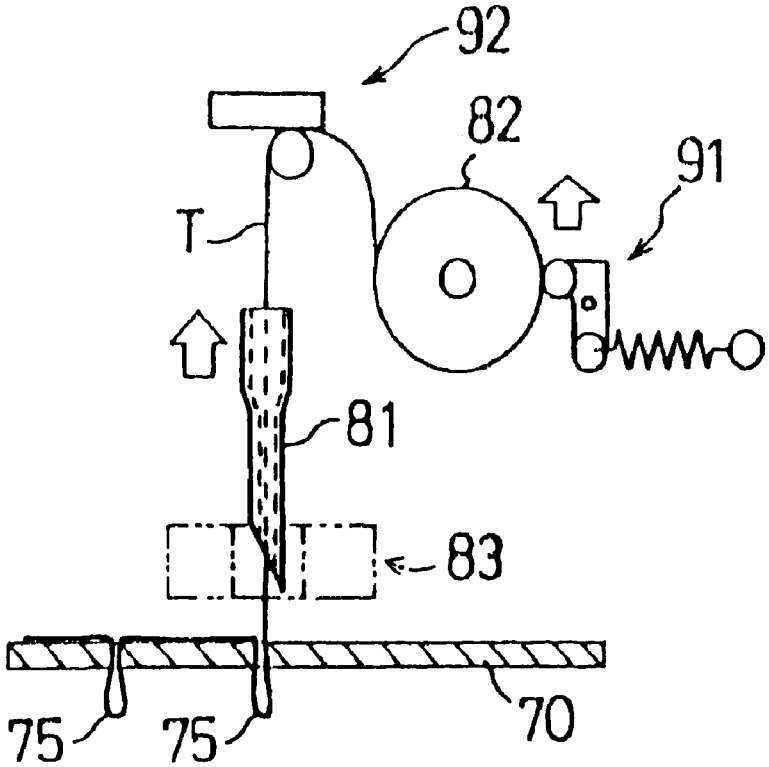
FIG. 32 is an explanatory diagram showing the sewing operation (when the hollow needle has risen immediately after the second or following stitching is made)
Figure 33:
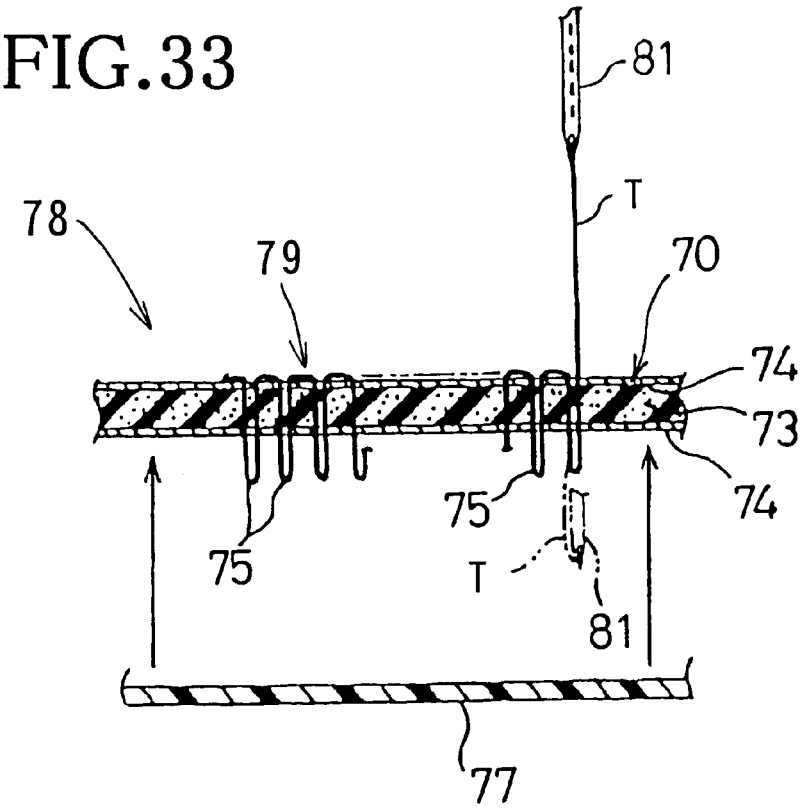
FIG. 33 is a sectional view of a work cloth, an embroidery pattern formed on the work cloth, and a double-sided adhesive tape.
Figure 34:
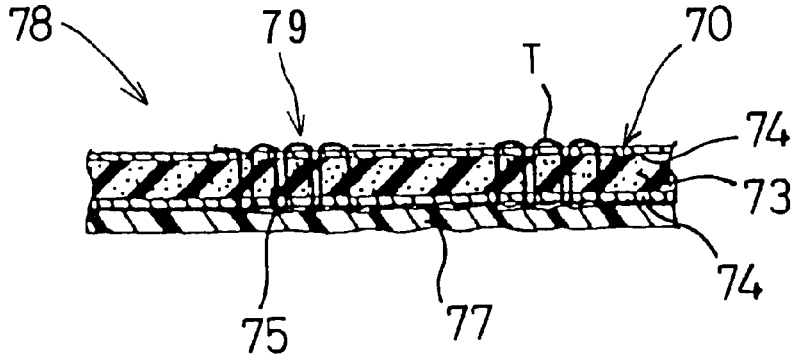
FIG. 34 is a sectional view of a patterned cloth.

Next, as shown in FIG. 32, the hollow needle 81 and the needle cover 83 ascend. Then, the operations shown in FIGS. 30 to 32 are repeatedly performed. As described above, the thread T is left in the work cloth 70 every sewing operation by the thread holding force produced by the elasticity of the work cloth 70 and a plurality of free loops 75 are formed on the reverse side of the work cloth 70 by the thread T, as shown in FIG. 33. Thus, stitches forming an embroidery pattern 79 are formed on the surface of the work cloth 70. When a double-sided adhesive tape 77 is adhered to fix the free loops 75 on the reverse side of the work cloth 70, a patterned cloth 78, as shown in FIG. 34, is obtained.

Accordingly, the free loops 75 do not come off or out, so that the thread T does not need to be fixed by other thread or the thread of the previous stitch and following stitch. The embroidery pattern 79 formed on the work cloth 70 is stable without unraveling. The patterned cloth 78 can be attached to various things via the double-sided adhesive tape 77 as an emblem. Instead of the double-sided adhesive tape 77, adhesive agent may be applied to the reverse side of the work cloth 70 in layers. A tape may be formed of the adhesive agent and the tape may be used to fix the free loops 75 on the reverse side of the work cloth 70.

There are a plurality of free loops 75 on the reverse side of the work cloth 70. Accordingly, unevenness may develop in the double-sided adhesive tape 77 when the double-sided adhesive tape 77 is adhered to the reverse side of the work cloth 70. When the work cloth 70 is adhered to clothes via the double-sided adhesive tape 77 as an emblem, the emblem is liable to come off because the cloth is soft. However, adhesion of the work cloth 70 can be improved because of the unevenness of the double-sided adhesive tape 77. The unevenness is formed every free loop or every several free loops depending on the materials of the thread and the double-sided adhesive tape used.

Figure 47B:
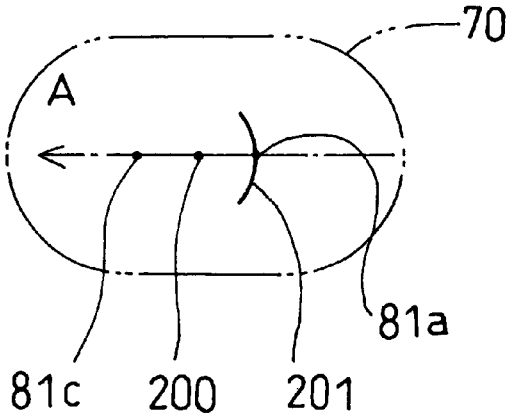
FIG. 47B is a plan view of a cut surface formed in the work cloth by which the hollow needle penetrates the work cloth.
Figure 48:
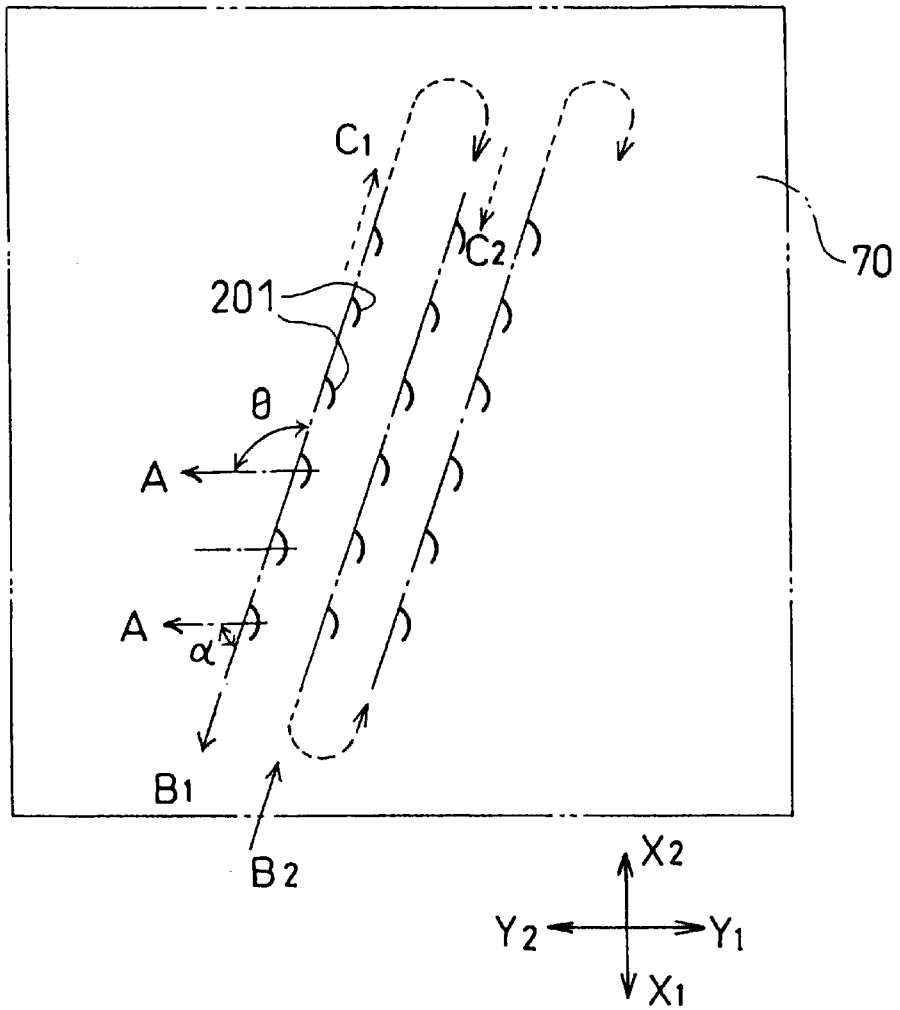
FIG. 48 is an explanatory diagram showing a sewing method for forming Tatami stitches.

Referring to FIGS. 46 to 48, a sewing method for providing an excellent sewing result (stitches) will be described below. In FIG. 48, stitches 202 are omitted for simplicity. As described above, as shown in FIG. 47A, the hollow needle 81 has the inclined opening 81*b*, which is formed by the hollow needle 81 being cut across the extreme tip 81*a* of the hollow needle so that the tip is inclined rightwardly and downwardly from the left to the right. Accordingly, as the hollow needle 81 penetrates the work cloth 70, as shown in FIG. 47B, at a stitch position, an arc-shaped cut surface 201, which is substantially equal to a radius of the hollow needle 81, is formed around the axis 200 of the hollow needle 81. A thread T is held by the arc-shaped cut surface 201 in the work cloth 70.

The upper end 81*c* of the inclined opening 81*b* is positioned in line with the axis 200 and the extreme tip 81*a* of the hollow needle 81. A direction of a line segment extending from the extreme tip 81*a* to the upper end 81*c*, which is projected on the surface (an X-Y plane) of the work cloth 70, is defined as a needle tip opening direction A. In the embodiment, the needle tip opening direction A is parallel to (coincides with) the extending direction of the arm portion 40*a* from the base side to the free end side, when the arm portion 40*a* is viewed from above.

As shown in FIG. 46, it is assumed that the surface of the work cloth 70 attached to the embroidery frame 4 is the X-Y plane and the axis 200 of the hollow needle 81 extends in a direction perpendicular to the X-Y plane. While the hollow needle 81 ascends from a stitch position and is apart from the work cloth 70, the embroidery frame 4 is moved in any direction of X1, X2, Y1 or Y2, or varying combinations of X1 or X2 and Y1 or Y2 (hereinafter, referred to as a work cloth moving direction B) and then is brought to a standstill. After that, the hollow needle 81 penetrates the work cloth 70 at a current stitch position and then the hollow needle 81 ascends. As a result, a stitch 202 is formed on the surface of the work cloth 70 between the current stitch position and the previous stitch position. A direction that stitches 202 are to be formed is referred to as a stitching direction. In the X-Y plane, the stitching direction is a direction (indicated with an arrow C) opposite to the work cloth moving direction B.

As described above, the lower end part of the hollow needle 81 is inclined as a syringe. If sewing operation is performed while the hollow needle 81 is oriented such that the extreme edge 81*a* of the hollow needle 81 is located upstream of the thread T extending upward from a preceding stitch position in a moving direction of the work cloth 70 and is located downstream in the stitching direction C (which is a direction of moving the hollow needle 81 toward a next stitch position from a stitch position where the hollow needle 81 has passed through the work cloth 70) when the work cloth 70 is moved to place the hollow needle 81 to a next stitch position from the preceding stitch position, a middle portion of the thread T between a portion of the thread T that is inside of the hollow needle 81 and a portion of the thread T that extends upward from a current stitch position is acutely bent at an edge of the inclined opening 81*b* in the hollow needle 81 while the hollow needle 81 penetrates the work cloth 70. Thus, the thread T is caught by the edge of the inclined opening 81*b*, so that the friction between the middle portion of thread T and the edge of the inclined opening 81*b* is increased when the hollow needle 81 passes through the work cloth 70. As a result of this, at a preceding free loop 75 formed on the reverse side of the work cloth 70 may become smaller or a stitch 202 may not be newly formed because the thread T comes out of a preceding stitch position. Further, the thread T may be cut by the edge of the inclined opening 81*b* at a stitch position when the hollow needle 81 penetrates the work cloth 70. Such situations happen when, for example, the work cloth 70 is moved rightward in FIG. 47A.

Therefore, a sewing method for providing excellent stitches is provided, for example, in a case where an embroidery portion 204, which is filled with Tatami stitches, is formed in a part of or the whole of an area 203 with stitches 202 having a substantially certain length P1, on the surface of the work cloth 70, as shown in FIG. 46. The Tatami stitches are formed as described below. First, a plurality of stitches 202 are formed substantially in line in a first stitching direction C1. When the line of the stitches 202 reaches one end of the area 203 (FIG. 46), the sewing operation is turned around in a direction opposite to the needle tip opening direction A and travels back in a stitching direction C2 to form a plurality of stitches 201 substantially in line, parallel with the line of the stitches 202 previously formed in the first stitching direction C1. When the line of the stitches 202 formed in the second stitching direction C2 reaches another end of the area 203, the sewing operation is turned around in the direction opposite to the needle tip opening direction A and travels back in the first stitching direction C1 to form a plurality of stitches 202 substantially in line, parallel with the line of the stitches 202 previously formed in the second stitching direction C2. The sewing operation is repeatedly performed in such a manner to form the Tatami stitches (see FIG. 48).

When forming the Tatami stitches, as shown in FIG. 48, if a work cloth moving direction is a direction of an arrow B1 with respect to the needle tip opening direction A with an included angle of $\alpha$ formed therebetween, a first stitching direction C1 is opposite to the work cloth moving direction B1 and an included angle between the needle tip opening direction A and the first stitching direction C1 is $\theta$. The included angle $\alpha$ is set so as to be between 20 and 160 degrees. A plurality of stitches 202 are formed in the first stitching direction C1 substantially in line until the line of the stitches 202 reaches one end of a predetermined area. At the one end of the area, the sewing operation is turned around in a direction opposite to the needle tip opening direction A and travels back in the second stitching direction C2 to form a plurality of stitches 202 substantially in line, parallel with the line of the stitches 202 previously formed in the first stitching direction C1. For example, when the included angle $\theta$ in the first stitching direction C1 is 120 degrees, the included angle $\theta$ in the second stitching direction C2 is 60 degrees.

By performing the above operation, when the included angle $\theta$ is, for example, between 90 and 160 degrees, in the first stitching direction C1, the thread T extending upward (toward the hollow needle 81) from a preceding stitch position is placed downstream from the extreme edge 81*a* of the hollow needle 81 in the direction of moving the work cloth 70 (in the work cloth moving direction B1). Therefore, when the hollow needle 81 penetrates the work cloth 70, the thread T will not be cut by the extreme tip 81*a* of the hollow needle 81 stepping on the thread T. Further, the sewing operation is performed while the hollow needle 81 is oriented such that the extreme tip 81*a* of the hollow needle 81 is located downstream in the first stitching direction C1, so that the thread T comes out from the hollow needle 81 on the side of the inclined opening 81*b* and the friction produced between the edge of the inclined opening 81*b* and the middle portion of the thread T is small. Therefore, the middle portion of the thread T is not caught by the edge of the inclined opening 81*b*. Consequently, the thread T will not come out from the preceding stitch position and the preceding free loop 75 formed on the reverse side of the work cloth 70 will not become small.

In the second stitching direction C2, the included angle $\theta$ is between 20 and 90 degrees. In this state, the sewing operation is performed while the hollow needle 81 is oriented such that the thread T extending upward (toward the hollow needle 81) from a preceding stitch is also located downstream from the extreme tip 81*a* of the hollow needle 81 in the direction of movement of the work cloth 70 (in the work cloth moving direction B2). When the hollow needle 81 penetrates the work cloth 70, the middle portion of the thread T between the portion of the thread T that is inside of the hollow needle 81 and the portion of the thread T that extends upward from a current stitch position is obtusely bent at the edge of the inclined opening 81*b* in the hollow needle 81. Because the thread T is obtusely bent at the edge, the friction produced between the middle portion of the tread T and the edge of the inclined opening 81*b* is small. Therefore, the thread T is not caught by the edge. Consequently, the thread T will not come out from the preceding stitch position and the preceding free loop 75 formed on the reverse side of the work cloth 70 will not become small. The included angle $\theta$ is preferably between 45 and 135 degrees.

As described above, in the Tatami stitches that fills an area with stitches on the work cloth 70, as shown in FIG. 48, sewing operation is repeatedly performed by turn in the first stitching direction C1 and in the second stitching direction C2 in which stitches are to be formed in a direction opposite to the first stitching direction C1. The second stitching direction C2 is substantially parallel to the first stitching direction. By performing the sewing operation as described above, lines of stitches are formed on the work cloth 70 in parallel to each other. To fill an area on the work cloth 70 with stitches, in the embodiment, the movement of the work cloth 70 is controlled so that a spacing between adjacent lines of stitches is approximately between 0.2 and 0.25 mm. An internal diameter of the hollow needle 81 is approximately between 0.70 and 0.75. If a stitch that has already been formed in a line on the work cloth 70 lifts because of omission of a lower thread or a sag of the work cloth 70 when the hollow needle passes through the work cloth 70, it is necessary to prevent the extreme tip 81*a* of the hollow needle 81 from entangling the lifted stitch in a new line that is being formed next to the previously-formed line. Accordingly, new lines of stitches are to be formed in a direction opposite to the needle tip opening direction. With this control, even if the internal diameter of the hollow needle 81 is twice as large as the spacing between adjacent lines, the extreme tip 81*a* of the hollow needle 81 penetrates an area in which new lines of stitches are to be formed later, that is, an area in which no stitches have been formed, with respect to a line of stitches including a current stitch position. In other words, the extreme tip 81*a* of the hollow needle 81 does not penetrate an area in which lines of stitches have already been formed. Thus, the lifted stitch in a previous line can be prevented from being entangled in a new line by the hollow needle 81. Consequently, a thread T forming stitches formed on the work cloth 70 can be prevented from being cut when the hollow needle 81 passes through the work cloth 70 and excellent Tatami stitches can be formed.

Figure 49:
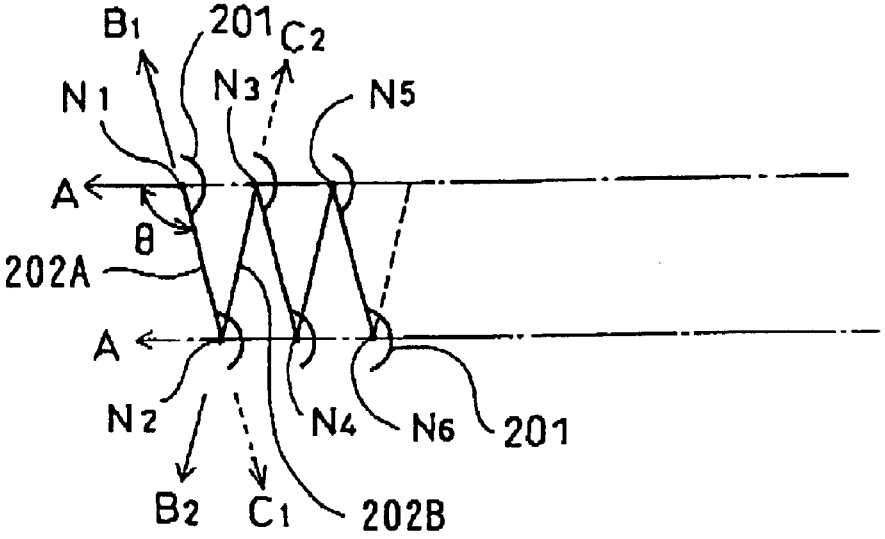
FIG. 49 is an explanatory diagram showing a sewing method for forming Satin stitches.

FIG. 49 shows a favorable sewing method for Satin stitches. In the Satin stitches, stitch positions N1, N2, N3, N4, N5, N6 . . . are aligned in two rows in a staggered configuration. In this case, for example, first, a stitch 202A is formed in the first stitching direction C1 (the stitch positions from N1 to N2) at any angle from 20 to 160 degrees with respect to the needle tip opening direction A. Then, a stitch 202B is formed in the second stitching direction C2 (the stitch positions from N2 to N3) which extends in the direction opposite to the first stitching direction C1 for forming the stitch 202A and opposite to the needle tip opening direction A. The sewing operation is repeatedly performed in such a manner to form the Satin stitches. In this case, the included angle θ between the needle tip opening direction A and the first stitching direction C1 (the second stitching direction C2) is between 20 and 160 degrees, preferably, between 45 and 135 degrees.

In the above case, also, the thread T extending upward (toward the hollow needle 81) from the previous stitch position is placed downstream from the extreme tip 81*a* of the hollow needle 81 in the direction of moving the work cloth 70 (the work cloth moving direction B1 or B2). Accordingly, when the hollow needle 81 penetrates the work cloth 70 at a stitch position after the work cloth 70 is moved in the work cloth moving direction B1 or B2, the thread T will not be cut by the extreme tip 81*a* of the hollow needle 81 at the time of penetration of the hollow needle 81 into the work cloth 70 because the thread T is not stepped on by the extreme tip 81*a* of the hollow needle 81. Further, a sewing operation is performed by which the hollow needle 81 is oriented such that the extreme tip 81*a* of the hollow needle 81 is positioned downstream in the stitching direction C1 or C2. Thus, the thread T will not be cut by the edge of the inclined opening 81*b*.

When a plurality of stitches 202 are formed by straight stitches, the stitches 202 may be formed in the first stitching direction C1 (see FIG. 48) at the included angle θ of between 20 and 160 with respect to the needle opening direction A.

If the above-described sewing method is adopted, a sewing failure will not occur. In particular, an appearance of embroidery portions formed by the above method is improved, so that a patterned cloth 78 having the embroidery portions has increased value as a product.

As shown in FIGS. 35 to 41, the sewing apparatus 1 is provided with a thread cutting mechanism 130 that cuts a thread T extending between the sewing cartridge 5 and the work cloth 70 attached to the embroidery frame 4 when the sewing cartridge 5 attached to the sewing apparatus body 2 is changed to the other sewing cartridge 5. As described above, the sewing apparatus body 2 is provided with the operating member 44*b* that is to be operated to detach the sewing cartridge 5 from the sewing apparatus body 2 (the swing arm 40). In response to the operation of the operating member 44*b* and the detachment of the sewing cartridge 5 from the sewing apparatus body 2, the thread cutting mechanism 130 is actuated so as to cut the thread T.

The thread cutting mechanism 130 includes a thread cutting lever 131, a link mechanism 132 that is connected to the left end portion of the thread cutting lever 131, a pair of cutting blades 133, 134 that open and close via the link mechanism 132, and an engagement mechanism 135. The thread cutting lever 131 is pivotally supported to the engagement plate 19 near the operating member 44*b* and straightly extends toward the left. The engagement mechanism 135 releasably engages the right portion of the sewing cartridge 5 with the thread cutting lever 131 in a state where the engagement groove 86*a* formed in the sewing cartridge 5 engages the engaging pin 42.

By the operation of the operating member 44*b* to detach the sewing cartridge 5 from the sewing apparatus body 2, the thread cutting lever 131 and the link mechanism 132 become movable. In response to the detachment of the sewing cartridge 5, the thread cutting lever 131 and the link mechanism 132 are moved. As a result, the thread cutting mechanism 130 actuates to cut the thread T via the movement of the thread cutting lever 131 and the link mechanism 132.

Figure 35:
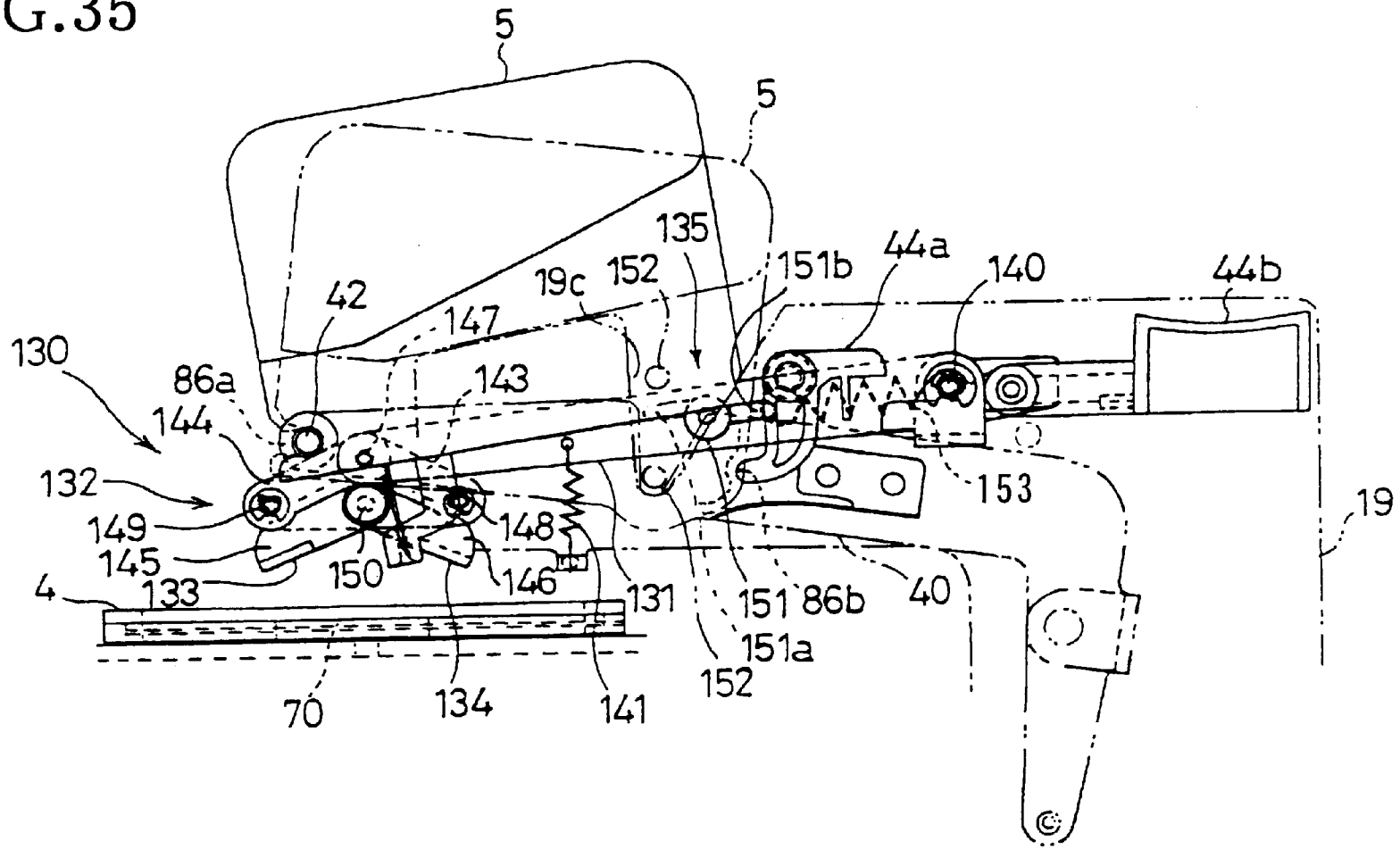
FIG. 35 is a front view of essential parts of a thread cutting mechanism (in a standby state)
Figure 36:
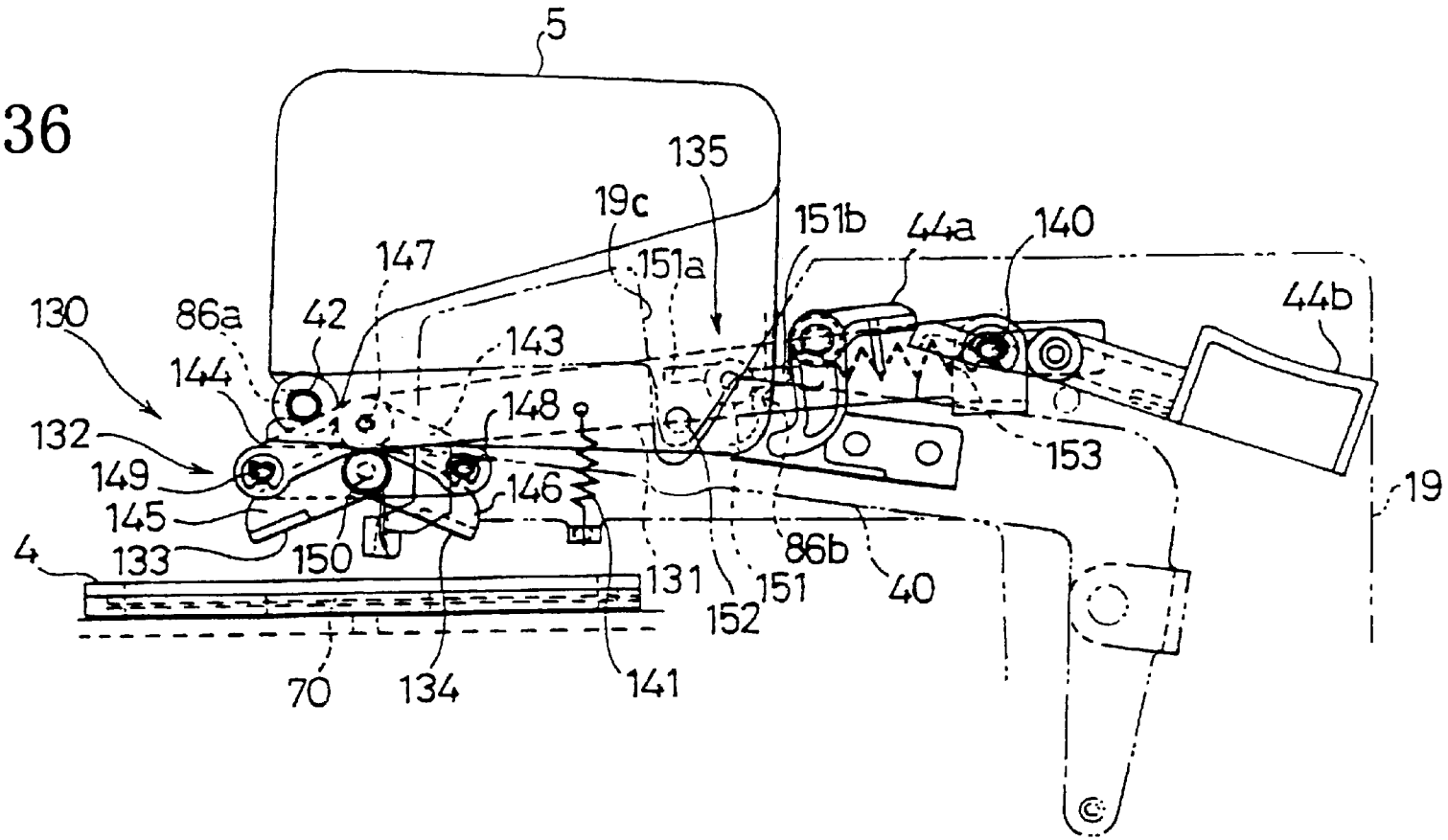
FIG. 36 is a front view of essential parts of the thread cutting mechanism (in the standby state)
Figure 37:
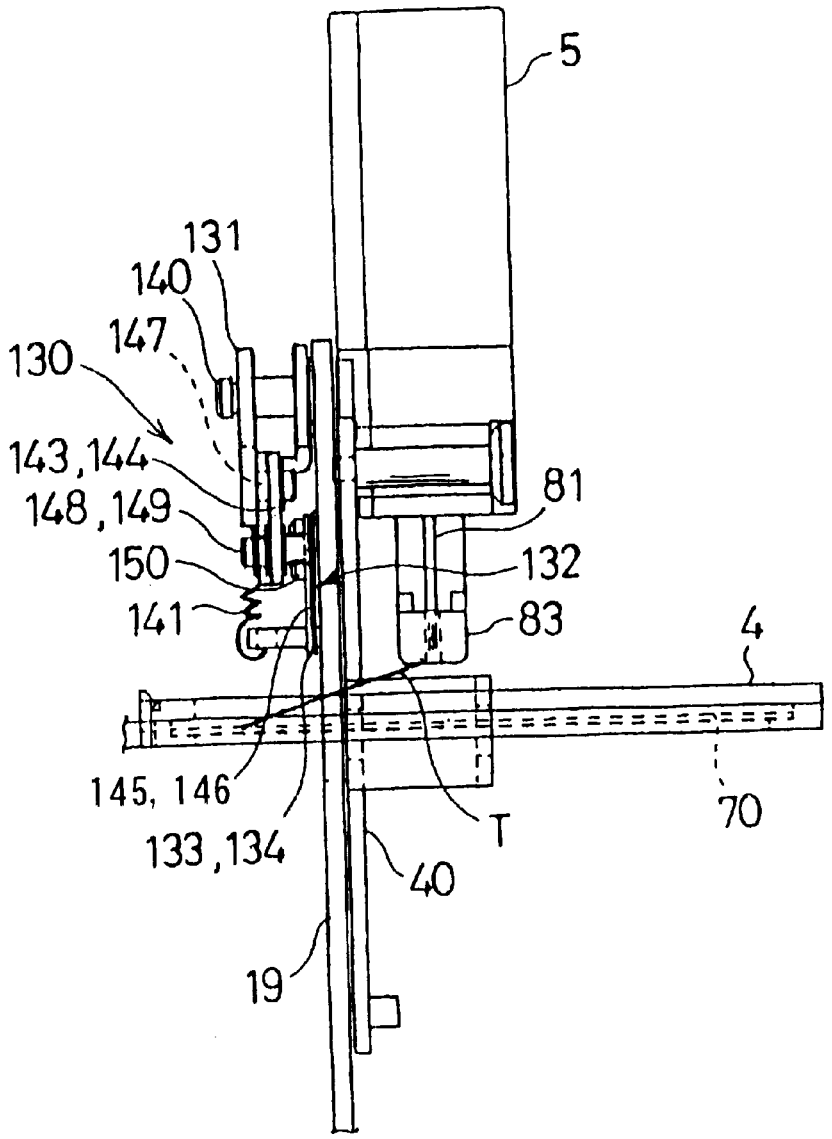
FIG. 37 is a left side view of essential parts of the thread cutting mechanism of FIG. 36.

The thread cutting lever 131 is disposed behind the engagement plate 19. Through holes 131*a* (see FIG. 40) are formed in the thread cutting lever 131 at its right end portion. The thread cutting lever 131 is pivotally supported to the engagement plate 19 using a pivot shaft 140, extending in the front and rear direction. As shown in FIGS. 35 to 37, the thread cutting lever 131 can vertically travel between a lower limit position shown in FIG. 38 and an upper limit position shown in FIG. 39. Upper and lower ends of a coil tension spring 141 are connected with the thread cutting lever 131 and the engagement plate 19, respectively. The thread cutting lever 131 is elastically urged to the lower limit position by the coil tension spring 141.

The link mechanism 132 has four links 143 to 146, which are substantially straight-shape members. The links 143, 144 are rotatably connected to the left end portion of the thread cutting lever 131 via a shaft 147 at their upper end portions (FIG. 35). The lower end portions of the links 143, 144 are rotatably connected to the upper end portions of the links 145, 146 via shafts 148, 149, respectively. The links 145, 146 are rotatably supported to the engagement plate 19 via a shaft 150 at their middle portion in the length of the links 145, 146. The links 145, 146 are provided with cutting blades 133, 134, respectively, at the lower end portions. When the thread cutting lever 131 is placed in the lower limit position, the shafts 147 and 150 become very close to each other and the links 145, 146 having the cutting blades 133, 134 are opened to the maximum. When the thread cutting lever 131 is placed in the upper limit position, the shafts 147 and 150 are apart from each other and the links 145, 146 having the cutting blades 133, 134 are closed.

The engagement mechanism 135 has a thread cutting lever pawl 151 that is rotatably supported in front of the thread cutting lever 131 at its middle in the length direction. The sewing cartridge 5 is provided with a pin-like protrusion 152, extending toward the rear, at its lower right portion. The thread cutting lever pawl 151 has a pawl portion 151*a* (disposed in a side of the link mechanism 132 in FIG. 35), extending outward in a diameter of the thread cutting lever pawl 151 with respect to its axis of rotation, and a spring connecting portion 151*b* (disposed in a side of the operating member 44*b* in FIG. 35). The protrusion 151 provided to the sewing cartridge 5 can engage the pawl portion 151*a*. The thread cutting lever pawl 151 is rotatably supported to a protrusion 131*b* (See FIG. 40) that protrudes toward the front, from a some midpoint in the length of the thread cutting lever 131.

Figure 41:
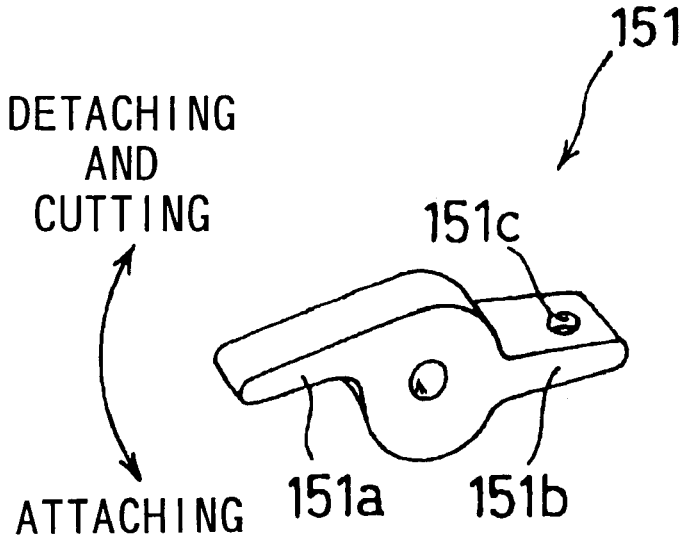
FIG. 41 is a perspective view of a thread cutting lever pawl.

As shown in FIG. 41, in the thread cutting lever pawl 151, the pawl portion 151*a* and the spring connecting portion 151*b* extend in almost opposite directions each other. A coil tension spring 153, which connects with the pivot shaft 140 of the thread cutting lever 131 at its right end, is hooked in a hole 151*c*, formed in the spring connecting portion 151*b*, at its left end. The spring connecting portion 151*b* is pulled by the coil tension spring 153, so that the pawl portion 151*a* extends leftward along the thread cutting lever 131 and the thread cutting lever pawl 151 is placed in an engagement position.

A swingable range of the thread cutting lever 131 is restricted by two engagement portions (not shown) provided above and below the thread cutting lever 131. When the thread cutting lever 131 is restricted (stopped) its swing, the thread cutting lever pawl 151 rotates. The thread cutting lever pawl 151 can freely rotate both clockwise and counterclockwise from the engagement position. However, the thread cutting lever pawl 151 is urged to the engagement position by the coil tension spring 153. The engagement plate 19 is formed with a cutaway portion 19*c* that is cut away from above so that the protrusion 152 of the sewing cartridge 5 can engage the thread cutting lever pawl 151.

The attachment/detachment of the sewing cartridge 5 to/from the swing arm 40 had been described above. As shown in FIG. 35, when the sewing cartridge 5 is attached to the swing arm 40, the sewing cartridge 5 is rotated in the clockwise direction while the engagement groove 86*a* of the sewing cartridge 5 is engaged with the engaging pin 42 of the swing arm 40. In process of attaching the sewing cartridge 5 to the swing arm 40, before the operating member 44*a* engages the engagement recess 86*b* in the sewing cartridge 5, the protrusion 152 engages the pawl portion 151*a* from above, so that the thread cutting lever 131 is restricted its movement. Then, the thread cutting lever pawl 151 is rotated in the counterclockwise direction from the engagement position due to a force of pressing the sewing cartridge 5.

As shown in FIGS. 36 and 37, in the state where the sewing cartridge 5 is attached to the swing arm 40 with the engaging member 44*a* engaged with the engagement recess 86*b*, the protrusion 152 and the pawl portion 151*a* is disengaged by the rotation of the thread cutting lever pawl 151. The thread cutting lever pawl 151 is rotated in the clockwise direction due to the urging force from the coil tension spring 153 so that the thread cutting lever pawl 151 is returned to the engagement position. The pawl portion 151*a* is positioned above the protrusion 152. In this state, the thread cutting lever 131 is held at the lower limit position and the cutting blades 133, 134 are opened.

Figure 38:
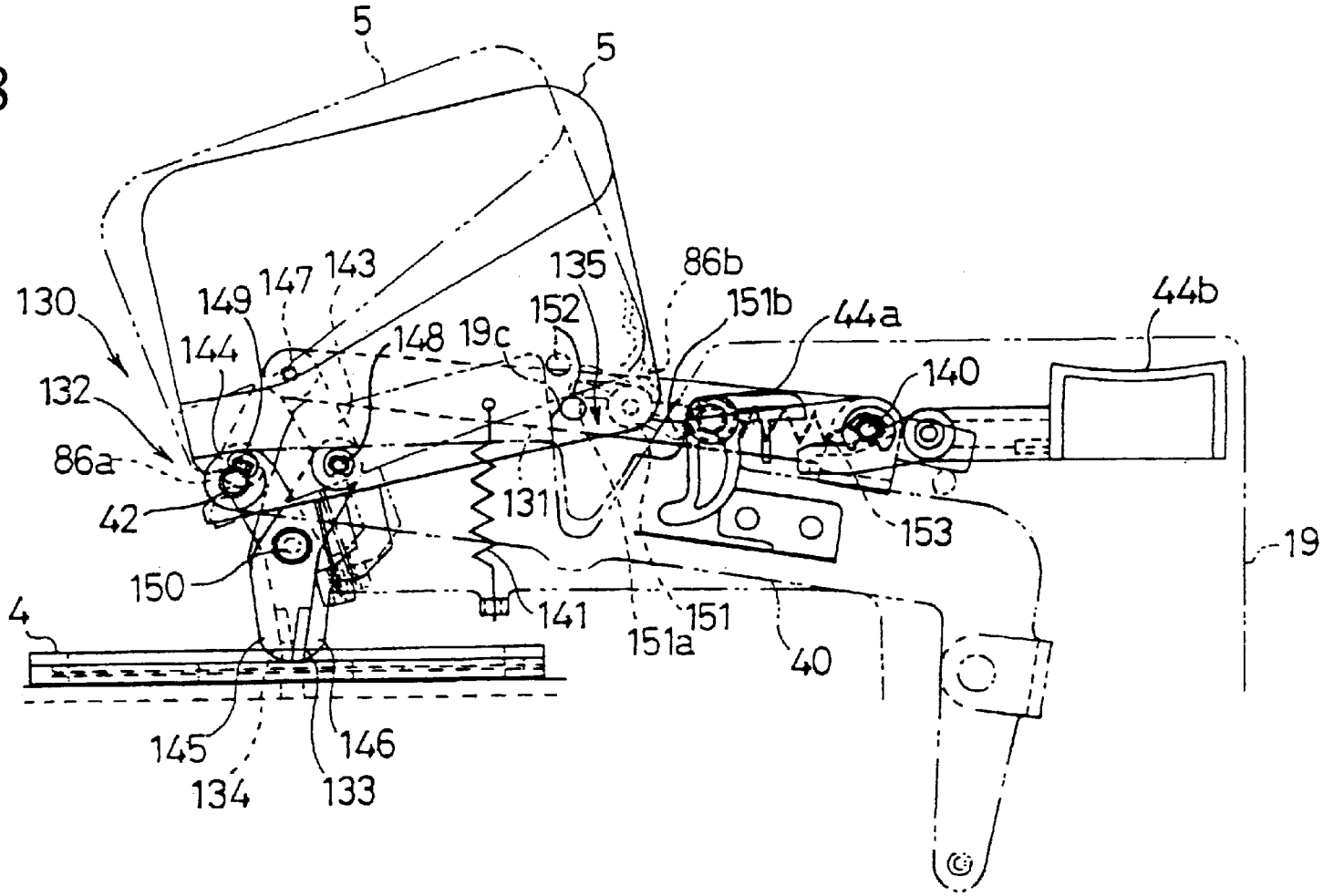
FIG. 38 is a front view of essential parts of the thread cutting mechanism (when the thread is being cutting)
Figure 39:
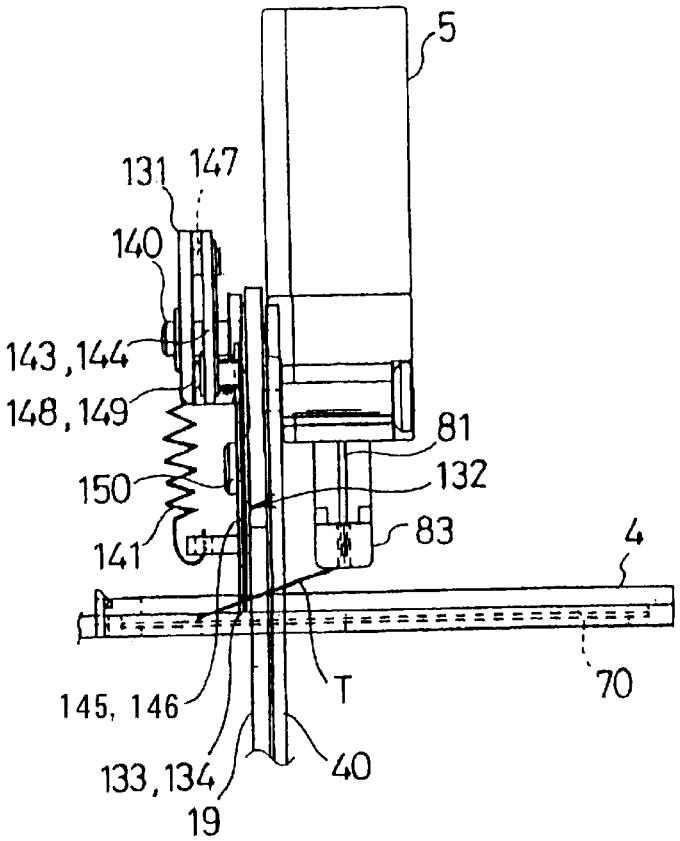
FIG. 39 is a left side view of essential parts of the thread cutting mechanism of FIG. 38.
Figure 40:
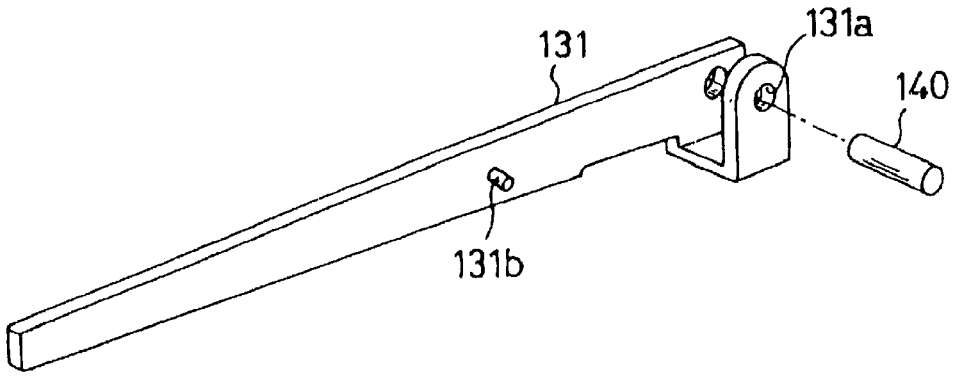
FIG. 40 is a perspective view of a thread cutting lever.

When the sewing cartridge 5 is detached from the swing arm 40, first, as shown in FIG. 36, the engaging member 44*a* is disengaged from the engagement recess 86*b* by operating the operating member 44*b*. As a result, the sewing cartridge 5 is brought into a state where the sewing cartridge 5 can be detached from the swing arm 40 at any moment by rotating in the counterclockwise direction about the engaging pin 42. As the sewing cartridge 5 is further rotated in the counterclockwise direction, as shown in FIGS. 38 and 39, the protrusion 152 of the sewing cartridge 5 engages the pawl portion 151*a* from below and the thread cutting lever pawl 151 is slightly rotated in the clockwise direction, so that the thread cutting lever pawl 151 cannot be rotated by itself. Then, therefore, the thread cutting lever 131 is rotated up to the upper limit position together with the thread cutting lever pawl 151. In the meantime, the cutting blades 133, 134 are closed, thereby cutting the thread T.

The protrusion 152 of the sewing cartridge 5 is leftwardly lifted. Therefore, when the thread cutting lever 131 is rotated up to the upper limit position, the thread cutting lever pawl 151 is further rotated, so that the protrusion 152 and the pawl portion 151*a* are disengaged. Then, the thread cutting lever 131 is returned to the lower limit position due to the urging force from the coil tension spring 141, so that the thread cutting lever pawl 151 is also returned to the engagement position due to the urging force from the coil tension spring 153.

In order to surely cut the thread T by the cutting blades 133, 134, the thread T is required to be placed between the opened cutting blades 133, 134. The thread T is moved to the position by the control of the movement of the embroidery frame 4 by the controller 13 (the thread cutting preparation processing). The thread T extends between the sewing cartridge 5 and a last stitch position on the work cloth 70. That is, by the thread cutting preparation processing, the embroidery frame 4 is moved backward so that the last stitch position is placed behind the hollow needle 81. Thus, the thread T can be placed between the cutting blades 133, 134 with the thread T stretched.

As described above, the sewing cartridge 5 is detached from the sewing apparatus body 2 by operating the operating member 44*b* provided to the sewing apparatus body 2. In response to the operation of the operating member 44*b* and the detachment of the sewing cartridge 5 from the sewing apparatus body 2, the thread T can be cut by actuating the thread cutting mechanism 130.

That is, first, by the operation of the operating member 44*b*, it can be determined that the sewing cartridge 5 is detached from the sewing apparatus body 2. Then, before the sewing cartridge 5 is completely removed from the swing arm 40, the thread cutting mechanism 130 can be actuated to cut the thread T. It is unnecessary to separately provide an operating member for operating the thread cutting mechanism 130. Accordingly, the number of operating process can be prevented from being increased.

With the structure described above, the sewing cartridge 5 can be prevented from being detached from the sewing apparatus body 2 without cutting the thread T or the thread T can be prevented from being mistakenly cut though the sewing cartridge 5 is not expected to be detached from the sewing apparatus body 2 (or to be changed to the other). That is, the thread cutting for detaching (changing) the sewing cartridge 5 from the sewing apparatus body 2 can be easily and surely performed. Further, the color of the thread T (the sewing cartridge 5) can be further easily performed.

Though drawings are omitted, a sensor that detects the operation of the operating member 44*b* and/or the detachment of the sewing cartridge 5 from the sewing apparatus body 2, and an actuator, such as an electric motor, that actuates the thread cutting mechanism 130 may be provided. With this structure, the actuator is actuated according to a detection signal provided by the sensor to actuate the thread cutting mechanism 130. In this case, the engagement mechanism 135 is removed. The operating member 44*b* may be provided to the sewing cartridge 5. The thread cutting mechanism 130 may be provided to the sewing cassette 5.

According to the sewing cartridge 5 described above, the needle cover 83 can cover at least the tip of the hollow needle 81 in both states where the sewing cartridge 5 is attached to and detached from the sewing apparatus body 2. Further, the needle cover 83 placed at a cover position can be inhibited from moving therefrom by the movement prohibiting mechanism 85, so that the tip of the hollow needle 81 can be prevented from being exposed to the outside due to careless handling. Accordingly, particularly when the sewing cartridge 5 is attached to or detached from the sewing apparatus body 2, damage to clothes due to the hollow needle 81 can be prevented and the sewing cartridge 5 can be easily and safely handled.

The hollow needle 81 is fixedly provided so that the portion of the tip side of the hollow needle 81 protrudes from the cassette body 80. Sewing operations can be performed by which the hollow needle 81 vertically reciprocates with the sewing cartridge 5 and the hollow needle 81 passes through the work cloth 70. Further, the needle cover 83 also serves as a presser foot. Therefore, a small sewing cartridge 5 having a simple structure can be provided. Further, the mechanism that reciprocates the hollow needle 81 (the sewing cartridge 5) can be simplified, thereby contributing to miniaturization of the sewing apparatus 1.

When the sewing cartridge 5 is attached to the sewing apparatus body 2, first, the sewing cartridge 5 is held in a posture different from the posture that the sewing cartridge 5 is attached to the sewing apparatus body 2. Then, the engagement groove 86*a* is engaged with the engaging pin 42 and the sewing cartridge 5 is rotated about the engaging pin 42. Thus, the sewing cartridge 5 can be placed in the sewable position. At that time, the engaging member 44*a* engages the engagement recess 86*b*, so that the sewing cartridge 5 can be regulated its rotation. That is, the sewing cartridge 5 can be easily and surely attached to the sewing apparatus body 2 and it can be easily determined whether the sewing cartridge 5 is attached to the proper position.

The structure of the sewing cartridge 5 may be partially changed as described below. The needle cover 83 may be structured such that the position of the needle cover 83 is manually switched between a cover position and a retracted position. In this case, the coil compression spring 84 that urges the needle cover 83 to the cover position can be removed. Thus, a standard sewing needle may be used instead of the hollow needle 81. The excessive rotation preventive mechanism 91 may be structured such that frictional resistance is produced by which a spool holder or other member or portion makes contact with the spool 82, instead of by which the contact 101 urged by the torsion spring 102 is pressed against the flange 82*b* of the spool 82. In the backflow preventive mechanism 92, a recess may be formed in the leaf spring 106 to provide a thread passing portion, instead of forming the slender portion 105*a* in the guide pin 105. Instead of forming the opening 86*c*, at least one of the housing case 86 and the openable cover 87 may be formed of a transparent or a translucent material so that the remaining amount of the thread T can be visually confirmed through the housing case 86 and/or the openable cover 87. The thread color indicating portion 87*b* may be provided to a portion other than the top surface of the openable cover 87 of the cassette body 80. As the thread color indicating portion 87*b*, the cassette body 80 may be partially or entirely colored with a same/similar color as the color of the thread T wound around the spool 82 contained in the cassette body 80.

Figure 42:
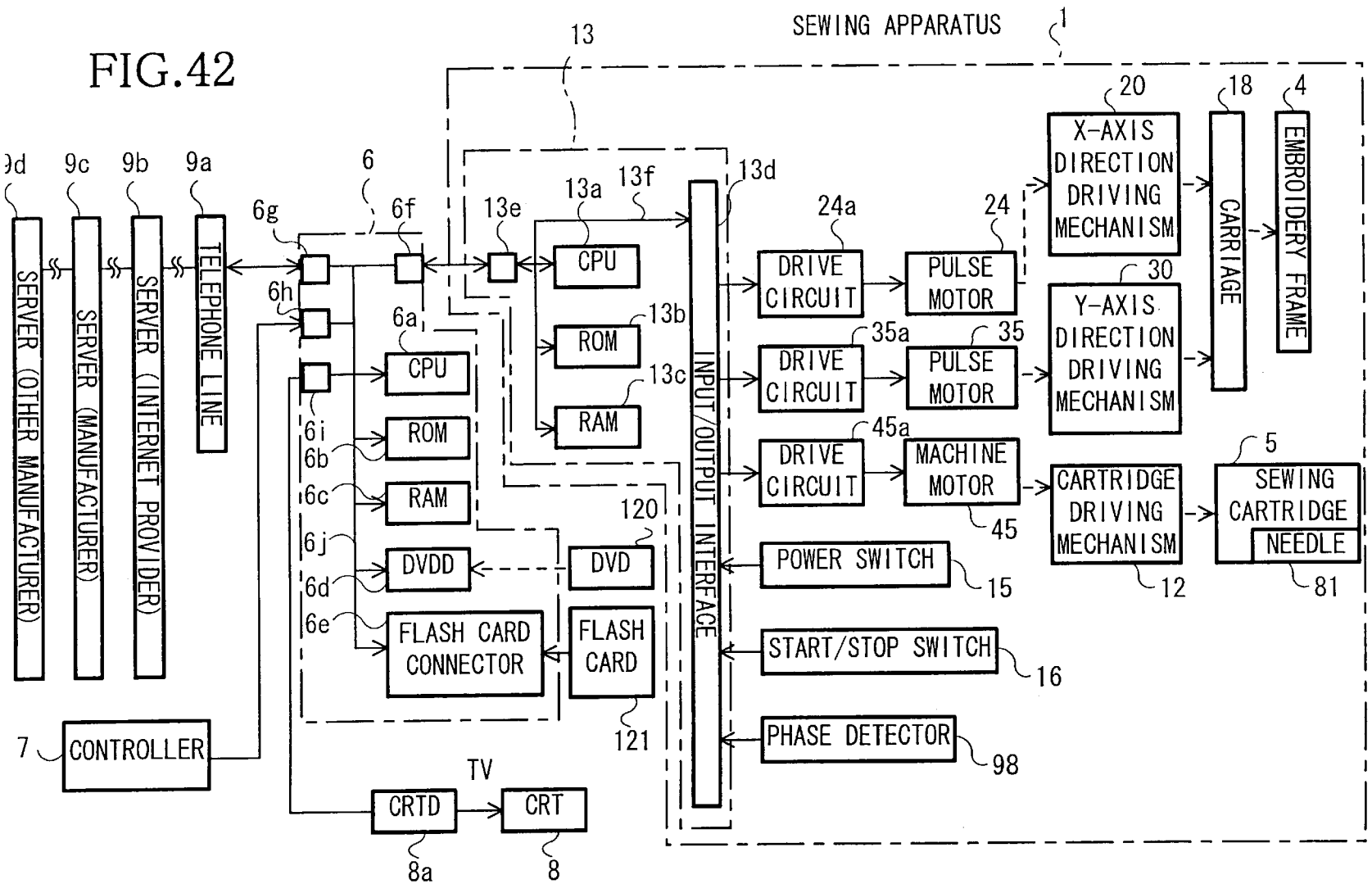
FIG. 42 is a block diagram showing a control system of the sewing apparatus and a game machine.

As shown in FIG. 42, the controller 13 of the sewing apparatus 1 has a computer including a CPU 13*a*, a ROM 13*b*, and a RAM 13*c*, an input/output interface 13*d*, and an input/output terminal 13*e*. The CPU 13*a*, the ROM 13*b*, the RAM 13*c*, the input/output interface 13*d*, and the input/output terminal 13*e* are connected to each other via a bus 13*f*. The input/output interface 13*d* is connected with a drive circuit 24*a* for the pulse motor 24 of the X-axis direction driving mechanism 20, a drive circuit 35*a* for the pulse motor 35 of the Y-axis direction driving mechanism 30, a drive circuit 45*a* for the machine motor 45 of the cartridge driving mechanism 12, the power switch 15, the start/stop switch 16, and a phase detector 98.

The phase detector 98 includes a plurality of photo interrupters and encoder disks which are fixedly attached to the pivot shaft integrally rotating with the large-diameter gear 54 and correspond to the photo interrupters. The phase detector 98 detects a rotational phase of the pivot shaft, so that an upper limit position, a lower limit position, and an unthreading position of the swing arm 40 can be detected.

The game machine 6 has a computer including a CPU 6*a*, a ROM 6*b* and a RAM 6*c*, a DVD drive (DVDD) 6*d* capable of reading and writing a DVD 120, a flash card connector 6*e*, input/output terminals 6*f*, 6*g*, an input terminal 6*h*, and an output terminal 6*i*, which are connected each other via bus 6*j*. The input/output terminal 6*f* is connected to the input/output terminal 13*e* of the sewing apparatus 1. The controller 7 is connected to the input terminal 6*h*. The output terminal 6*i* is connected with a drive circuit (CRTD) 8*a* for the display (CRT) 8. The drive circuit 8*a* and display 8 could also be an LCD drive and display. The input/output terminal 6*g* can be connected with a telephone line 9*a*.

The DVD 120, as an external storage medium, stores various sewing data and programs so that the sewing data and the programs are readable by the computer. The DVD 120 can be attached to or detached from the DVD drive 6*d*. When a DVD 120 storing game software for a video game is installed in the DVD drive 6*d*, a game screen is displayed on the display 8 according to the game software and a user can enjoy playing the game using the controller 7. Further, by connecting the input/output terminal 9*g* to the telephone line 9*a*, the sewing apparatus 1 can capture various data regarding sewing via the telephone line 9*a*, through a server 9*b* of an Internet provider, from a server 9*c* of a manufacturer of data and programs or a server 9*d* of another manufacturer. That is, various data regarding sewing provided from the manufacturers can be captured via the Internet 406.

A homepage of a manufacturer is not necessary to be established on a server in a country where a game machine or a terminal for sewing exists. The homepage may be established on a server in another country if the homepage can be accessed through the Internet using a connection, such as a telephone line. For example, a front homepage which is a "HOME" of a company is established on a server 9*d* in the U.S.A homepage of the same company or a related company or a private homepage is established on a server 9*d* in a country other than the U.S. (for example, European countries) so that control programs regarding sewing, control signals, and data can be sent from their homepage. The control programs, the control signals, and the data may be distributed worldwide via the Internet by which the homepage in the U.S. is linked to the homepage in the other country.

In the sewing apparatus 1, an embroidery pattern can be formed on the work cloth 70 by controlling the embroidery frame driving mechanism 11 (the X-axis direction driving mechanism 20 and the Y-axis direction driving mechanism 30) and the cartridge driving mechanism 12 by the controller 13 based on the sewing data. A control program for sewing is stored in the ROM 13*b*. In the embodiment, various characters (e.g., persons, animals, robots) to be displayed on the display 8 by the game software can be selected and edited using the game machine 6. Pattern data for sewing a selected/edited character can be created in the game machine 6 and can be supplied to the sewing apparatus 1.

Figure 43:
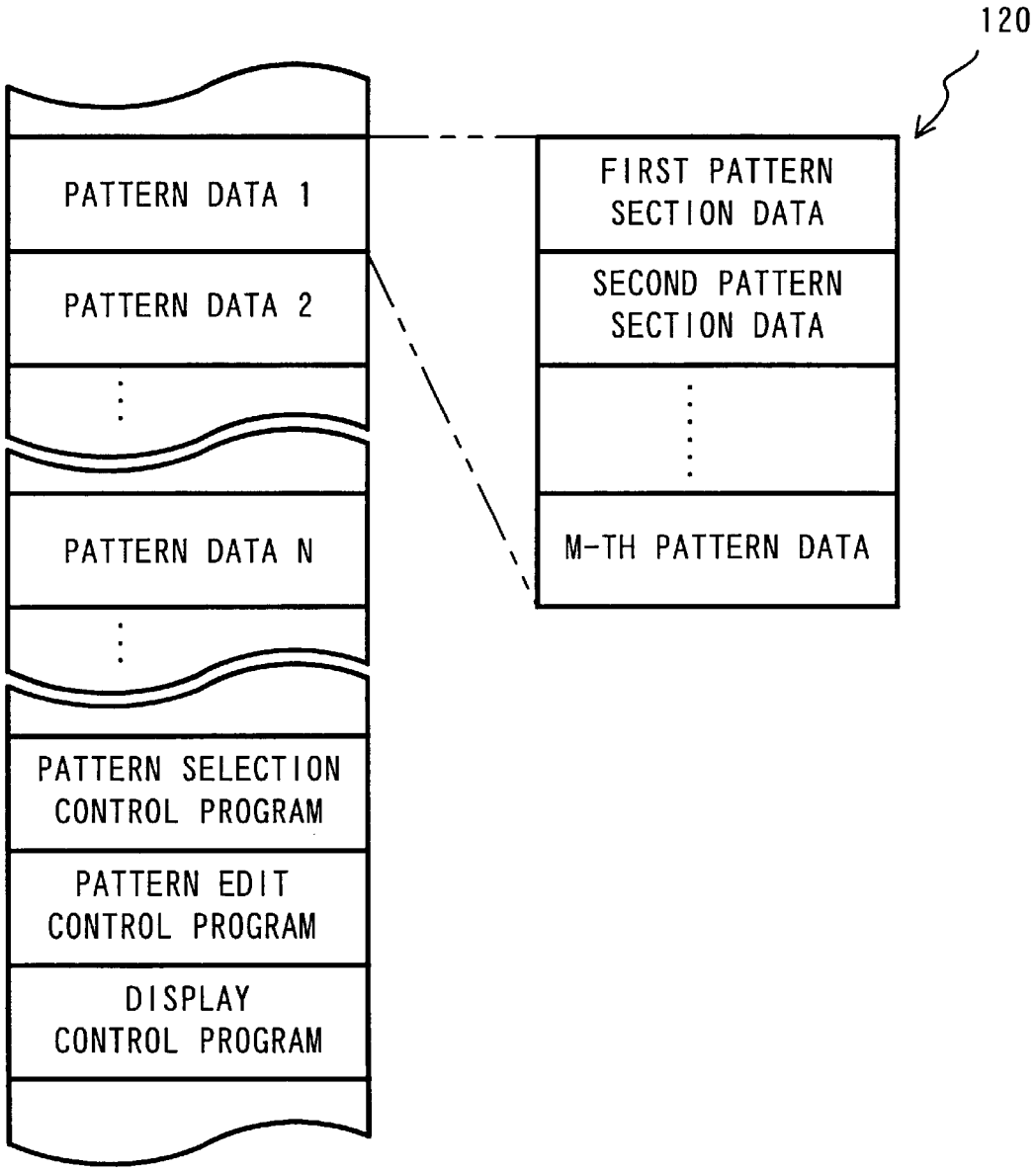
FIG. 43 is a diagram showing data stored in a DVD.

Therefore, the DVD 120 for selecting/editing sewing data is provided for the game machine 6. That is, as shown in FIG. 43, the DVD 120 stores various kinds of embroidery patterns selected from game software as described above, pattern data of various kinds for prestored embroidery patterns, a pattern selection control program for selecting a desired embroidery pattern from the various kinds of embroidery patterns, a pattern edit control program for editing (e.g., enlargement, reduction, unification, reversal) a selected embroidery pattern, and a display control program for displaying an embroidery pattern for selecting and setting on the display 8. A flash card 121, connectable to the flash card connector 6*e*, can store pattern data of a selected/edited embroidery pattern.

The DVD 120 also stores a pattern data creation program for creating pattern data by selecting/editing a character of game software based on data of the game software. When pattern data is created using the pattern data creation control program, first, the control program is downloaded into the RAM 6*c*, and then various kinds of characters are displayed by running the game software DVD. A character to be sewn is selected/edited, and then pattern data is created. The created pattern data is stored in the DVD 120.

Next, a series of operations of the sewing apparatus 1 described above will be described with reference to the flowcharts of FIGS. 44 and 45. As shown in FIG. 1, it is assumed that the sewing apparatus 1 is connected with the game machine 6 via the connecting cable and the DVD 120 storing data of FIG. 43 is installed in the DVD drive 6*d* of the game machine 6. The game machine 6 is connected to the display 8 via the connecting cable.

First, an embroidery pattern is selected/edited using the controller 7 of the game machine 6 while observing a screen on the display 8. The embroidery pattern can be selected/edited without turning the power of the sewing apparatus 1 on.

Figure 44:
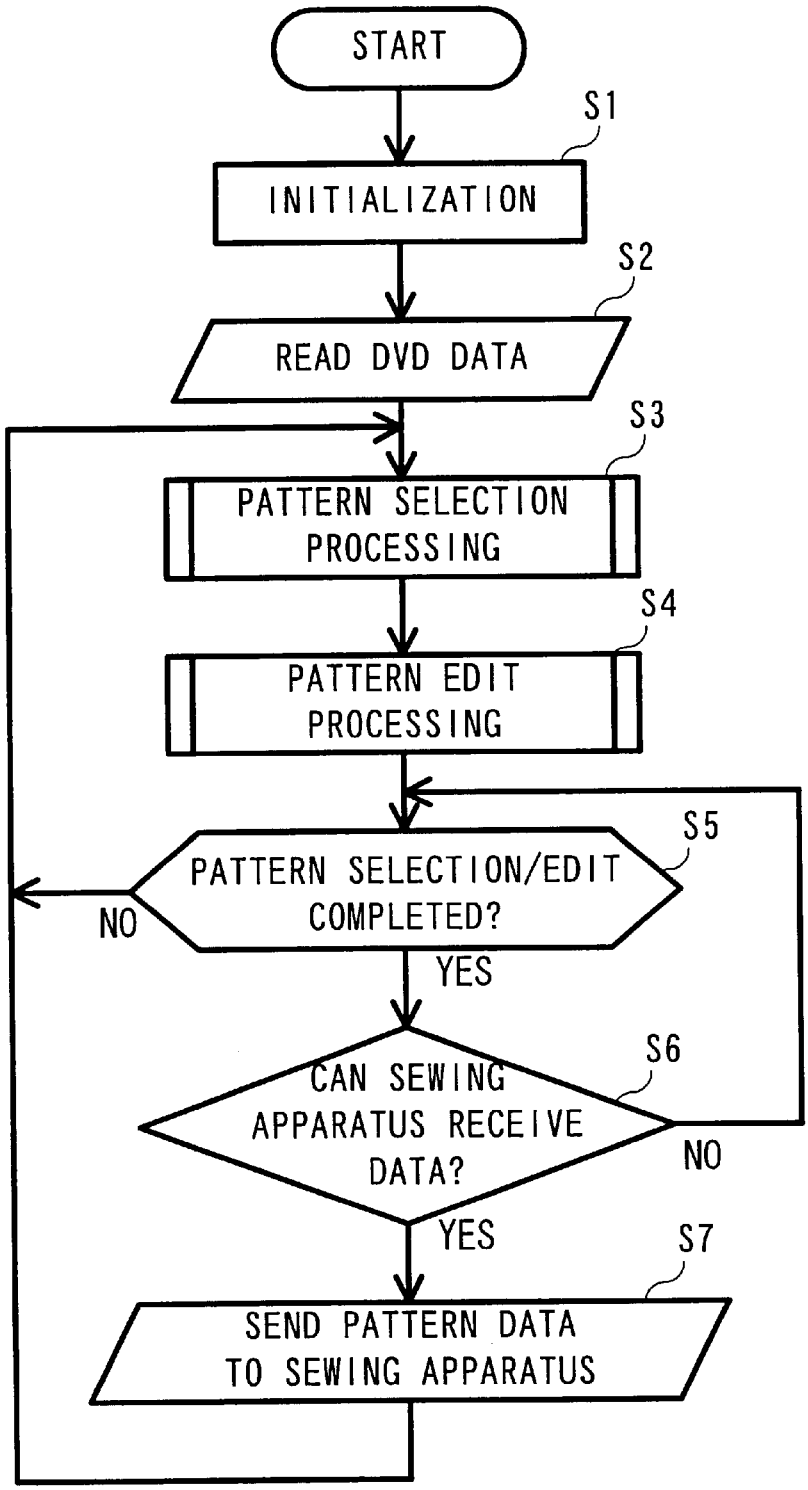
FIG. 44 is a flowchart of control to be executed in the game machine.

As shown in FIG. 44, in a controller of the game machine 6, control is started when the power of the game machine 6 is turned on. After initialization (S1) (S stands for a step), data in the DVD 120 (such as the pattern selection control program, the pattern edit control program, and the display control program) are read (S2). Then, in pattern selection processing (S3), a desired embroidery pattern can be selected from various kinds of embroidery patterns stored in the DVD 120. In pattern edit processing (S4), a selected embroidery pattern can be edited (e.g., enlargement, reduction, unification, reversal).

Selection/edit of the embroidery data is completed by operating a predetermined button of the controller 7 (S5;Yes). Then, when the sewing apparatus 1 can accept data (S6;Yes), the pattern data of the selected/edited embroidery pattern is sent to the sewing apparatus 1 (S7). After that, flow is returned to S3. When the sewing apparatus 1 cannot receive data, such that the power of the sewing apparatus 1 is not turned on (S6;No), flow returns to S5.

Figure 45:
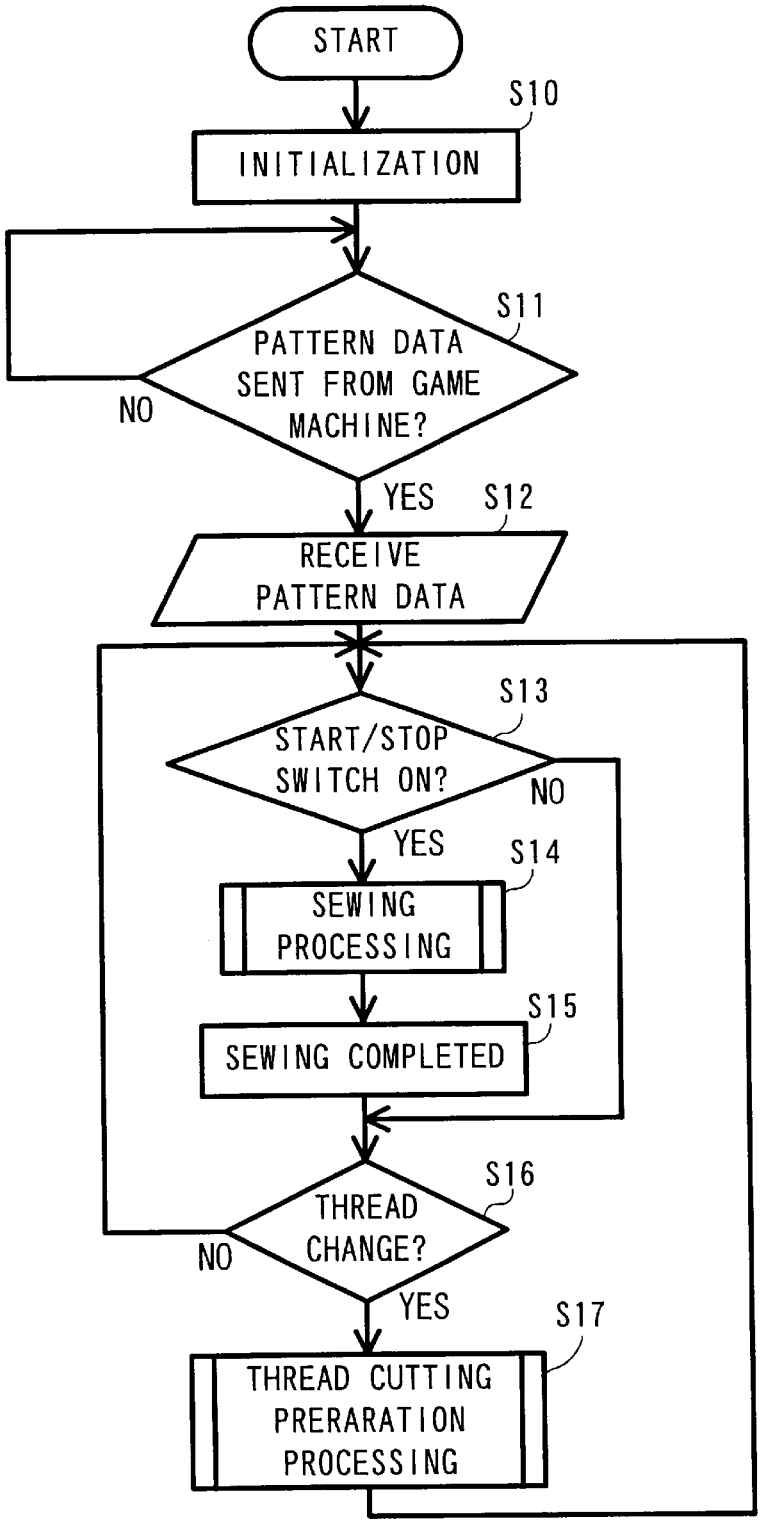
FIG. 45 is a flowchart of control to be executed in the sewing apparatus.

As shown in FIG. 45, in the controller 13 of the sewing apparatus 1, control is started when the power switch 15 is turned on. After initialization (S1), the sewing apparatus 1 can receive data. When the selected/edited pattern data is sent from the game machine 6 (S11;Yes), the sewing apparatus 1 receives the pattern data (S12). Next, when the start/stop switch 16 is turned on (S13;Yes), sewing processing is performed based on the received pattern data (S14).

Preparation required prior to starting the sewing operation will now be described.

In a state where the safety cover 3 of the sewing apparatus 1 is in the storage position, shown in FIG. 2, the embroidery frame 4 having the work cloth 70 is inserted into the inside of the safety cover 3 from the embroidery frame insertion slot 3*f* while the embroidery frame 4 is guided by the guide member 69 of the safety cover 3. The rear end support portion 4*a* of the embroidery frame 4 is engaged with the engagement portion 18*a* of the carriage 18. As described above, the carriage 18 in which the embroidery frame 4 can be surely attached is positioned substantially under the swing arm 40. At the initialization (S10), the carriage 18 is moved to this position and placed on standby. The safety cover 3 is in the storage position and the embroidery frame 4 slightly protrudes from the safety cover 3.

After the embroidery frame 4 is attached to the carriage 18, the guide member 69 is grasped and the safety cover 3 is slid forward so as to be placed in the sewing position shown in FIG. 3. In this state, the cartridge insertion slot 68 is formed by the safety cover 3 and the casing 10. The sewing cartridge 5, accommodating a thread of a desired color, is inserted into the inside of the safety cover 3 from the cartridge insertion slot 68 and is attached to the swing arm 40. After this preparation is completed, sewing processing can be performed.

When the safety cover 3 is in a position other than the sewing position, the start/stop switch 16 cannot be operated because the start/stop switch 16 is covered with the safety cover 3. When the safety cover 3 is switched to the sewing position, the start/stop switch 16 is opposed to the switch operating hole 3*e*, so that the start/stop switch 16 can be operated. When the start/stop switch 16 is turned on (S13;Yes), the sewing processing (S14) is performed.

As shown in FIG. 43, pattern data of each embroidery pattern stored in the DVD 120 includes pattern section data of several pattern sections. The sewing cartridge is changed every pattern section to change a thread color. That is, as shown in FIG. 45, when the start/stop switch 16 is turned on (S13;Yes), the sewing processing (S14) is performed. Based on the pattern data of one pattern section, the embroidery frame driving mechanism 11 and the cartridge driving mechanism 12 are controlled and the pattern section is sewn on the work cloth 70.

When one pattern section is formed, the sewing operation of the pattern section is finished (S15). When a pattern section to be sewn next has a different color, the sewing cartridge 5 is changed to the sewing cartridge 5 that has a thread having a color for a pattern section to be sewn. In this case, for example, when a thread change is commanded by operating a predetermined button of the controller 7 (S16;Yes) before the sewing cartridge 5 presently attached to the sewing apparatus body 2 is detached therefrom, thread cutting preparation processing (S17) is performed in order to cut the thread and change the sewing cartridge 5.

In the thread cutting preparation processing of S17, the thread T extending between the pattern (work cloth 70) and the sewing cartridge 5 is placed between the cutting blades 133, 134 of the thread cutting mechanism 130. Specifically, the embroidery frame driving mechanism 11 is controlled by the controller 13 (the CPU 13*a*) so that the embroidery frame 4 is placed at the farthest position within the embroidery frame moving area 38 and the thread T extends in the front to rear direction. The thread T is stretched to the extent that the thread T does not come off or out from the work cloth 70. It is essential only that the thread T be placed between the opened cutting blades 133, 134.

When it is not necessary to change the sewing cartridge 5, the thread cutting preparation processing at S17 does not need to be performed. That is, when the thread change is not commanded (S16;No), flow returns to S13. Accordingly, the start/stop switch 16 is turned on (S13;Yes) while the sewing operation is stopped (S15), the sewing operation (S14) is started again. Thus, the next pattern section is formed.

As described above, according to the sewing apparatus 1, a desired embroidery pattern can be selected/edited from various kinds of embroidery patterns using the game machine 6. A selected/edited embroidery pattern can be sewn on a work cloth 70 attached to the embroidery frame 4. Further, a colorful embroidery pattern can be sewn using threads having different colors in several pattern sections forming the embroidery pattern. The work cloth 70 on which the embroidery pattern is sewn is removed from the embroidery frame 4 and is adhered with the double-sided adhesive tape 7. Thus, a patterned cloth 78 is obtained and can be attached to various items as an emblem.

While the sewing operation is performed, the embroidery frame moving area 38 can be covered with the safety cover 3 in the sewing position. Most of the sewing cartridge 5, including the hollow needle 81, and the swing arm 40 can be also covered by the safety cover 3. The safety cover 3 cannot be removed from the sewing apparatus body 2. In positions other than the sewing position, the safety cover 3 prevents the start/stop switch 16 from being operated. Thus, the sewing apparatus 1 is prevented from an undesired operation occurring. Accordingly, the sewing apparatus 1 offers a superior level of safety and operability.

The sewing apparatus 1 is convenient to carry and store because the sewing apparatus 1 is compact and lightweight. The embroidery frame 4 and the sewing cartridge 5 can be easily attached to and detached from the sewing apparatus 1. In the sewing apparatus 1, the safety cover 3 can be easily switched in its position between the storage position and the sewing position to attach/detach the embroidery frame 4 and the sewing cartridge 5 thereto/therefrom. The thread T extending between the hollow needle 81 and the work cloth 70 can be easily cut. Accordingly, the sewing apparatus 1 can be easily handled and operated.

The sewing condition can be observed via the safety cover 3 made of a transparent or a translucent material, so that a user's interest will be raised. Accordingly, the sewing apparatus 1 can be easily handled by all users, for example, by children. Further, the sewing apparatus 1 offers a superior level of safety and operability. Because character emblems can be made by which desired characters are selected from game software and are embroidered on a work cloth, children will get a lot of pleasure from the sewing.

In the aforementioned embodiment, a desired embroidery pattern is selected from various kinds of embroidery patterns stored in the DVD 120 and pattern data of the desired embroidery pattern is sent to the sewing apparatus 1 using the game machine 6. However, image data of a character in game software may be provided to the sewing apparatus 1 using the game machine 6 and pattern data may be created in the sewing apparatus 1, based on the image data.

It should be appreciated that the invention can be applied to an apparatus or method that performs sewing operation by which the embroidery frame 4 is secured and the sewing cartridge 5 is moved in parallel with the X-Y plane and up and down in the X-Y plane.

In the embodiment, sewing data is supplied from a DVD, which is an external storage medium, via a home video game machine. However, sewing data may be supplied from other types of external storage mediums such as an optical recording medium (e.g., a CDROM, a CD-R), a magnetic recording medium (e.g. a floppy disk), and a semiconductor recording medium (e.g. a flash memory).

In the embodiment, it is assumed that sewing data is stored in an external storage medium in advance. However, sewing data may be created by calculation of a CPU in the sewing apparatus body 2 or the game machine 6. For example, color image data of a game is divided by color and areas are specified by color. Then, the color-specific areas are specified as color-specific sewing areas. After that, sewing data for filling an area with Tatami stitches is created by color. Sewing data for stitching pattern sections so that boundary areas of the pattern sections overlap each other is created. Sewing data for stitching with Satin stitches as an outline of an embroidery pattern is created. A video capture function (a print screen function in a personal computer) can be used to capture image data as described above. A sequence of sewing of areas is determined based on size of areas and the lightness of the colors. However, an outline is preferably sewn last.

A data supply device connected to the sewing apparatus body 2 of the sewing apparatus 1 is not restricted to the home video game machine 6, but may be embroidery machines, computer sewing machines, radio-cassette players, satellite receiving tuners, karaoke terminals (including on-line and non on-line karaoke systems), facsimiles, cellar phones, televisions, videocassette recorders, music CD players, 8-millimeter video cameras, digital cameras or computers, if the apparatus has a function of handling data. Data communications with the sewing apparatus body 2 may be implemented via a cable 401. However, wireless data communication (including infrared rays) may be implemented.

For example, when a satellite receiving tuner is used, main audio information is used in a commercial and the satellite receiving tuner receives data and programs for the sewing apparatus body 2 through sub-audio information, which is not used for audio of the commercial while the commercial of the sewing apparatus 1, a manufacturer of the sewing apparatus 1, or other products is being run. Sewing may be performed by which data and programs received by the satellite receiving tuner is processed and the sewing apparatus body 2 is controlled. Data may be supplied to the sewing apparatus body 2 via other equipment, such as the home video game.

When the sub-audio information is used, advertising effectiveness may be ensured by which it is structured that the data and programs received by the satellite receiving tuner can be used only when the data is played back at a normal playback speed, in which the recorded commercial is watched, in a case where image data is recorded using a videocassette recorder. When a sewing machine is used as a data supply device, sewing can be performed using patterns installed in the sewing machine or patterns supplied from an external storage medium to be attached to the sewing machine. Sewing data is edited using a display and operating members provided on the sewing machine.

In the aforementioned embodiment, the sewing apparatus body 2 of the sewing apparatus 1 is directly connected with a data supply device via a cable. The sewing apparatus body 2 may be connected with the data supply device via a converter 400 so as to be connected with other equipment described above. The converter 400 may be dedicated to various equipment described above, or may have several types of connecting portions. If such a converter 400 is used, there is a possibility of using a general-purpose cable for connection. The sewing apparatus body 2 may be connected with one or more data supply devices, such as a second game machine 402, a third game machine 403, a data supply device 404 other than the game machine, and a sewing machine 405, at the same time. The converter 400 may contribute to only data transmission, or may be provided with a CPU so that data can be edited or converted in the converter 400.

In the aforementioned embodiment, because a patterned cloth, such as an emblem, is adhered to clothes using a double-sided adhesive tape, the patterned cloth can be easily attached to and detached from the clothes. Instead of the double-sided adhesive tape, hook-and-loop fasteners may be used. In a case where an emblem is attached to clothes via a double-sided adhesive tape or hook-and-loop fasteners, the emblem can be easily removed from the clothes when the clothes are washed.

Although the invention has been described in detail with reference to a specific embodiment thereof, it would be apparent to those skilled in the art that various changes and modifications may be made therein without departing from the spirit of the invention.

What is claimed is:

1. A method for performing sewing operation on a workpiece that is movable in all directions along an X-Y plane perpendicular to an axial direction of a hollow needle having an inclined opening that is formed by angularly cutting a portion of an end of the hollow needle that penetrates the workpiece with respect to the axial direction of the hollow needle, by reciprocating the hollow needle in a penetrating direction, using a thread threaded in the hollow needle, comprising the steps of:

forming a plurality of stitches in a first stitching direction; and forming a plurality of stitches in a second stitching direction opposite to the first stitching direction, following and in parallel with the plurality of stitches formed in the first stitching direction, by controlling direction of movement of the workpiece so that the stitches in the second stitching direction are preceded by a movement of the workpiece opposite to the needle tip opening direction.

2. The method according to claim 1, wherein the step of forming the plurality of stitches in the first stitching direction and the step of forming the plurality of stitches in the second stitching direction opposite to the first stitching direction, following and in parallel with the plurality of stitches formed in the first stitching direction, by controlling direction of movement of the workpiece so that the stitches in the second stitching direction proceed to an area opposite to the needle tip opening direction, are repeatedly performed in sequence.

3. The method according to claim 1, wherein the plurality of stitches are formed on a workpiece in a direction along a line that is angled between 20 and 160 degrees with respect to the needle tip opening direction.

4. The method according to claim 3, wherein a predetermined sewing area on the workpiece is filled with the plurality of stitches formed in the first and second stitching directions.

5. The method according to claim 3, wherein the plurality of stitches are formed in a direction along a line that is angled between 45 and 135 degrees with respect to the needle tip opening direction.

6. The method according to claim 1, wherein the needle tip opening direction is a direction of a line segment extending from an extreme tip of the hollow needle to an upper end of the hollow needle across an axis of the hollow needle, which is projected on the X-Y plane.

7. A method for performing sewing operation on a workpiece that is movable in all directions along an X-Y plane perpendicular to an axial direction of a hollow needle having an inclined opening that is formed by angularly cutting a portion of an end of the hollow needle that penetrates the workpiece with respect to the axial direction of the hollow needle, by reciprocating the hollow needle in a penetrating direction, using a thread threaded in the hollow needle, comprising a step of forming a plurality of stitches on a workpiece in a direction along a line that is angled between 20 and 160 degrees with respect to the needle tip opening direction.

8. The method according to claim 7, further comprising a step of forming a plurality of stitches in a second stitching direction opposite to the first stitching direction, following and in parallel with the plurality of stitches formed in the first stitching direction of between 20 and 160 degrees with respect to the needle opening direction, by controlling direction of movement of the workpiece so that the stitches in the second stitching direction proceed to an area opposite to the needle tip opening direction.

9. The method according to claim 8, wherein the step of forming a plurality of stitches in the first stitching direction and the step of forming a plurality of stitches in the second stitching direction opposite to the first stitching direction, following and in parallel with the plurality of stitches formed in the first stitching direction, by controlling direction of movement of the workpiece so that the stitches in the second stitching direction proceed to an area opposite to the needle tip opening direction, are repeatedly performed in sequence.

10. The method according to claim 9, wherein a predetermined sewing area on the workpiece is filled with the plurality of stitches formed in the first and second stitching directions.

11. The method according to claim 7, wherein the plurality of stitches are formed in a direction along a line angled between 45 and 135 degrees with respect to the needle tip opening direction.

12. The method according to claim 7, wherein the needle tip opening direction is a direction of a line segment extending from an extreme tip of the hollow needle to an upper end of the hollow needle across an axis of the hollow needle, which is projected on the X-Y plane.

13. A sewing apparatus that performs sewing operation on a workpiece including a workpiece movement controller that controls movement of the workpiece in all directions along an X-Y plane perpendicular to an axial direction of a hollow needle having an inclined opening that is formed by angularly cutting a portion of an end of the hollow needle that penetrates the workpiece with respect to the axial direction of the hollow needle, by reciprocating the hollow needle in a penetrating direction, using a thread threaded in the hollow needle, comprising:

a stitch forming unit that forms a plurality of stitches in a first stitching direction and forms a plurality of stitches in a second stitching direction opposite to the first stitching direction, following and in parallel with the plurality of stitches formed in the first stitching direction, by the workpiece movement controller controlling direction of movement of the workpiece so that the stitches in the second stitching direction are preceded by a movement of the workpiece opposite to the needle tip opening direction.

14. The sewing apparatus according to claim 13, wherein the stitch forming unit repeatedly forms, in sequence, the plurality of stitches in the first stitching direction and the plurality of stitches in the second stitching direction opposite to the first stitching direction, following and in parallel with the plurality of stitches formed in the first stitching direction, by the workpiece movement controller controlling direction of movement of the workpiece so that the stitches in the second stitching direction proceed to an area opposite to the needle tip opening direction.

15. The sewing apparatus according to claim 13, wherein the plurality of stitches are formed on a workpiece in a direction along a line that is angled between 20 and 160 degrees with respect to the needle tip opening direction.

16. The sewing apparatus according to claim 15, wherein a predetermined sewing area on the workpiece is filled with the plurality of stitches formed in the first and second stitching direction.

17. The sewing apparatus according to claim 15, wherein the plurality of stitches are formed in a direction along a line that is angled between 45 and 135 degrees with respect to the needle tip opening direction.

18. The sewing apparatus according to claim 13, wherein the needle tip opening direction is a direction of a line segment extending from an extreme tip of the hollow needle to an upper end of the hollow needle across an axis of the hollow needle and projected on the X-Y plane.

19. A sewing apparatus that performs sewing operation on a workpiece that is movable in all directions along an X-Y plane perpendicular to an axial direction of a hollow needle having an inclined opening that is formed by angularly cutting a portion of an end of the hollow needle that penetrates the workpiece with respect to the axial direction of the hollow needle, by reciprocating the hollow needle in a penetrating direction, using a thread threaded in the hollow needle, comprising:

a stitch forming unit that forms a plurality of stitches on a workpiece in a direction along a line that is angled between 20 and 160 degrees with respect to the needle tip opening direction.

20. A patterned cloth that is formed by performing sewing operation on a workpiece that is movable in all directions along an X-Y plane perpendicular to an axial direction of a hollow needle having an inclined opening that is formed by angularly cutting a portion of an end of the hollow needle that penetrates the workpiece with respect to the axial direction of the hollow needle, by reciprocating the hollow needle in a penetrating direction, using a thread threaded in the hollow needle, comprising:

a plurality of stitches formed in a stitching direction along a line angled between 20 and 160 degrees with respect to a needle tip opening direction that is a direction of a line segment extending in a direction normal to a middle of the arc-shaped cut surface.

* * * * *